US006993887B2

(12) United States Patent
Dharssi et al.

(10) Patent No.: US 6,993,887 B2
(45) Date of Patent: Feb. 7, 2006

(54) SYSTEM AND METHOD FOR INCLUDING PACKETS WITH GOODS DURING AUTOMATED PACKAGING

(75) Inventors: Fatehali Dharssi, Vancouver (CA); Joe D. Kitterman, Centerton, AR (US); William Patrick Reddie, Shoreline, WA (US); Vincent D. Rigney, Gentry, AR (US)

(73) Assignee: DSD Communications, Inc., Stamford, CT (US)

( * ) Notice: Subject to any disclaimer, the term of this patent is extended or adjusted under 35 U.S.C. 154(b) by 0 days.

(21) Appl. No.: 10/858,148

(22) Filed: Jun. 1, 2004

(65) Prior Publication Data

US 2005/0000189 A1 Jan. 6, 2005

Related U.S. Application Data

(60) Continuation-in-part of application No. 10/443,697, filed on May 22, 2003, now Pat. No. 6,792,737, which is a division of application No. 09/928,936, filed on Aug. 13, 2001, now Pat. No. 6,584,753, which is a continuation-in-part of application No. 09/780,950, filed on Feb. 9, 2001, now Pat. No. 6,662,525, which is a continuation-in-part of application No. 09/632,900, filed on Aug. 7, 2000, now abandoned.

(51) Int. Cl.
*B65B 61/20* (2006.01)

(52) U.S. Cl. ..... 53/445; 53/237; 53/252; 156/571; 156/DIG. 31

(58) Field of Classification Search ..... 156/215, 156/256, 566, 567, 564, 571, DIG. 31, DIG. 29; 53/237, 238, 250, 252, 258, 445, 447; 271/99, 271/102

See application file for complete search history.

(56) References Cited

U.S. PATENT DOCUMENTS

| | | | |
|---|---|---|---|
| 1,308,321 | A | 7/1919 | Armstrong |
| 1,602,881 | A | 10/1926 | Christensen |
| 1,683,789 | A | 9/1928 | Molins |
| 1,721,552 | A | 7/1929 | Foernsler |
| 1,805,119 | A | 5/1931 | Voigt |
| 1,818,923 | A | 8/1931 | Taylor |
| 1,913,642 | A | 6/1933 | Smith |
| 2,072,516 | A | 3/1937 | Ferenci et al. |
| 2,227,378 | A | 12/1940 | Milmoe et al. |
| 2,294,273 | A | 8/1942 | Buxbaum |
| 2,653,743 | A | 9/1953 | Stenger |

(Continued)

FOREIGN PATENT DOCUMENTS

| | | |
|---|---|---|
| DE | 1761426 | 6/1971 |

(Continued)

*Primary Examiner*—Louis Huynh
(74) *Attorney, Agent, or Firm*—Pillsbury Winthrop Shaw Pittman LLP

(57) ABSTRACT

The invention comprises a packet placing system for use with an automated packaging machine. Preferably, the system is used to include packets with products being automatically packaged, such as various bread products. The system may comprise various magazine orientations and arrangements for holding packets, a packet placer, and a gluing system. Preferably, the packet placer includes a vacuum system configured to pick a packet from the magazine. Glue is applied to a face of the packet, which is then placed on the outside of the wrapper of the packaged product. The system may be used in conjunction with a packet insertion mechanism in order to both insert a packet inside the wrapper and removably affix a packet to the outside of the wrapper. The invention also comprises methods of using the system.

95 Claims, 48 Drawing Sheets

U.S. PATENT DOCUMENTS 2,741,886 A 4/1956 Garapolo et al.
2,821,826 A 2/1958 Stubblefield
3,797,822 A 3/1974 Anderson
3,868,807 A 3/1975 Noyes et al.
3,926,425 A 12/1975 Pierce et al.
3,935,691 A 2/1976 Broch
3,937,458 A 2/1976 Langen
3,952,478 A 4/1976 Richards et al.
4,179,113 A 12/1979 Gallimore
4,182,222 A 1/1980 Stahl
4,248,032 A 2/1981 Woods et al.
4,268,344 A 5/1981 Jones
4,293,365 A * 10/1981 Geyser et al. ..... 156/DIG. 31
4,297,826 A 11/1981 Woertche
4,332,325 A 6/1982 Manizza
4,355,967 A 10/1982 Hellmer
4,418,906 A 12/1983 Scott
4,530,200 A 7/1985 Prewer
4,564,412 A * 1/1986 Oberdorf ..... 156/DIG. 29
4,649,692 A 3/1987 Tomosue
4,658,564 A 4/1987 Bell, Jr. et al.
4,709,851 A 12/1987 Vanasse
4,787,953 A * 11/1988 Trouteaud et al. ..... 156/571
4,815,251 A 3/1989 Goodman
4,833,861 A 5/1989 Hale et al.
4,837,956 A 6/1989 Dolence
4,908,761 A 3/1990 Tai
5,002,313 A 3/1991 Salvatore
5,065,943 A * 11/1991 Boger et al. ..... 239/298
5,079,901 A 1/1992 Kotsiopoulos
5,102,484 A * 4/1992 Allen et al. ..... 239/298
5,157,896 A 10/1992 Tisma
5,194,115 A * 3/1993 Ramspeck et al. ..... 156/578
5,238,190 A * 8/1993 Herke ..... 239/298
5,368,286 A * 11/1994 Horsman et al. ..... 271/11
5,431,274 A * 7/1995 Schaupp ..... 156/DIG. 31
5,477,662 A 12/1995 Rompa
5,481,094 A 1/1996 Suda
5,483,786 A 1/1996 Giesbrecht et al.
5,502,956 A 4/1996 Rompa
5,528,280 A * 6/1996 Endo et al. ..... 347/262
5,549,233 A 8/1996 Clauser
5,645,680 A 7/1997 Rietheimer
5,680,743 A 10/1997 Hoekzema
5,727,153 A 3/1998 Powell
5,737,899 A 4/1998 Supron et al.
5,806,044 A 9/1998 Powell
5,819,954 A 10/1998 Lacriola
5,826,356 A 10/1998 Lapp
5,941,053 A 8/1999 Kotsiopoulos
5,941,681 A 8/1999 Piotrowski et al.
6,035,605 A 3/2000 Perego
6,143,818 A * 11/2000 Wang et al. ..... 524/528
6,276,724 B1 8/2001 Zorn
6,421,986 B1 7/2002 Dharssi
6,434,914 B1 8/2002 Bouldin et al.
6,470,653 B1 10/2002 Lutz et al.
6,571,279 B1 5/2003 Herz et al.
6,584,753 B2 7/2003 Dharssi et al.
6,598,647 B1 * 7/2003 Draghetti ..... 156/567
6,662,525 B2 12/2003 Dharssi et al.
2002/0004732 A1 1/2002 Quigg

FOREIGN PATENT DOCUMENTS

DE 3545838 A1 7/1987
FR 2332935 6/1977

* cited by examiner

SYSTEM AND METHOD FOR INCLUDING PACKETS WITH GOODS DURING AUTOMATED PACKAGING

RELATED APPLICATION DATA

This is a continuation-in-part of Ser. No. 10/443,697, filed May 22, 2003, now U.S. Pat. No. 6,792,737, which is a divisional of Ser. No. 09/928,936, filed Aug. 13, 2001, now U.S. Pat. No. 6,584,753, which is a continuation-in-part of Ser. No. 09/780,950, filed Feb. 9, 2001, now U.S. Pat. No. 6,662,525, which is a continuation-in-part of Ser. No. 09/632,900, filed Aug. 7, 2000, now abandoned.

BACKGROUND OF THE INVENTION

1. Field of the Invention

The present invention relates to the field of automated packaging and specifically to the delivery of packets to be automatically included with a product being packaged.

2. Description of Related Art

Automated bread packaging devices are widely used to wrap loaf bread in plastic. However, when packaging bread (or other consumer products or commodities), it can be desirable to include coupons, promotional material, or other printed material directed at the purchaser of the product. Prior-art systems for placing this material into, or on the outside of, the package have generally been deficient. For example, coupons and the like can be inserted manually, after the bread/product has been placed in the wrapper and prior to closure, but this is labor intensive and time consuming. Similar problems characterize systems that place the coupons into the bag before wrapping the bread/product.

In addition, existing systems for placing the coupons outside the bag suffer from problems relating to consistency, efficiency, and adhesion reliability. Thus, in some systems, where either no adhesive is used, or the inherent and/or application properties of the adhesive are not fully compatible with the adhesion surfaces, coupons and other similar material that are placed on, or attached to, the (bread) bag may fall (or come) off the bag and be lost during the production, delivery, distribution, or shelving/sales processes. Other existing methods, on the other hand, may affix the coupon to the bag permanently, so that removal of the coupon requires tearing of the (bread) bag. Similarly, other systems have proven inadequate as they utilize adhesives and operating conditions that cause partial or complete melting of the (bread) bag during application.

Thus, prior-art automated means for including a coupon with the product packaging have required relatively complicated and expensive machinery and suffer from reliability problems. Further, these prior-art systems often require significant modification or even replacement of otherwise useful automated packaging machines.

Accordingly, what has been needed is an automated system for including packets with packaged bread and other similar consumer goods/commodities. There is also a need for such an automated system that easily integrates with existing automated packaging machines. This invention satisfies these and other needs.

DETAILED DESCRIPTION OF THE INVENTION

Figure 1:
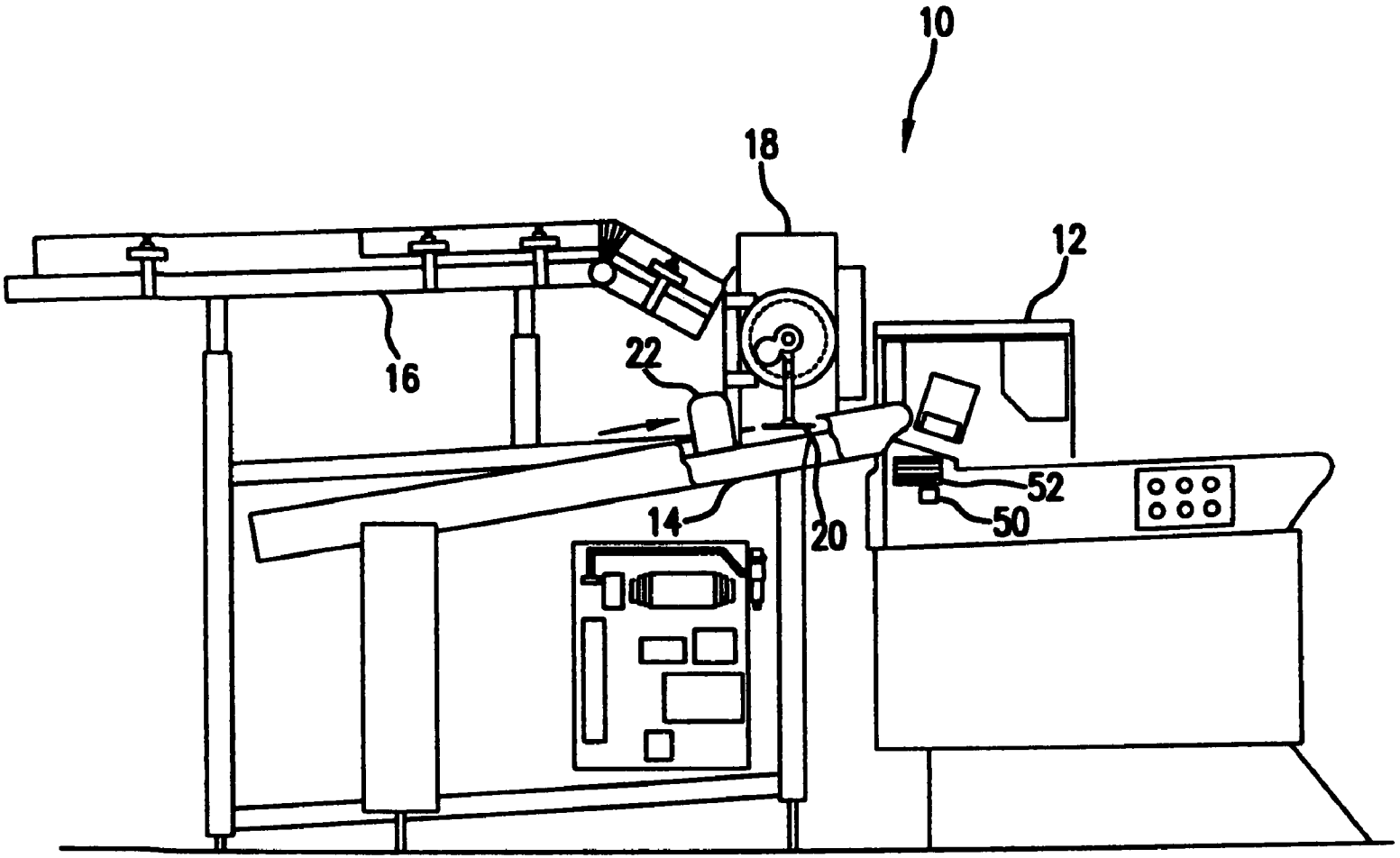
FIG. 1 is a schematic view of the insert delivery system of an embodiment of the invention in use with an automated bread packaging machine.

This invention is directed to a packet delivery system and method for use with an automated product packager having an infeed to convey a product to be packaged. As is explained in further detail below, it is critical that the movement of the various components of the system be synchronized, such that each component can be positioned in the proper location at the appropriate time. In general, this is accomplished by: (1) placing sensors in critical locations within the components of the system, as well as on other devices that operate in conjunction with the system; (2) providing information gathered from the sensors as input into a control mechanism, such as a programmable logic controller (PLC), or other similar device (e.g., a digital computer system with programmable memory in communication with an IT system); and (3) using the PLC or other similar device to activate the various components of the system at the appropriate time.

It is noted that, in the description that follows, the words "wrapper" and "bag" are used interchangeably. In addition, the terms "coupon" or "coupons" may be used from time to time as an example of, or synonymously with, "promotional material" or "advertising material". However, such use is by way of example, and for ease of reference, only, and not by way of limitation. Similarly, the terms "bread" or "bread product" are used by way of example (e.g., of a product to be packaged), and in order to facilitate the description, and not by way of limitation, such that products other than bread are also within the scope of the invention. Moreover, "bread" or "bread product" may refer to a loaf of bread (e.g., sliced, unsliced, etc.), buns (e.g., hamburger buns, hot dog buns, etc.), tortillas (e.g., flat, shaped, etc.), bagels, rolls, and other bread products or bread-type products (e.g., rice cakes, pop-corn cakes, etc.).

Finally, the term "packet" is used to refer generally to one or more coupons, promotional/advertising material, product samples, etc. that may be included with a package (e.g., of bread) by either inserting into, and/or affixing to the outside of, the package. Thus, where a single coupon, product sample, etc. is used, the latter constitutes the "packet" that is included with the package (of bread). On the other hand, where a plurality of coupons, product samples, etc. are used, the latter may be enclosed within a "packet", which is then included with the package of bread. Also, the "packet" may be constituted by several loose-leaf coupons, etc. that are bound together, but not necessarily enclosed within an envelope or "packet".

In one embodiment, the system comprises an insert delivery tray configured to present a packet as an insert to an insert placer, wherein the insert delivery system is configured so that the insert placer delivers the insert onto the infeed conveyor upstream of the product. As noted, the insert may be coupons, promotional material, or the like. The system is particularly suited to automatic packagers of the type used to wrap bread. In a preferred embodiment, the insert placer is a reciprocating-type placing machine (hereinafter referred to as a "recipe placer") having an arm that cycles between a packet pick-up position and a packet drop-off position, with a packet holder that is adjacent the insert delivery tray and secures the insert when the arm is in the insert pick-up position and is adjacent the conveyor and releases the insert when the arm is in the insert drop-off position. More preferably, the packet holder comprises a vacuum system.

In an alternative embodiment, the system comprises an insert delivery tray that is configured to present a packet as an insert to a packet placer. The packet placer, in turn, delivers the packet to a feeder mechanism (alternatively referred to as a "packet deposition mechanism") that is disposed adjacent, and above, a distal portion of an (infeed) conveyor. The feeder mechanism deposits the packet onto a scoop that has been advanced, or extended, towards a forward position, in order to receive the product (e.g., bread). In a preferred embodiment, the scoop has two sets of air apertures, wherein each set is preferably arranged in a line, and wherein at one selected time the air apertures provide a suction vacuum for securely retaining the packet that is placed on the scoop, and at a second selected time the air apertures provide blow-off air, which helps separate the packet from the scoop before the scoop slides back to its retracted position. Also, as the scoop slides back, air is blown through the apertures to clear any bread crumbs that may have accumulated.

In another embodiment, the system comprises a packet/insert conveyor that is configured to present a packet as an insert to a packet placer, wherein the packet placer delivers the packet to a feeder mechanism which, in turn, deposits the packet onto a fully-retracted scoop before the scoop receives the product, e.g., a loaf of bread. In a preferred embodiment, the scoop has two sets of air apertures, wherein each set is preferably arranged in a line, and wherein at one selected time the air apertures provide a suction vacuum for securely retaining the packet that is placed on the scoop, and at a second selected time the air apertures provide blow-off air, which helps separate the packet from the scoop before the scoop slides back to its retracted position, where it picks up another packet. Also, as before, as the scoop slides back, air is blown through the apertures to clear any bread crumbs that may have accumulated.

In yet another embodiment, the system comprises a scoop which has an additional lower compartment for carrying a packet as an insert. When in the fully-retracted position, a packet is deposited into the compartment, which is equipped with a means for driving the packet out from the distal end of the compartment once the scoop has been advanced (i.e., extended). Preferably, once the scoop has received a bread product and extended into a wrapper, a plunger is used to push the packet into the wrapper, so that the packet will lie underneath the bread once the latter has been fully placed into the wrapper. Alternatively, a stop pin, a bar, or other similar member may be positioned perpendicularly through the scoop and lower compartment. In this way, as the scoop is being retracted, the packet is automatically expelled from the lower compartment, thus obviating the need for a plunger.

In yet another embodiment, the system comprises an insert deposition mechanism (e.g., a plurality of feeder mechanisms, each of which delivers a separate packet, or a feeder mechanism that is capable of delivering more than one packet at a time) whereby one or more packets may be delivered onto the scoop assembly through a line of insertion that is parallel to the longitudinal axis of the scoop. Preferably, when more than one packet is being deposited on to the scoop, the packets are delivered substantially simultaneously such that all packets are included with the product being packaged. Thus, for example, when two packets are to be included as inserts with a loaf of bread, an insert can be included on each of two different sides of the loaf, so as to generate a bread package with two separate inserts.

The invention described herein also includes an ejection mechanism whose operation is synchronized with the operation of the packet delivery system and the automated product packager. When activated, the ejection mechanism utilizes air pressure, a mechanical device (e.g., a plunger), an electro-mechanical device, or other similar means to ensure that packets that have been misfed, are stuck, or otherwise obstruct the continuous operation of the system are removed. Regardless of the actual mechanism used, however, the ejection mechanism is configured such that the operation of the mechanism does not interrupt the operation of the remainder of the system, i.e., the bagging of the bread.

Certain embodiments of the invention further comprise a second delivery tray, e.g., a packet/insert conveyor or magazine (generically referred to as "tray" or "delivery tray"), having a different packet, wherein the delivery trays are movable so that the packet placer can access either tray or conveyor depending upon which packet is desired. Similarly, the two trays may also contain the same packet, such that, when the packets of one tray have been placed, operation of the system can continue uninterrupted by simply switching to the second tray and continuing to place packets as needed. In other embodiments, more than two delivery trays may be employed wherein, as before, the trays may contain identical, or different, packets. In yet other embodiments of the invention, the delivery tray is configured to accommodate a three-fold insert that wraps around the bottom and sides of the packaged item.

In yet other embodiments, the delivery tray, or packet conveyor, may be a carousel and magazine assembly. Here, a rotating carousel is equipped with a plurality of vertical magazines, each of which holds a set of packets (e.g., inserts). Each magazine is also equipped with sensors, so that, each time a packet in picked up by a packet placer device, a magazine packet advancement mechanism is activated to move the stack of packets up in the vertical direction, so as to present the next packet to the packet placer device. When the packets in one magazine are depleted, a sensor activates a servo motor, which in turn rotates the carousel in order to present the next magazine to the packet placer device. In addition, in this embodiment, the suction cups of the packet placer device move in two linear directions between a pick-up and a drop-off position.

In embodiments where a plurality of packets are delivered to the scoop assembly, the packet deposition mechanism (e.g., a plurality of feeder mechanisms, or a single, modified feeder mechanism, as discussed above) may be adapted to receive a packet from each of a plurality of magazines which may, in turn, be positioned on either the same, or separate carousels.

Other embodiments of the invention are directed to using a packet placer, in conjunction with a fastening or attachment mechanism, to place one or more packets on the outside of the packaged product. Here, the operation of a packet delivery tray and a recipe placer having one or more suction cups is coordinated with that of a fastening/attachment mechanism in order to pick up and deliver a packet from the tray to the outside of the packaged product. In a preferred embodiment, a gluing system is used as the fastening/attachment mechanism, wherein the latter is configured to spray glue onto the packet as the packet travels between the delivery tray and the conveyor carrying the packaged product (e.g., a bread product). The system is synchronized such that, as the recipe placer reaches its "placing" position, the bag of bread is positioned underneath the packet, and the packet, having had the glue applied to it, is removably affixed to the top side of the bag. In alternative embodiments, the packet may be affixed to other sides of the bag either in place of, or in addition to, the top of the bag.

In alternative embodiments, a plurality of trays (e.g., magazines), carrying either identical or different packets, may be employed. In addition, the magazines and the recipe placer may be placed such that the longitudinal axes of the magazines, as well as the path of motion of the recipe placer, are either parallel, or perpendicular, to the line of motion of the product conveyor (and the packaged product). In yet other embodiments, a plurality of the systems and devices described above may be used in combination to provide at least one packet inside, and affix at least one packet outside, the packaged product.

The invention also includes methods of using an insert delivery system with an automated product packager. Generally, a method according to the invention comprises providing an automated product packager having an infeed and a packet delivery system having a first delivery tray configured to present a first packet as an insert to a packet placer, wherein the packet delivery system is configured so that the packet placer delivers the insert onto the infeed upstream of the product. The product is advanced along the infeed and a packet holder on the packet placer is operated to select and secure the packet from the delivery tray. The packet placer is then moved so that the holder is adjacent the infeed and the packet is released from the holder. This deposits the packet on the infeed upstream of the advancing product. The automated packager may then wrap the product and the packet together.

Alternatively, a method for including packets with goods during automated packaging includes providing an automated product packager (e.g., bread-bag packager) having an infeed and a packet delivery system having a first card conveyor configured to present a first packet as an insert to a packet placer, wherein the packet delivery system is configured so that the packet placer delivers the packet to a feeder mechanism. The feeder mechanism deposits the packet onto a bread scoop just before the scoop is advanced from its retracted position to receive the product (e.g., a loaf of bread) from the infeed conveyor. The loaded bread scoop is then advanced, receives the loaf of bread, deposits the loaf and the packet (insert) into a bag, and then retracts for another cycle. The automated packager may then wrap the product and the packet together.

Alternatively, the feeder mechanism may be provided in a position above the scoop when the scoop is in its extended position, wherein the scoop receives the packet after it has been extended, but before it receives the loaf of bread.

Additionally, a method for including packets with goods during automated packaging may include providing a scoop with an additional compartment underneath the scoop, depositing a packet in the compartment when the scoop is in the retracted position, advancing the scoop to receive the loaf of bread, advancing the distal ends of the scoop and compartment into a wrapper, and simultaneously depositing the packet and the bread into the wrapper before the scoop-and-compartment assembly is retracted.

Alternatively, a method for including packets with goods during automated packaging may include providing one or more packet deposition mechanisms for delivering one or more packets onto the scoop assembly through a line of insertion that is parallel to the longitudinal axis of the scoop. The delivery, or deposition, of the packets is performed substantially simultaneously such that all of the packets are included with the product being packaged. Thus, for example, when the product is a loaf of bread, a packet can be included as an insert on one or more sides of the loaf, so as to generate a bread package with one or more separate inserts.

In other embodiments, a method for including packets with goods during automated packaging may include affixing a packet to the outside of each package of bread (or other product) by using a packet placer, such as a recipe placer, in conjunction with a fastening or attachment mechanism, such as a gluing system. The operation of a packet delivery tray and the recipe placer are coordinated with that of the gluing system such that the gluing system sprays glue onto the packet as the packet travels between the delivery tray and the conveyor carrying the packaged product (e.g., a bread product). As the recipe placer reaches its "placing" position, the bag of bread is positioned underneath the packet, and the packet is removably affixed to the top side of the bag. The temperature of the glue, the placement of the glue device within the overall system, as well as the duration of glue application are determined based on several factors, including the type of product that is being wrapped and the wrapper that is being used to bag the product.

FIG. 1 shows an automated bread packaging station 10 comprising a bread packaging machine 12, a product conveyor 14, a packet delivery tray 16 and a packet placer 18, configured to include a packet 20 with individual (sliced or unsliced) bread loaves 22 as they are wrapped. Bread packaging machine 12 generally is conventionally known in the art and its function in conjunction with the invention is described below (e.g., with reference to FIGS. 6–9). Product conveyor 14 is also similar to those in conventional use and utilizes a driven flight system to urge the individual loaves 22 along a smooth table, although other conventional means such as conveyor belts may also be used. In addition, as noted previously, the depiction of, and reference to, a bread loaf 22 in the description of the diagrams herein is by way of example only, and the systems and methods of the invention may be used in conjunction with other products, and other bread products, e.g., hamburger buns, hot dog buns, tortillas, bagels, rolls, etc.

Figure 2A:
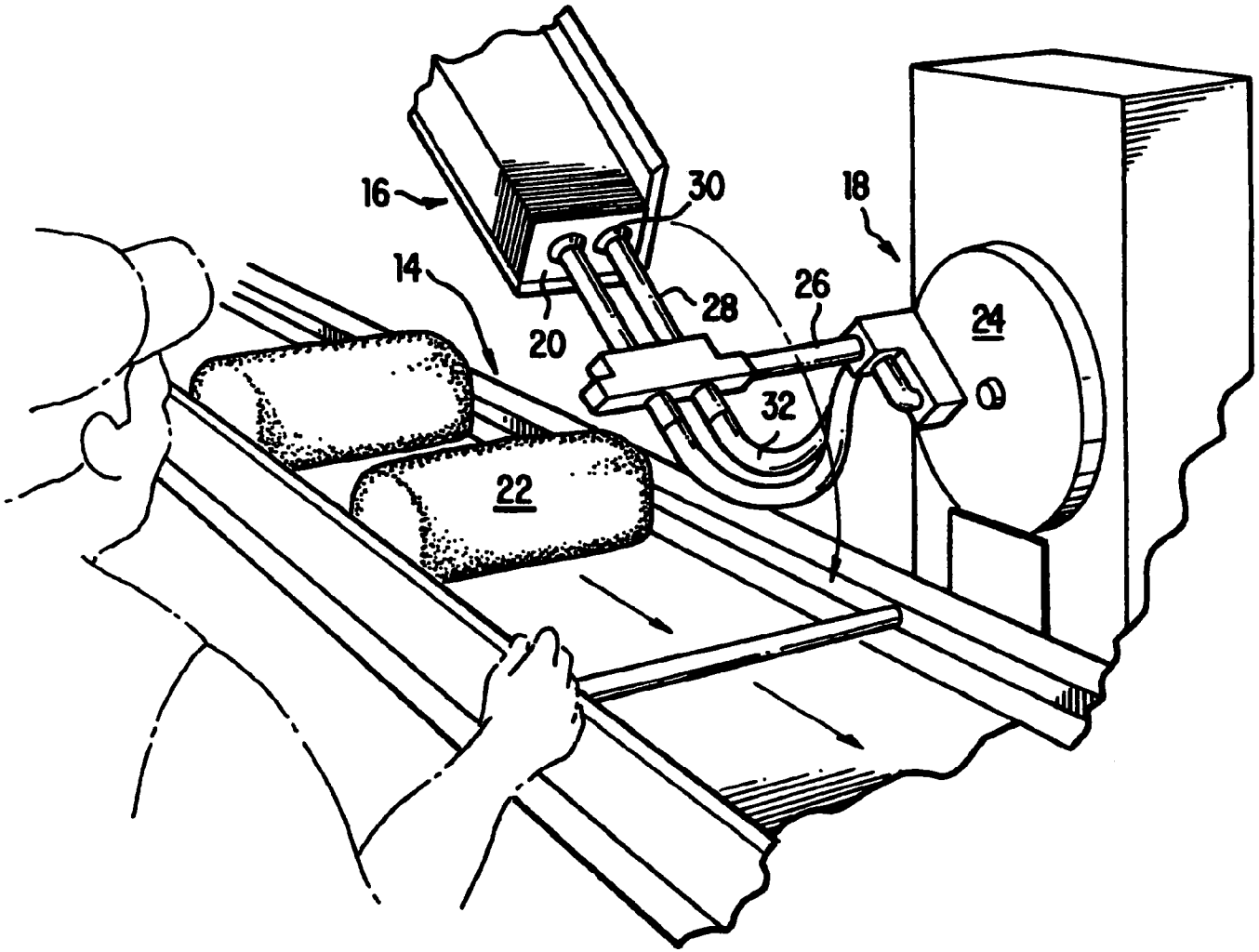
FIGS. 2A and 2B is a view of the insert delivery system of an embodiment of the invention oriented adjacent the infeed of the automated bread packaging machine.
Figure 2B:
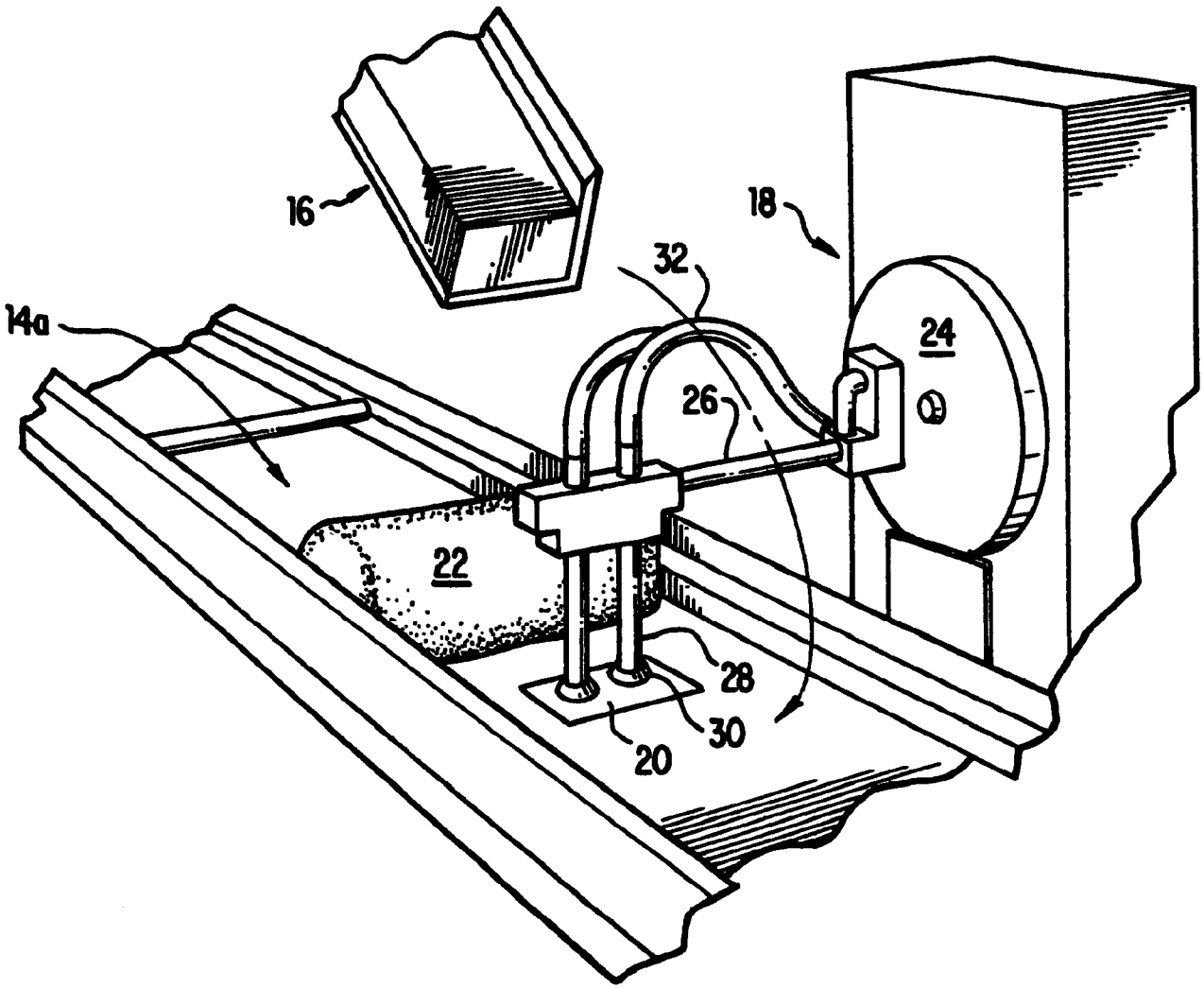

Packet placer 18 cycles between the two positions shown in FIGS. 2A and 2B to select a packet 20 from delivery tray 16 and then place it just upstream of the advancing loaf 22. In a preferred embodiment, packet placer 18 comprises rotating drive plate 24 having arm 26. Stems 28, each carrying a vacuum cup 30, are generally perpendicular to arm 26. The system is configured so that in the position shown in FIG. 2A, the vacuum cups are brought into contact with packet 20 which is accessible through the open end of delivery tray 16. The system applies a vacuum to cups 30 through hoses 32 and stems 28, thus securing packet 20 to the cups 30. Rotation of drive plate 24 swings the arm 26 and stems 28 to the packet drop-off position shown in FIG. 2B. The vacuum is released so that packet 20 remains on product conveyor 14 when packet placer 18 swings back to the packet pick-up position of FIG. 2A. Packet 20 is carried by the advancing loaf 22 to packaging machine 12.

Preferably, the packet placement motion is triggered by sensing the presence of a loaf 22 at the appropriate location on product conveyor 14 (e.g., via a sensor placed at position 14*a*, that, for illustrative purposes, may be about ¾ of the way along the conveyor 14 shown in FIG. 2B). The sensing may be accomplished by optical, mechanical, or any other suitable means.

In a preferred embodiment, packet delivery tray 16 is generally U-shaped and about six inches wide and three inches high. In this embodiment, a twelve-inch end portion of tray 16 adjacent packet placer 18 angles downward at about 30 degrees. In other embodiments, the dimensions of tray 16 generally should accommodate the size of packet 20, and the configuration of tray 16 may be adapted to packet placer 18, packaging machine 12, and product conveyor 14. Thus, in one embodiment, the tray 16 may be slanted in a downwards direction along the entirety of its length.

Figure 3:
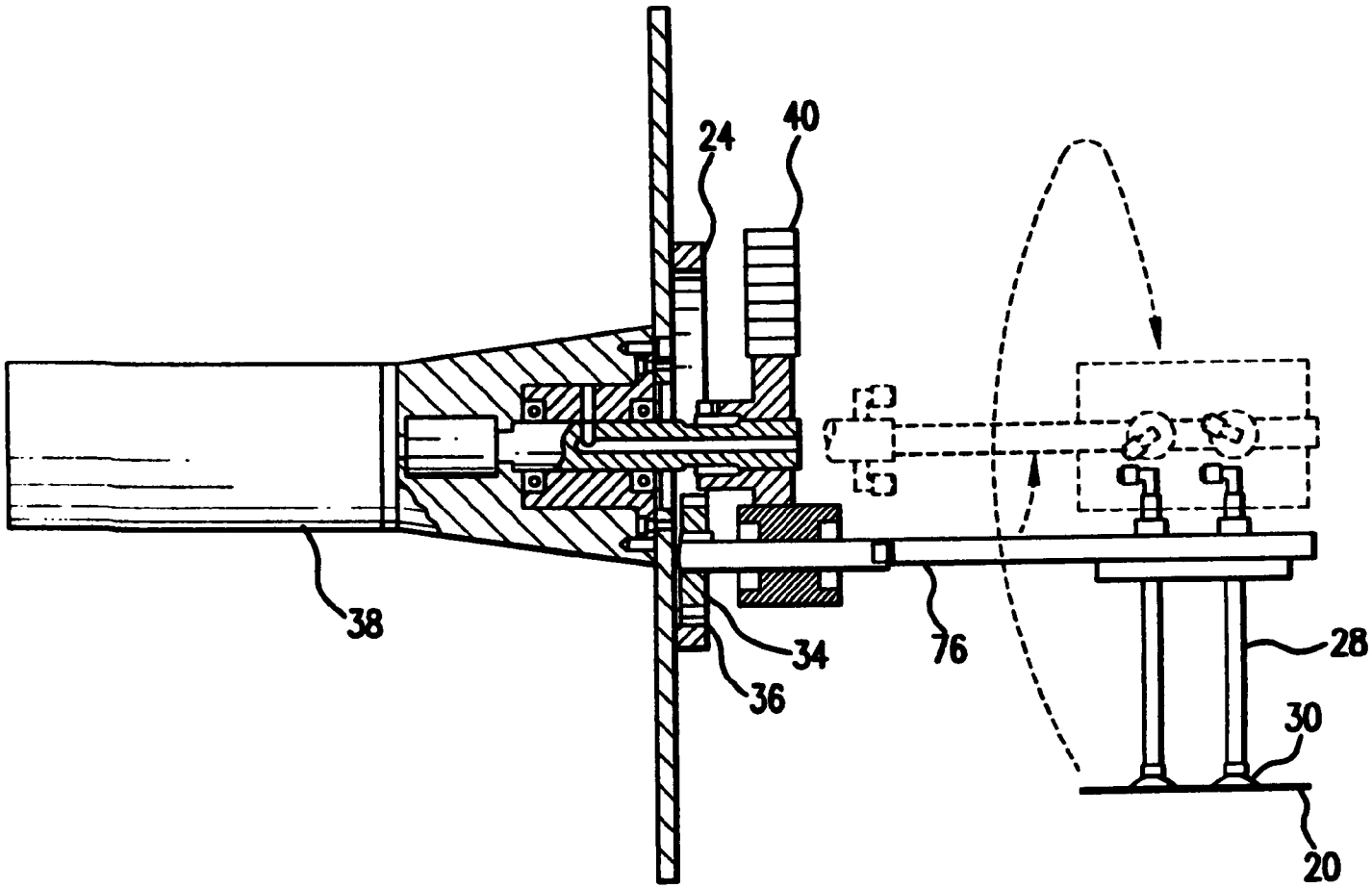
FIG. 3 is a detail top view of the insert delivery system of an embodiment of the invention.
Figure 4:
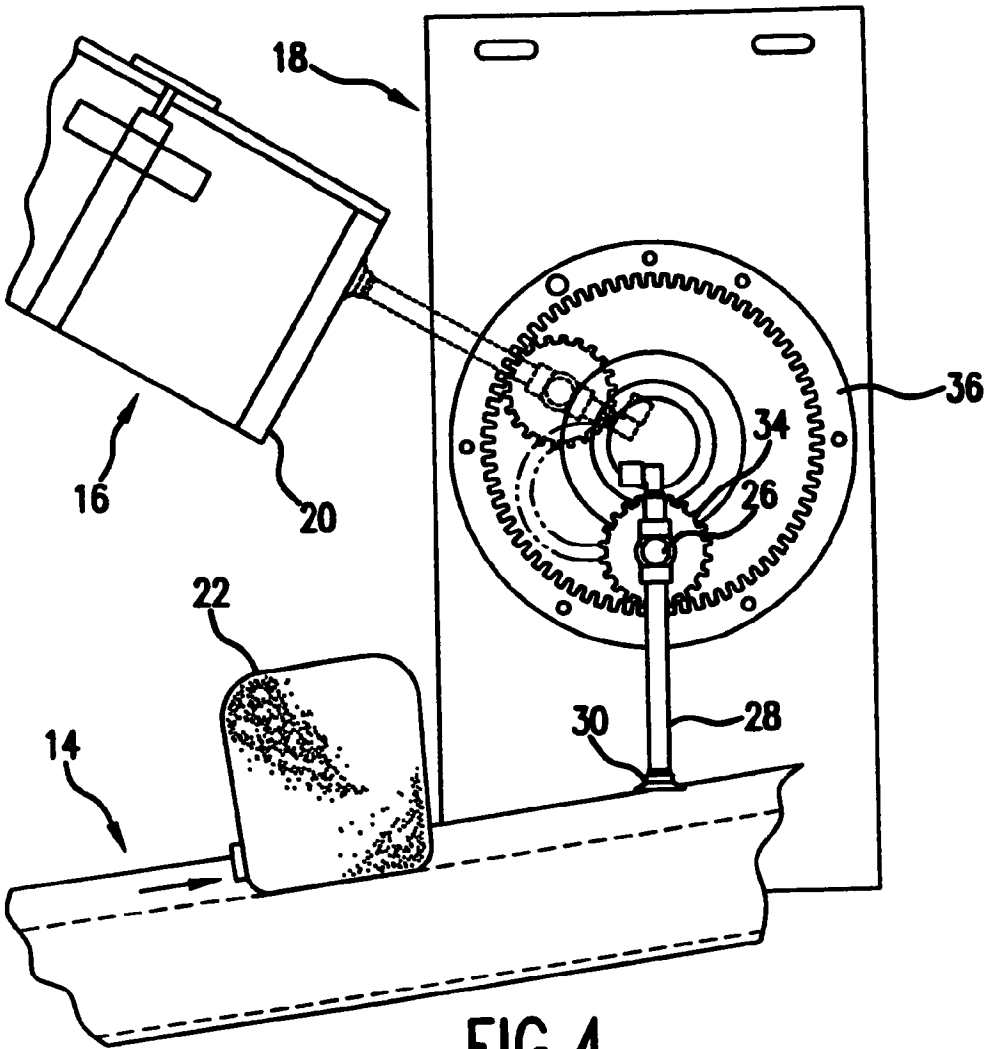
FIG. 4 is a detail side view of the insert delivery system of an embodiment of the invention.

FIGS. 3 and 4 show, partially in section, further details of the embodiment shown in FIGS. 2A and 2B. FIG. 3 is a top view showing the motion between the packet pick-up position and the drop-off position (shown in phantom). Arm 26 is driven by pinion gear 34 and ring gear 36 via servo motor 38. A counter weight 40 may be positioned opposite arm 26 to decrease the load on the servo. Similarly, FIG. 4 is a side view showing the motion between the drop-off position and the pick-up position (shown in phantom).

Other embodiments of the invention may employ different packet holding and delivery mechanisms. For example, the packets may be presented by the delivery tray in an edgewise manner. In such embodiments, the packet holder generally comprises an articulated gripper as opposed to the vacuum cup arrangement. It is also noted that delivery motions other than the rotation described herein may be used. Further, the packet delivery tray may be configured to simply release single packets, allowing gravity to drop them into position ahead of the advancing loaves.

In yet other embodiments, the delivery tray may be replaced by a carousel and magazine assembly. Here, a rotating carousel is equipped with a plurality (typically, between four and eight) of vertical magazines, each of which holds a set of packets which are placed horizontally in the magazine and stacked in a vertical arrangement. Each magazine is also equipped with sensors, so that, each time a packet is picked up by a packet placer device, a magazine packet advancement mechanism is activated to move the stack of packets up in the vertical direction (via, e.g., a lead-screw-and-knot assembly, or an air-cylinder-and-brake assembly), so as to present the next packet to the packet placer device. When the packets in one magazine are depleted, a sensor activates a servo motor, which in turn rotates the carousel in order to present the next magazine to the packet placer device.

In addition, the sensors are configured to detect packets that are stuck together. In such a situation, the packets are still delivered to the feeder mechanism. However, having been alerted by the sensors, the feeder simply ejects the stuck packets away, rather than deliver them to the scoop assembly.

One or more additional bar code readers can be mounted on the carousel and magazine assembly to determine whether the identity of the packet is proper for the particular type or brand of bread being wrapped. In addition, since the bar code on each packet identifies the chain store (e.g., Albertson's, Safe Way, etc.) to which the bag will be delivered, as well as, e.g., the brand of the bread, the bar code readers can also determine whether the correct packets (e.g., inserts intended to be included in products for Albertson's stores) are being delivered to the correct bags (e.g., bags that will be going to Albertson's stores, and not to Safe Way stores).

The packet placer device comprises suction cups of the kind discussed above, except that, in this embodiment, the cups do not cycle by rotating between a pick-up and a drop-off position. Rather, the suction cup assembly (e.g., the holder, having an arm and one or more suction cups) of the placer device moves in two linear directions. Thus, as a packet is presented atop the stack of packets in a magazine, one or more suction cups move vertically downwards in a direction that is perpendicular to the plane of the packet, and secure the packet from above; they then move vertically back up. With the packet secured, the suction cup assembly moves in a direction that is parallel to the plane of the packet (i.e., usually horizontally), until it reaches a drop-off position. Here, the suction cup assembly either releases the packet in the drop-off position, or moves vertically down before releasing the packet.

Figure 5:
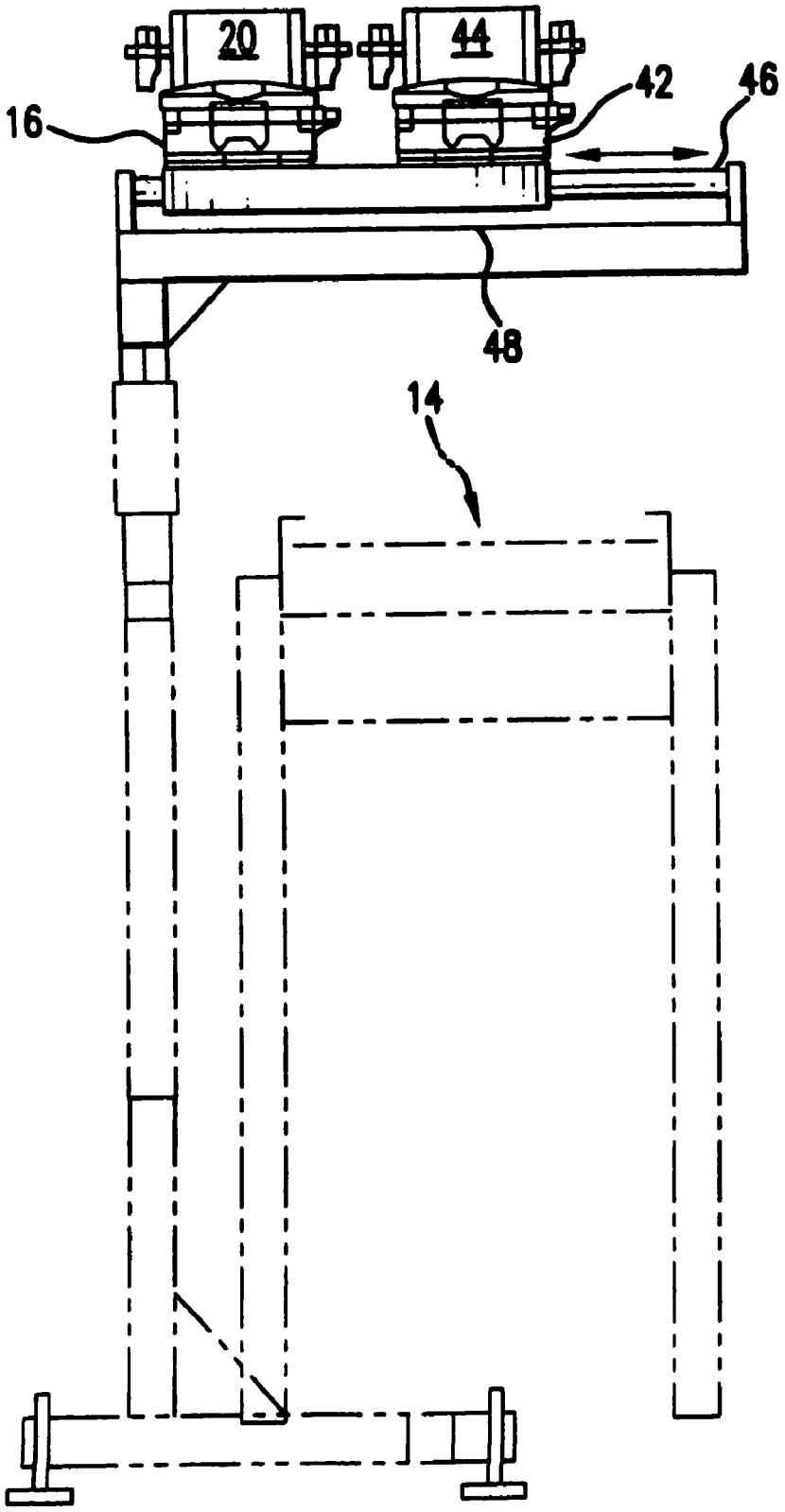
FIG. 5 shows an alternate embodiment of the invention comprising two insert delivery trays.

Returning to FIGS. 1, 2A, and 2B, packet delivery tray 16 preferably presents a stack of individual packets 20 to packet placer 18. The stack of packets may be moved along tray 16 by any suitable mechanism, such as by a spring loaded system. One embodiment employs a conveyor belt to maximize the capacity of the system. Optionally, the invention comprises a plurality of delivery trays 16 and 42 as shown in FIG. 5, carrying packets 20 and 44 respectively (packet placer 18 is not shown for clarity). Trays 16 and 42 slide along rail 46 so that either may be presented to packet placer 18. In this embodiment, movement of the trays is actuated by hydraulic cylinder 48, although any other suitable mechanism may be employed. Preferably, tray 16 and tray 42 are spaced about 11 inches on center to accommodate a typical packet size of about 3 inches by 6 inches. These dimensions may be adjusted as desired. In addition, more than two trays may be used, and each tray may be slanted downwards towards the packet placer 18.

In one embodiment of the invention, a sensor 50, such as a bar code reader to scan the UPC label of the wrappers 52, is provided on the packaging machine 12. The information from sensor 50 is used, in conjunction with a control mechanism (such as a PLC, or other similar device), to control cylinder 48 to automate the selection of either packets 20 or 44 depending upon the product being packaged as indicated by the wrappers 52. This allows the user of the information to tailor the packets to the expected demographic of the buyer of the particular product, for example.

Figure 6:
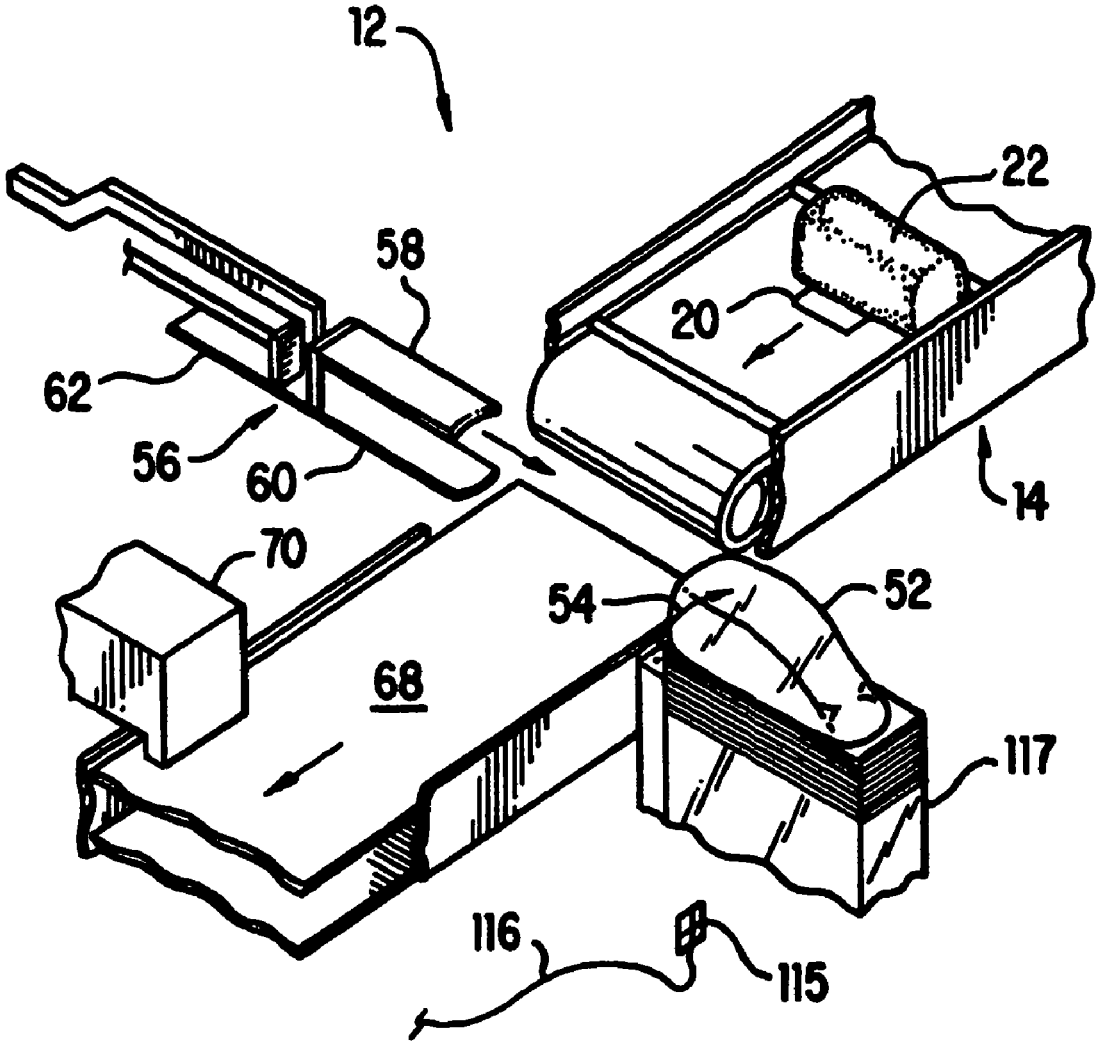
FIGS. 6–9 are schematic views of a bread packaging system suitable for use with embodiments of the invention, showing a loaf of bread and an insert being wrapped.
Figure 7:
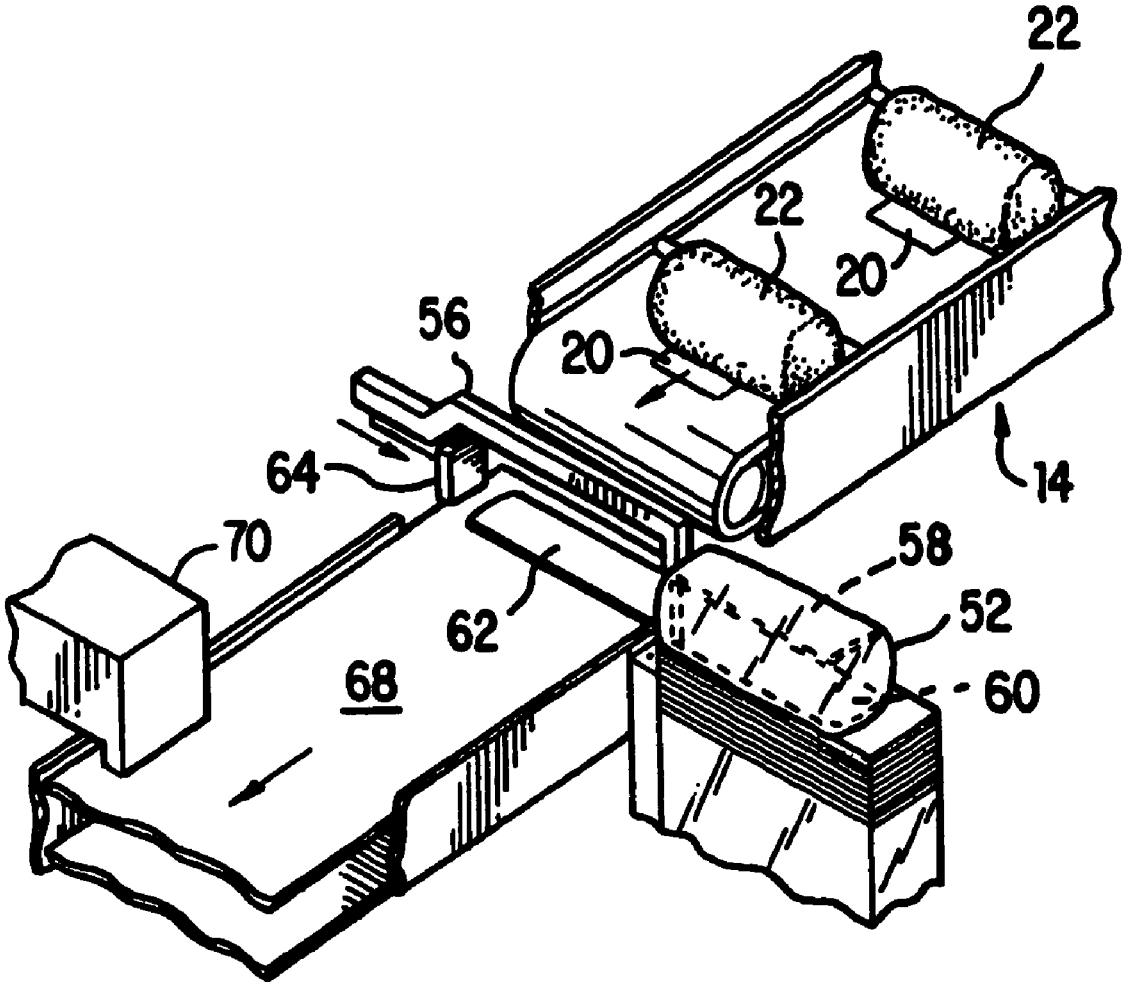
Figure 8:
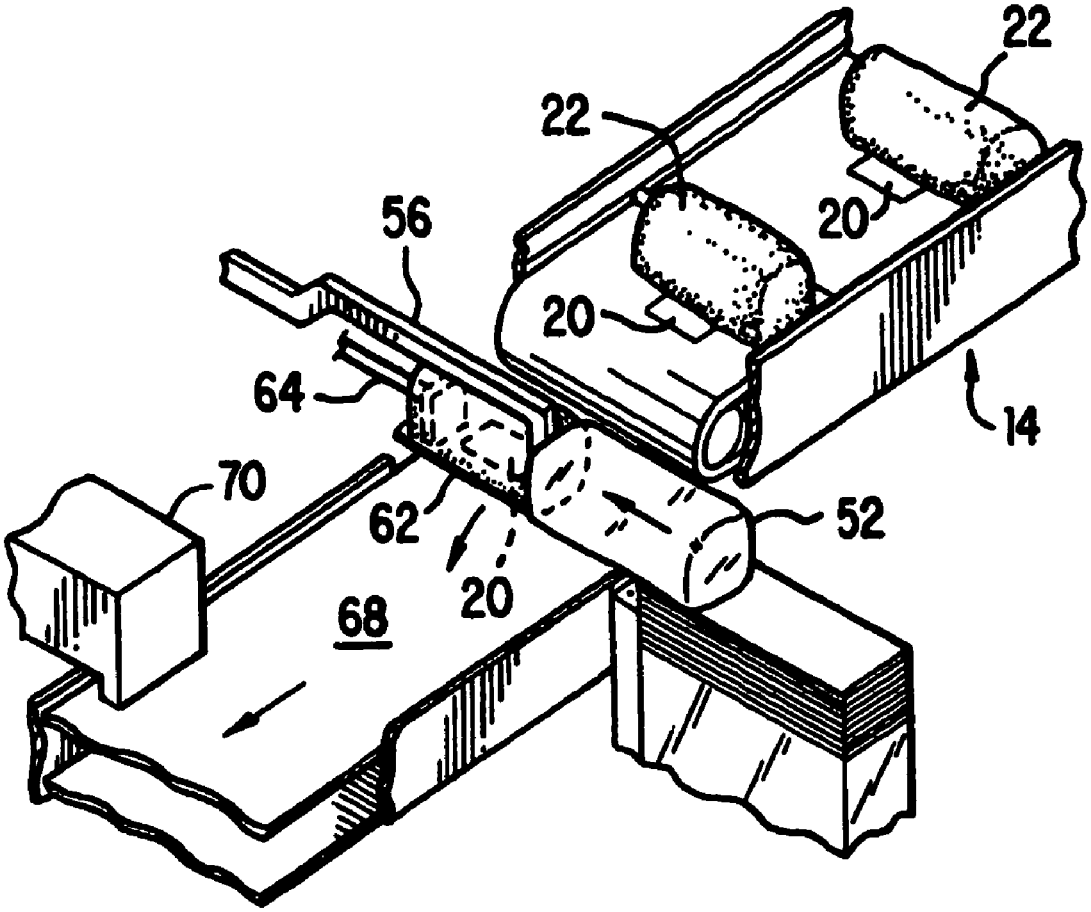
Figure 9:
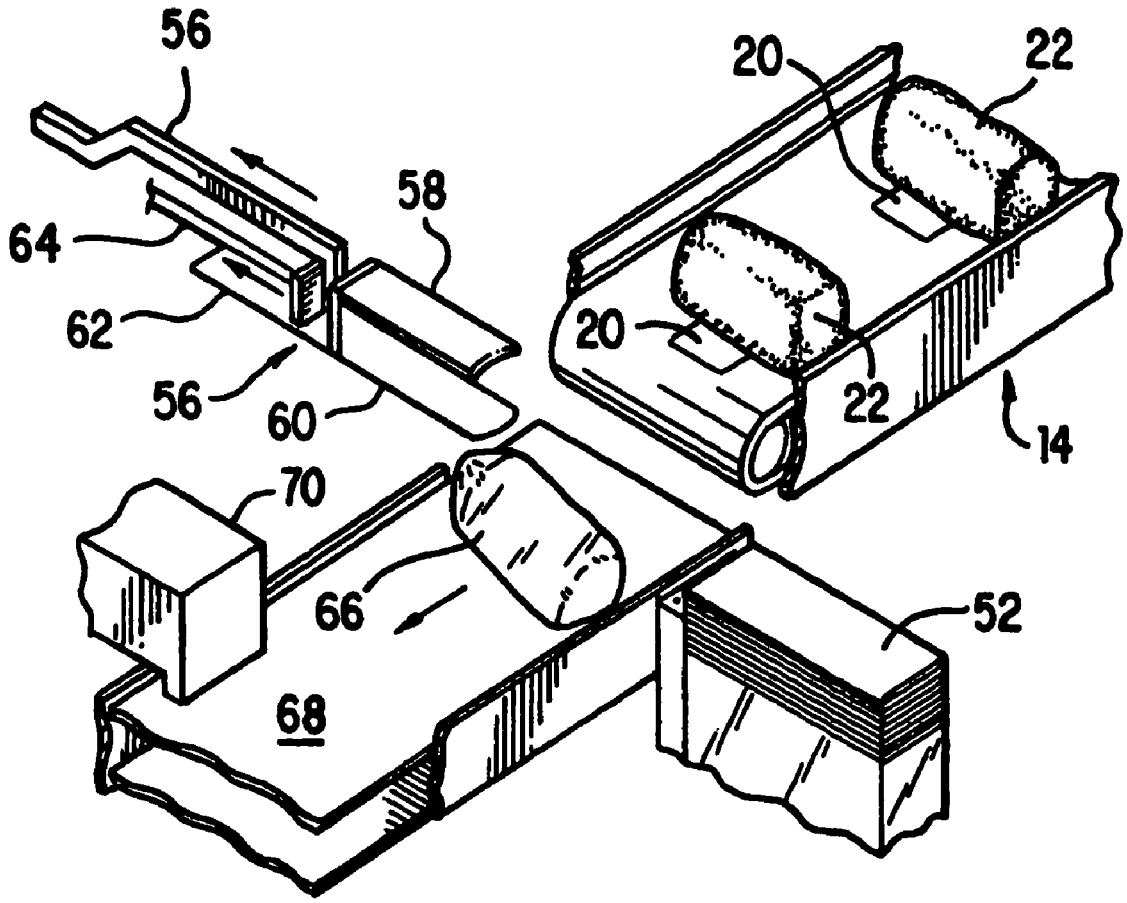

FIGS. 6–9 schematically show how packaging machine 12 wraps the loaves 22 and packets 20 (as inserts) provided by packet placer 18 and delivery tray 16. In FIG. 6, the advancing loaf 22 pushes packet 20 ahead of it. Wrapper 52 is opened, preferably with a jet of air 54, to receive therein scoop 56. Scoop 56 has upper and lower clamshell members 58 and 60, wherein lower member 60 further comprises a loaf receiving portion 62. As shown in FIG. 7, scoop 56 has advanced into opened wrapper 52 and members 58 and 60 have opened to grip wrapper 52 and secure it in an opened position. Loaf receiving portion 62 is positioned to catch packet 20 and then loaf 22 as they are delivered by product conveyor 14. A pushing assembly 64 has also advanced to a position adjacent the incoming loaf 22. FIG. 8 shows scoop 56 being withdrawn after packet 20 and loaf 22 have been deposited on receiving portion 62. Pushing assembly 64 is kept in its advanced position so that loaf 22 is retained in substantially the same spatial position while withdrawing scoop 56 pulls opened wrapper 52 over the loaf. Since the coefficient of friction of the bread loaf is considerably higher than that of the receiving portion, packet 20 stays with loaf 22 as it is wrapped. Scoop 56 completes its withdrawal and then pushing assembly 64 also withdraws, allowing wrapped loaf 66 to drop onto outfeed conveyor 68 where it will be carried to tying machine 70 for closure. The process is then repeated for the next loaf and packet on the product conveyor 14.

As further noted in reference to FIG. 6, embodiments of the present invention can also be configured to include a UPC bar code reader 115, positioned to read bar codes printed upon bags or wrappers 52 through transparent support surface 117. The information read by reader 115 can be conveyed (e.g., via line 116) to the upstream packet placer 18 for proper packet selection.

Figure 11:
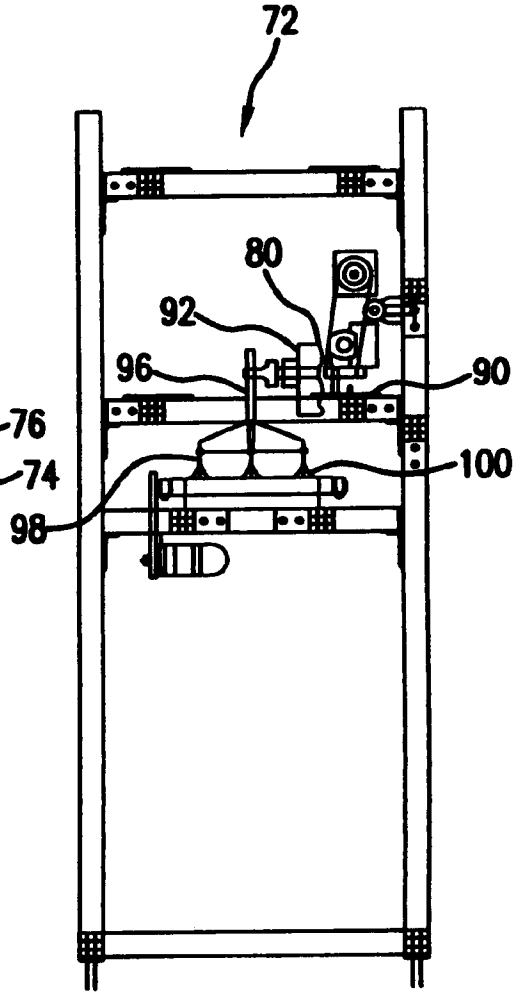
FIG. 11 is a front view of the embodiment of the invention shown in FIG. 10.
Figure 10:
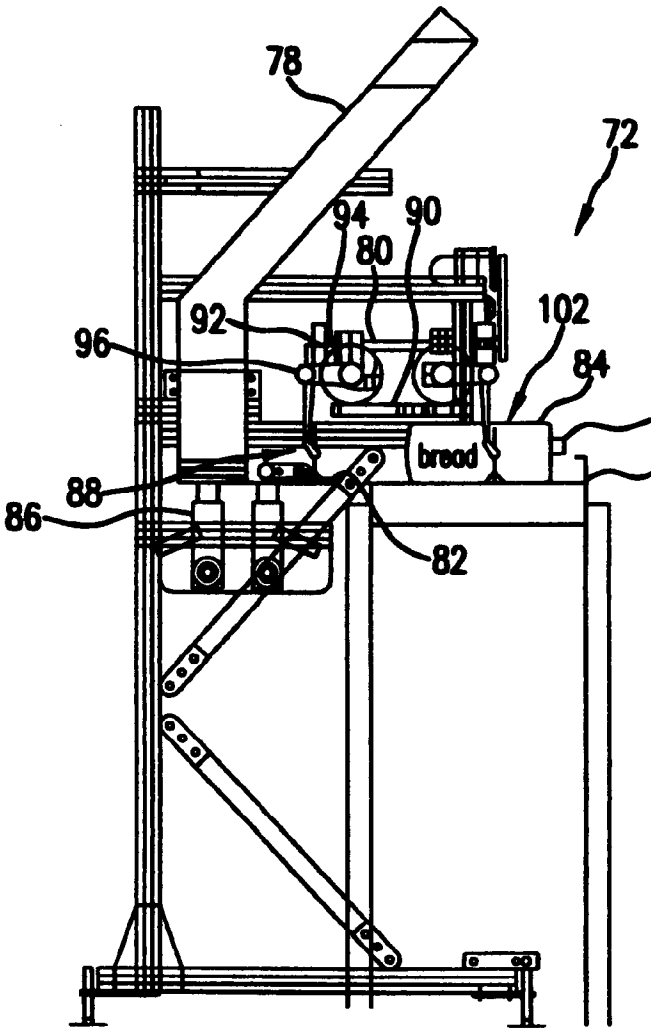
FIG. 10 is a schematic view of an embodiment of the invention configured to automatically package a three-fold insert.

FIGS. 10 and 11 show an alternate embodiment of the invention that is configured to automatically package a three-fold insert. Here, an automated bread packaging station 72 comprising a bread packaging machine 74, a product conveyor 76, an insert delivery tray 78, and an insert placer 80, configured to include a three-fold insert 82 with individual bread loaves 84 as they are wrapped. As described above, bread packaging machines are conventionally known in the art. The product conveyor 76 of packaging machine 74 conveys loaves of bread to the packaging machine, such as by a driven flight system to urge the individual loaves 84 along a smooth table. Insert placer 80 cycles between the solid position and the position shown in phantom. A servo 86 at the bottom of insert delivery tray 78 engages the bottom-most insert 82 and urges it laterally to the insert pick-up position 88. In this embodiment, insert placer is driven laterally along rack 90 by pinion 92. Drive plate 94 has an arm 96 with stems 98, each ending in a vacuum cup 100. Selective operation of the vacuum cups allows the insert placer to pick up an insert and then drop it off as described above. As insert placer 80 moves laterally along rack 90, the drive plate rotates 180 degrees and arm 96 also rotates 180 degrees so that insert 82 is placed in drop-off position 102, immediately ahead of advancing loaf 84.

Figure 12:
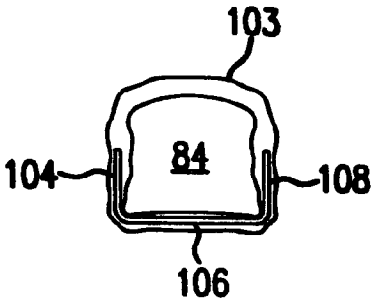
FIG. 12 is a schematic view of a three-fold insert of an embodiment of the invention around a packaged item.

As shown in FIG. 12, operation of this embodiment of the invention yields a loaf of bread 84, wrapped in a suitable package 103, with insert 82 folded around the loaf. Specifically, the first portion 104 of insert 82 is along one side of loaf 84, second portion 106 of the insert lies under the loaf, and third portion 108 of the insert is along the other side of the loaf. During packaging, the deposited three-fold insert 82 is driven forward along product conveyor 76 by advancing loaf 84. The bread packaging machine is substantially similar to the type described above. As the insert is pushed into the scoop, the first fold 104 is pushed up into a substantially vertical orientation. The loaf then falls onto second portion 106 and the third portion 108 is folded up allowing the clamshell to pull the wrapper over the loaf and suitably positioned insert. In some embodiments, it may be desirable to provide the scoop with a flange to help urge the third portion 108 of insert 82 into its vertical orientation.

One of skill in the art will recognize that this embodiment of the invention could easily be configured for a two-fold insert as well, so that one portion of the insert is along one side of the loaf and a second portion is underneath the loaf.

Figure 13:
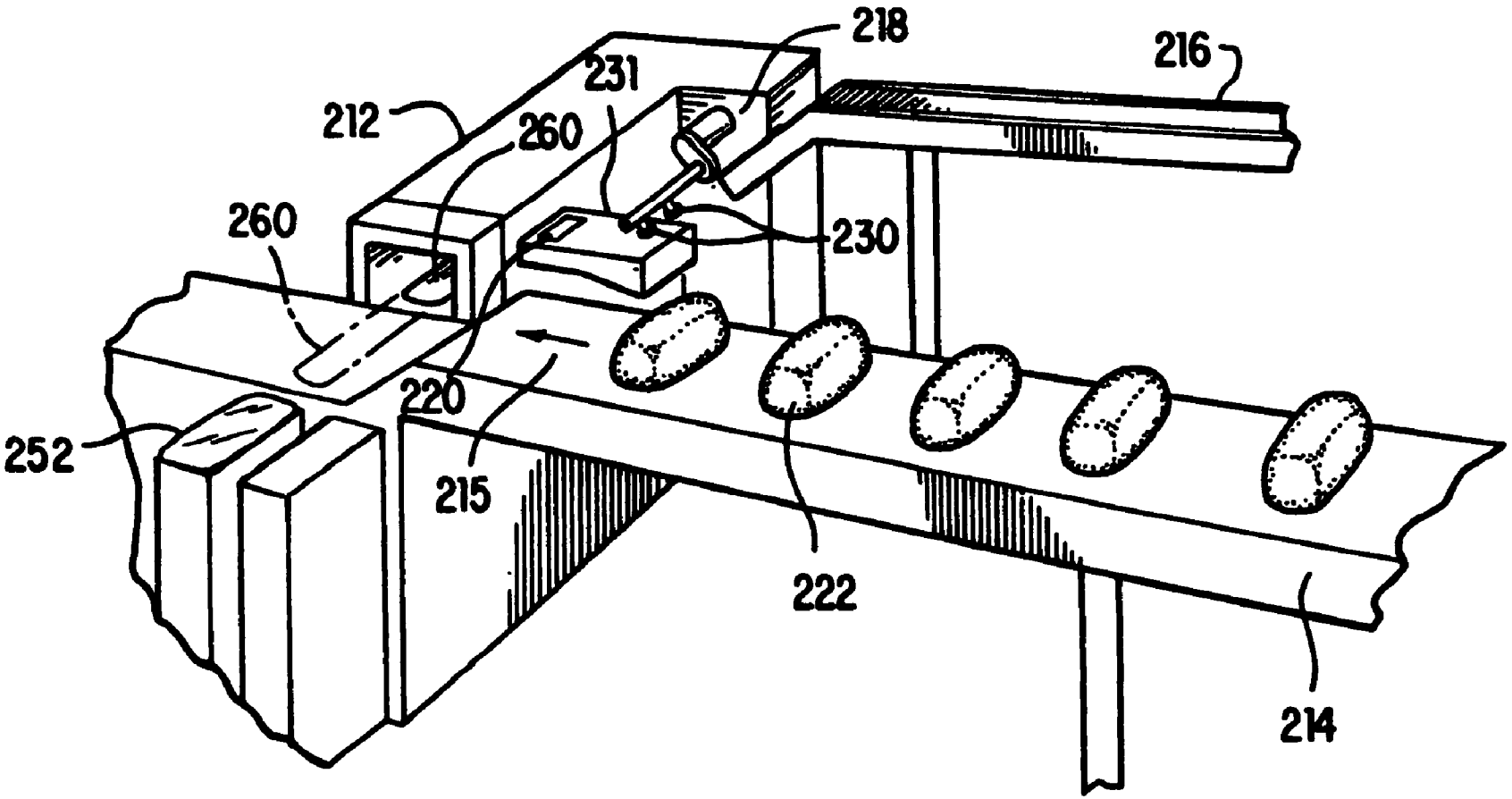
FIG. 13 is a schematic view of an alternative embodiment of the invention.

In the above embodiments, the proper alignment of the bread and packet relies upon certain frictional forces which exist as the bread and packet travel along the conveyor as they approach the bagger. FIG. 13 shows an alternative embodiment of the invention, wherein the packets are deposited onto the bread scoop, which subsequently receives the loaf of bread, rather than having the packet deposited onto the product conveyor ahead of the bread.

More specifically, in this embodiment, the packet delivery system comprises a packet conveyor 216, and a packet placer 218, which are similar, respectively, to the packet delivery tray 16 and packet placer 18 described previously. In a preferred embodiment, as each packet 220 advances along the packet conveyor 216, vacuum cups 230 of the packet placer 218 engage and secure the packet 220 and place the packet onto a feeder mechanism 231.

In this embodiment, as in the embodiments described previously, the invention includes a product conveyor 214, which is similar in structure and operation to product conveyor 14, a packaging machine 212, which is similar to packaging machine 12, and a scoop assembly (not shown), including lower bread scoop 260. As shown in FIG. 13, the feeder mechanism 231 is adapted so as to be disposed adjacent, and above, a distal portion 215 of the product conveyor 214, as well as adjacent the lower bread scoop 260, when the latter is in the advanced, or extended, position. More specifically, the feeder mechanism 231, which is a timed advancement mechanism, is positioned such that, as the lower bread scoop 260 moves towards the advanced position, such as is shown in phantom in FIG. 13, the feeder mechanism 231 receives a packet 220 from the packet placer 218 and, at the appropriate time, feeds, or deposits, the packet 220 onto the lower bread scoop 260.

Referring to a PLC by way of example, in a preferred embodiment, the timed deposition of the packet 220 onto the feeder mechanism 231, the subsequent delivery of the packet 220 by the feeder mechanism, as well as the loading of the loaf 222 unto the scoop 260, etc. are accomplished by a series of sensors located throughout the system which provide logistic information as input data into at least one PLC (or similar device), which, in turn, provides output signals activating the various components of the system. More specifically, in a preferred embodiment, the sensors are positioned so as to provide at least three separate pieces of data as input into the PLC.

First, the bread loaf conveyor and the scoop assembly run on a single chain cycle. As such, an encoder (or other position/velocity device, such as, e.g., a resolver), interacting with the PLC, ensures that the respective speeds of the bread conveyor, on the one hand, and the scoop, on the other, are synchronized. Second, as has been mentioned before with reference to FIG. 2B, an optical (or similar) sensor is placed at a point that is preferably about ¾ of the way along the product conveyor. When a loaf of bread that is on the conveyor and on its way to be loaded onto the scoop passes this point, it covers the sensor, thus signaling to the PLC that the loaf is about to reach the vicinity of the scoop assembly. The PLC then sends a signal to the scoop assembly for the latter to begin advancing towards its extended position. The PLC also uses this information to activate the packet placer and feeder mechanism. Finally, the scoop assembly itself is equipped with one or more position sensors, which help fine-tune the position of the scoop so that it will receive the packet and the loaf at an appropriate time and at the proper position.

The feeder mechanism 231 typically comprises two sets of rollers, or a set of rollers and a chain-lug assembly. A first set of rollers, placed towards the back of the mechanism, receive the packet 220 from the packet placer 218. When an appropriate signal is received from the PLC, a servo motor is activated to rotate these rollers, thus advancing the packet to the front portion of the feeder mechanism 231. Then, based on information received from the sensor(s) on the scoop assembly, the PLC sends a second signal to the same or a second servo motor, which, in turn, causes the chain-lug assembly, e.g., to advance the packet and shoot it out onto the scoop 260.

Based on the above description, the timing of packet (or insert) deposition by the feeder mechanism 231 on the one hand, and the timing of bread advancement by the feeder conveyor 214, on the other, are synchronized such that, for every loaf of bread 222 that moves along the conveyor, the feeder mechanism 231 loads the lower bread scoop 260 with a packet 220 prior to the arrival of the loaf. Thus, every time the lower bread scoop is advanced, it receives first a packet from the feeder mechanism 231, and then a loaf of bread 222, wherein the loaf rests on top of the packet to be inserted into wrapper 252.

More specifically, as a loaf of bread 222 is advanced on the product conveyor 214, a wrapper 252 is opened as described previously (with respect to wrappers 52), and the scoop assembly, including the lower bread scoop 260, move into position to receive a packet 220 and a loaf 222. The scoop assembly then continues to advance until its forward portion is inside the wrapper 252. Once inside, the scoop assembly then reverses direction, thus pulling the wrapper 252 over the loaf 222, which then exits the scoop assembly. As the scoop assembly begins to move rearwardly, the insert 220 remains positioned under the loaf of bread 222 as the lower bread scoop 260 slides from underneath on its way back to the fully-retracted position (as shown, for example, in FIGS. 6–9, and the solid lines in FIG. 13).

Once the wrapper 252 has been placed over the loaf 252 and packet 220, the bag is then tied in a tying machine (not shown; see, e.g., tying machine 70 in FIGS. 6–9). A label, sticker, or other similar medium is also affixed to the bag, wherein the medium contains information relating to the contents of the now-inserted packet.

It is noted that the embodiment just described can also be used in conjunction with the various features that have been described previously with regard to the other embodiments. For example, the present embodiment of the invention can be configured to include multiple packet conveyors (or one or more carousel and magazine assemblies) to carry a plurality of packets, as well as a sensor, such as a UPC bar code reader, to help in selecting the proper packet for each wrapper.

Figure 15:
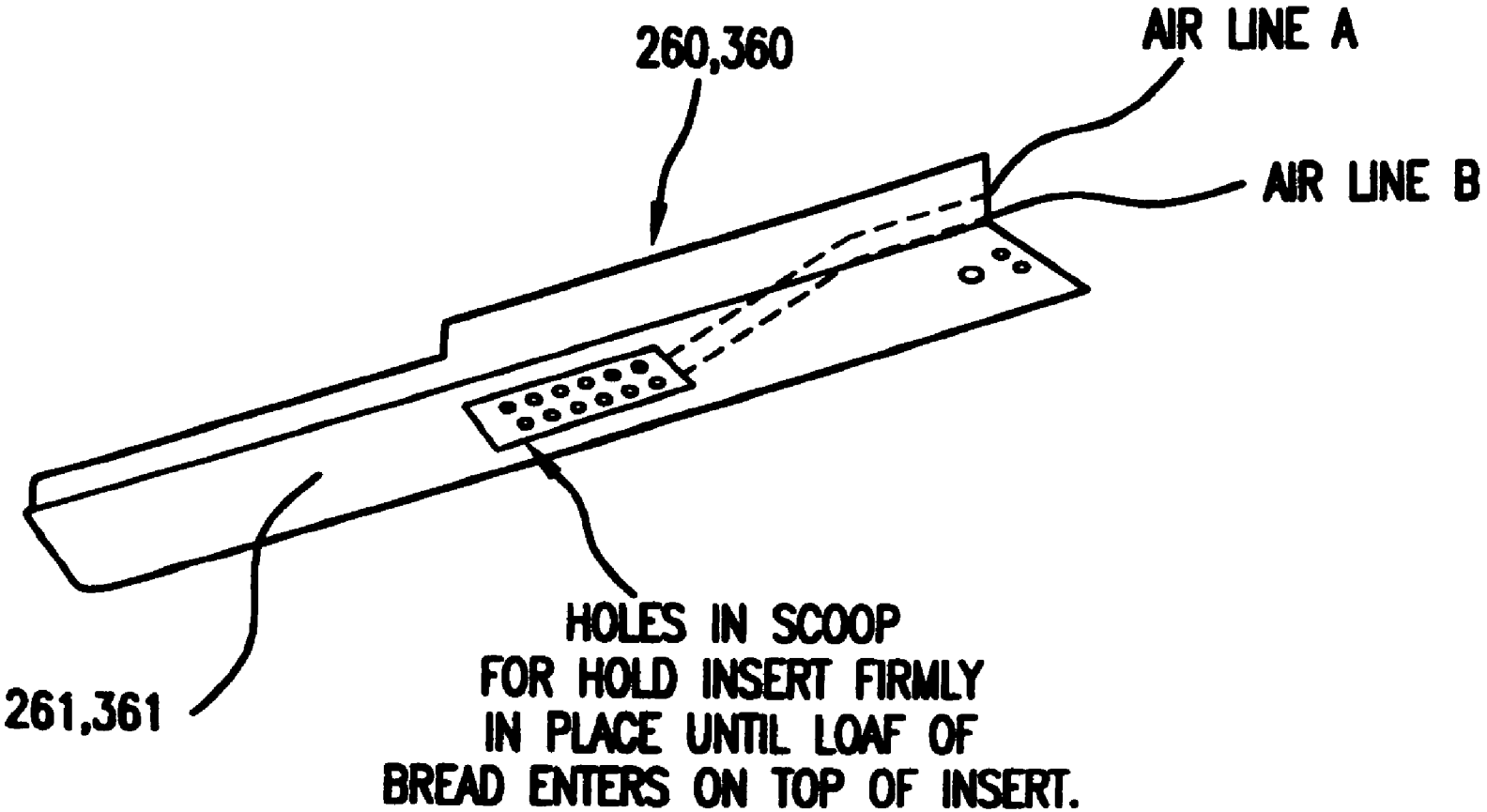
FIG. 15 is a schematic view of the lower bread scoop of the embodiment shown in FIG. 13.

The lower bread scoop 260 is similar to the lower member 60 of the scoop 56 depicted, e.g., in FIG. 6. As shown in FIG. 15, in order to keep the packet 220 stationary on the lower bread scoop 260, a horizontal surface 261, 361 of the scoop 260, 360 of the instant invention contains two sets of air apertures A and B. In a preferred embodiment, each set of apertures is aligned in a straight line, and the two lines are arranged parallel to each other. However, the apertures in each set, as well as the sets themselves, can be arranged in any configuration in order to accommodate the physical and functional requirements for practicing the invention.

An air-jet and vacuum chamber, or other vacuum-generating mechanism (not shown) is located adjacent the horizontal surface 261, 361 of the lower bread scoop 260, 360. The two sets of air apertures A, B are in turn connected to the air-jet and vacuum chamber via respective air lines (not shown) by conventional means.

Once the packet 220 has been fed, or advanced, onto the lower bread scoop 260 (i.e., once the lower bread scoop 260 has been loaded), suction is applied through the vacuum chamber and the air apertures A and/or A and B in order to securely retain the packet in place before the lower bread scoop 260, 360 receives a loaf of bread 222. The packet 220 and the loaf 222 are then advanced towards the wrapper 252 as described above.

As the scoop assembly begins to move rearwardly, i.e., away from the wrappers 252, the suction effected by the vacuum through air apertures A is terminated. At the same time, the air line connecting the air-jet chamber to air apertures B and/or A and B is activated (e.g., via an on/off toggle switch) to provide blow-off air through the horizontal surface 261, 361 of the lower bread scoop 260, 360. This helps separate the packet 220 from the horizontal surface 261, 361, so that it can remain positioned under the loaf of bread 222 as the lower bread scoop 260, 360 slides from underneath on its way back to the fully-retracted position (as shown, for example, in FIGS. 6–9, and 13). In addition, as the scoop slides back, air is blown through the apertures to clear any bread crumbs that may have accumulated.

As has been discussed previously, the timing and placement of the packet and the loaf are critical to the proper operation of the invented system. For example, for all of the embodiments discussed herein in which a feeder mechanism is used, the feeder mechanism may be placed either perpendicularly, or in a different orientation, with respect to the scoop assembly. The latter case is discussed in a subsequent section. However, in the former case, where the feeder mechanism and the scoop assembly are placed perpendicularly to each other (i.e., where the longitudinal axis of the feeder mechanism, defining the direction of movement of the packet on the feeder mechanism, is perpendicular to the longitudinal axis of the scoop, defining the direction of movement of the scoop), the feeder mechanism should preferably lie within a given range of angles as measured from the scoop and/or from the horizontal.

Depending on various factors including ease of access, machine location and the vantage point of an operator of the system of the instant invention, it may be advantageous to position the packet delivery system in a location away from a distal portion of the product conveyor. Thus, FIGS. 14 and 15 show an alternate embodiment of the invention, wherein the packets are deposited onto the bread scoop in a retracted position, which subsequently receives the loaf of bread, rather than having the packet deposited onto the product conveyor ahead of the bread, or onto the scoop when the latter has already advanced.

More specifically, in this embodiment, the packet delivery system comprises a packet conveyor 316, and a packet placer 318, which are similar, respectively, to the packet conveyor 216 and packet placer 218 described previously. In a preferred embodiment, as each packet 320 advances along the packet conveyor 316, vacuum cups 330 of the packet placer 318 engage and secure the packet 320 and place the packet onto a feeder mechanism 331.

Figure 14:
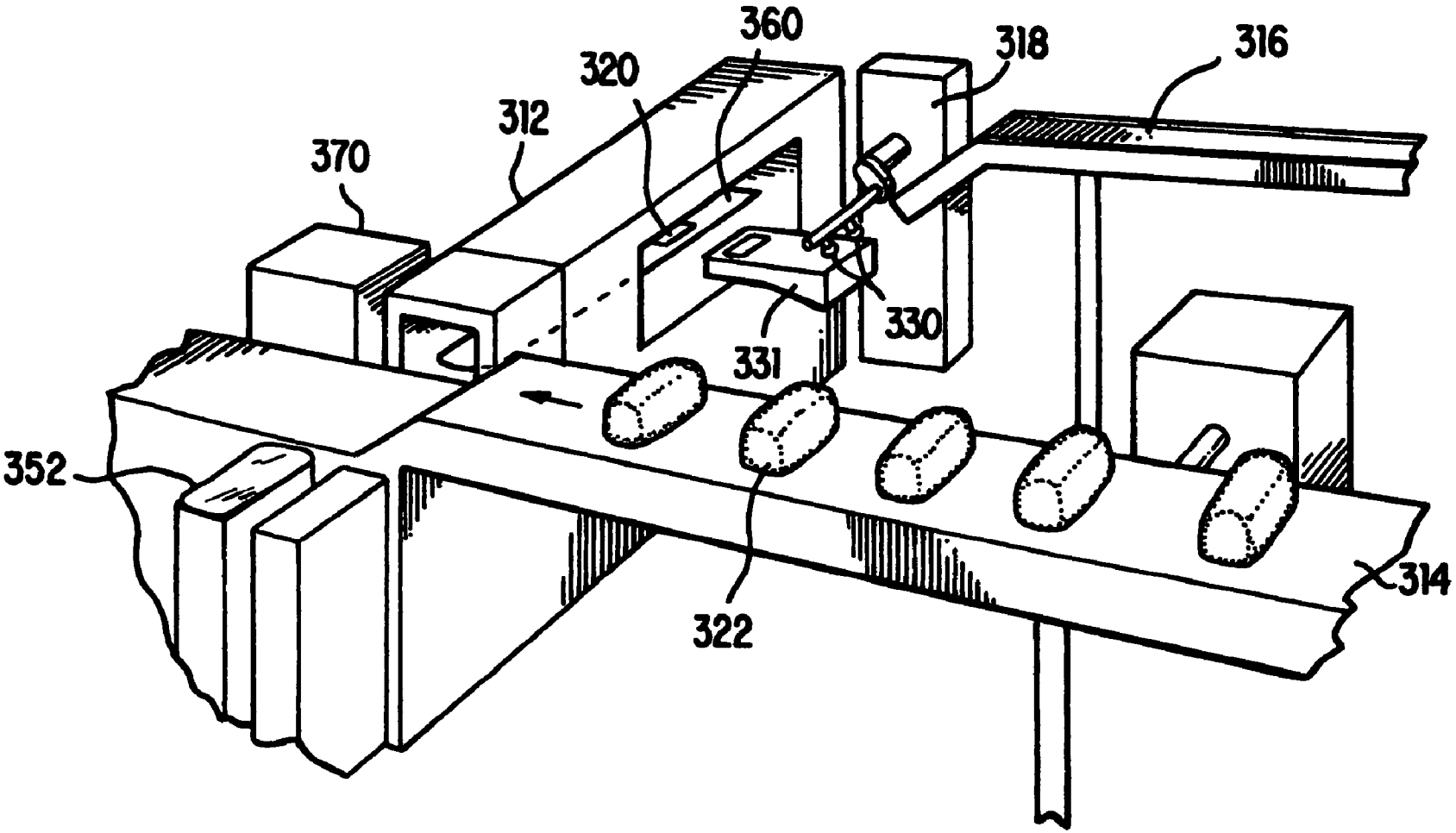
FIG. 14 is a schematic view of an alternative embodiment of the invention.

As shown in FIG. 14, the feeder mechanism 331 is adapted so as to be disposed adjacent a lower bread scoop 360 of the scoop assembly described (and shown, in FIG. 6–9, for example) previously. More specifically, the perpendicularly-positioned feeder mechanism, which is a timed advancement mechanism, is positioned such that, when the lower bread scoop 360 is in the retracted position (as shown in FIG. 14), the feeder mechanism 331 receives a packet 320 from the packet placer 318 and, at the appropriate time, feeds, or advances, the packet 320 into the lower bread scoop 360. In a preferred embodiment, the timed deposition of the packet 320 via the feeder mechanism 331 is accomplished in substantially the same manner as that described for the embodiment depicted in FIG. 13.

The lower bread scoop 360 is similar to the lower member 60 of the scoop 56 depicted, e.g., in FIG. 6. Given that, in this embodiment, the packet 320 is loaded onto the lower bread scoop 360 when the latter is in the retracted position, it must be ensured that the packet 320 remains stationary on the scoop 360 as the scoop extends to receive the loaf of bread 322 on top of the packet 320. Therefore, as shown in FIG. 15, the lower bread scoop 260, 360 of the instant invention has a horizontal surface 261, 361 which contains two sets of air apertures A and B. In a preferred embodiment, each set of apertures is aligned in a straight line, and the two lines are arranged parallel to each other. However, the apertures in each set, as well as the sets themselves, can be arranged in any configuration in order to accommodate the physical and functional requirements for practicing the invention.

An air-jet and vacuum chamber, or other vacuum-generating mechanism (not shown) is located adjacent the horizontal surface 261, 361 of the lower bread scoop 260, 360. The two sets of air apertures A, B are in turn connected to the air-jet and vacuum chamber via respective air lines (not shown) by conventional means.

Once the packet 320 has been fed, or advanced, onto the lower bread scoop 260, 360 (i.e., once the lower bread scoop 260, 360 has been loaded), suction is applied through the vacuum chamber and first set of air apertures A in order to securely retain the packet in place as the lower bread scoop 260, 360 moves forward (as shown, e.g., in FIG. 7), to receive a loaf of bread 322.

In this embodiment, as in the embodiments described previously, the invention includes a product conveyor 314, which is similar in structure and operation to product conveyor 14, a packaging machine 312, which is similar to packaging machine 12, and a scoop assembly (not shown), including lower bread scoop 360. As a loaf of bread 322 is advanced on the product conveyor 314, a wrapper 352 is opened as described previously (with respect to wrappers 52), and the scoop assembly, including the lower bread scoop 360 that is carrying the packet 320, moves forward toward the wrappers 352 in order to receive the loaf 322. The scoop assembly then continues to advance until its forward portion is inside the wrapper 352. Once inside, the scoop assembly then reverses direction, thus pulling the wrapper 252 over the loaf 322, which then exits the scoop assembly.

As the scoop assembly begins to move rearwardly, i.e., away from the wrappers 352, the suction effected by the vacuum through air apertures A is terminated. At the same time, the air line connecting the air-jet chamber to the second set of air apertures B is activated (e.g., via an on/off toggle switch) to provide blow-off air through the horizontal surface 261, 361 of the lower bread scoop 260, 360. This helps separate the packet 320 from the horizontal surface 261, 361, so that it can remain positioned under the loaf of bread 322 as the lower bread scoop 260, 360 slides from underneath on its way back to the fully-retracted position (as shown, for example, in FIGS. 6–9, and 14). In addition, as the scoop slides back, air is blown through the apertures to clear any bread crumbs that may have accumulated.

Once the wrapper 352 has been placed over the loaf 352 and packet 320, the bag is then tied in the tying machine 370. It is noted that the embodiment just described can also be used in conjunction with the various features that have been described previously with regard to the other embodiments. For example, the present embodiment of the invention can be configured to include multiple packet conveyors (or one or more carousel and magazine assemblies, one or more side-by-side or stacked magazines, etc.) to carry a plurality of packets, as well as a sensor, such as a UPC bar code reader, to help in selecting the proper packet for each wrapper.

As has been discussed previously, timing and placement are critical to the proper operation of the present invention. Thus, with respect to the embodiments shown in FIGS. 13–15, for example, it is important that the feeder mechanism be positioned, and its packet-advancement mechanism timed, so as to feed the packet onto the scoop in such a way that the packet lands on top of, and covers, all of the vacuum apertures of the scoop. In fact, if the feeder mechanism is not positioned properly, the packet might bounce away from the scoop as it leaves the feeder mechanism. Moreover, mispositioning and/or mistiming of the feeder mechanism may cause the packet to cover less than all of the apertures, which, in turn, would prevent the vacuum system from functioning properly to retain the packet in place. Similarly, the advancement of the scoop should preferably be timed such that the packet is released into the wrapper so as to lie underneath the loaf, between the middle portion and the tied end (i.e., the end that is twist wrapped) of the loaf.

Figure 16A:
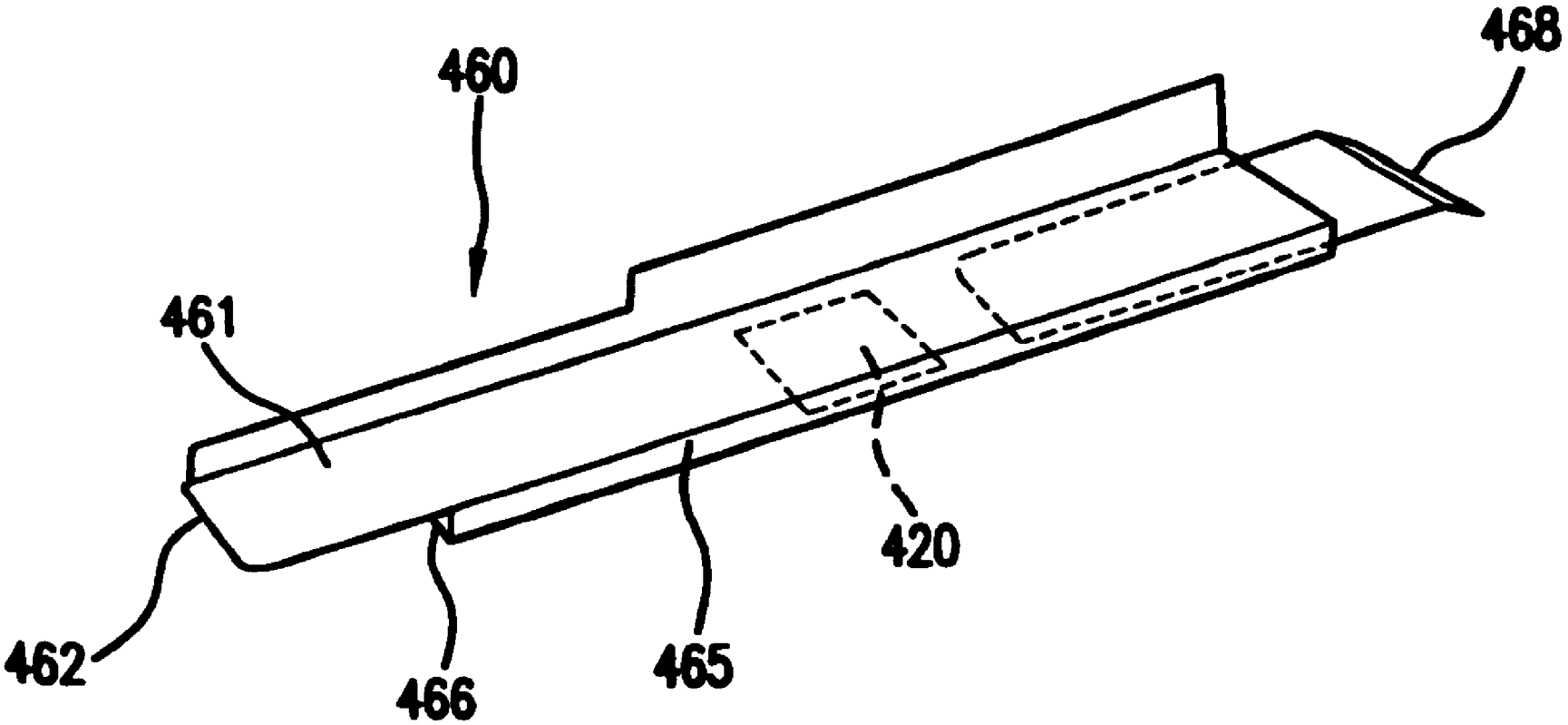
FIG. 16A is a schematic view of a lower bread scoop, modified according to an alternative embodiment of the invention.
Figure 16B:
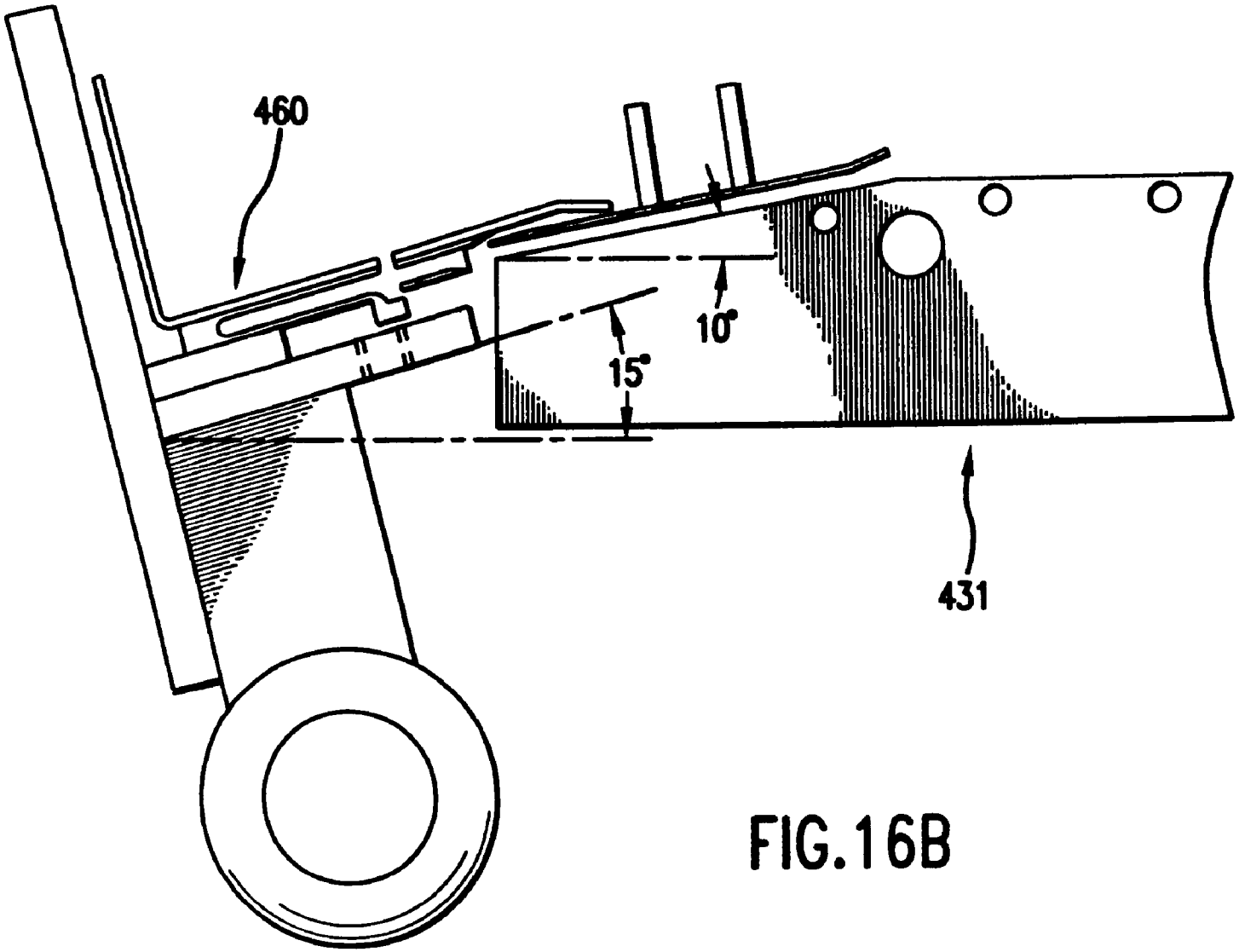
FIG. 16B is a schematic cross-sectional view of the relationship between a scoop and a feeder mechanism according to an embodiment of the invention.

In another alternative embodiment, shown in FIGS. 16A–16B, a bread scoop 460 comprises a horizontal surface 461, as well as a distal end 462. In contrast with the previous embodiment, where a packet 420 would be placed on top of the horizontal surface 461, in the present embodiment, the scoop 460 is equipped with a lower compartment 465, which is disposed underneath the lower surface of the horizontal surface 461 and which receives the packet 420 when the bread scoop 460 is in the retracted position.

Thus, as was described previously with respect to the embodiment depicted in FIGS. 14 and 15, a feeder mechanism (not shown) or similar device may be used to deposit the packet 420 into the lower compartment 465 at the appropriate time, wherein such delivery of the packet into the compartment is timed so as to be coordinated with the movement of, e.g., loaves of bread, on a product conveyor (see, e.g., FIG. 14). It is noted that, in this embodiment, the perpendicularly-positioned feeder mechanism 431 is preferably located vertically lower (i.e., closer to the ground) than in previous embodiments. In addition, for the purposes of this embodiment, the scoop is preferably rotated about 15° around its longitudinal axis, such that the edge closer to the feeder mechanism is tilted upwards (see FIG. 16B). Moreover, the front portion of the feeder mechanism 431 should preferably be tilted down at an angle of between about −15° and about 15° with respect to the edge of the scoop that is tilted upwards (i.e., about 15° above to about 15° below the edge of the scoop that is tilted upwards). Thus, as an example, FIG. 16B shows a preferred configuration, wherein the scoop has been slanted about 15°, and the feeder mechanism is tilted down about 10°.

Once the scoop 460 has been loaded with the packet 420, the scoop 460 advances towards a forward position in order to receive a loaf of bread, and then proceeds to enter a wrapper with its distal end 462, all in the same manner as that described with respect to the embodiment depicted in FIGS. 14 and 15.

As shown in FIG. 16A, the lower compartment 465 has a distal end 466 which may or may not extend as far forward as the distal end 462 of the bread scoop 460. Once the distal end 462 of the scoop and the distal end 466 of the lower compartment have fully advanced into the wrapper, a plunger 468, that is slidably coupled to the lower compartment, is moved forward toward the distal end 466 of the lower compartment 465 in order to expel the packet 420 into the wrapper. The scoop assembly then reverses direction, thus depositing the loaf of bread on top of the packet 420 while pulling the wrapper over the loaf. As the scoop assembly begins to move rearwardly, the packet 420 remains positioned under the loaf of bread as the lower compartment and bread scoop slide from underneath on their way back to the fully-retracted position. As before, once the wrapper has been placed over the loaf and packet 420, the wrapper is then tied in a tying machine (not shown).

The plunger 468 is mechanically connected to the bagger, so that synchronization exists between the two components via the PLC, or other IT controller. It has been found that, for proper operation of an embodiment of the invention, the release of the packet 420 into the wrapper should be effected within a time window that begins when, as the scoop 460 advances towards the wrapper, the distal end 462 of the scoop 460 is about 3 inches from its fully-extended position, and ends when, on its way back to the retracted position, the distal end 462 of the scoop 460 is again about 3 inches from its fully-extended position. Deposition of the packet 420 into the wrapper within the specified time period helps ensure that the packet 420 will be properly retained in place as the scoop assembly retracts, as well as stay out of the way of the twist wrapping operation of the bagging system.

It is noted that the embodiment just described can also be used in conjunction with the various features that have been described previously with regard to the other embodiments. For example, the present embodiment of the invention can be configured to include multiple packets conveyors (or one or more carousel and magazine assemblies, one or more side-by-side or stacked magazines, etc.) to carry a plurality of packets, as well as a sensor, such as a UPC bar code reader, to help in selecting the proper packet for each wrapper.

It is also noted that, although in the embodiment that has been shown in FIG. 16A, the lower compartment 466 is shorter in length than the bread scoop 460, it is not necessary that this be the case. Thus, in a preferred embodiment, the distal ends 462 and 466 are aligned. Moreover, although FIG. 16A shows the use of a plunger 468, other means for expelling the packet 420 from the lower compartment 465 may also be used. For example, the packet 420 may be expelled by compressed air, or through the use of a pneumatic cylinder or other similar means for urging the packet towards the distal end 466 of the lower compartment 465. Additionally, a vacuum and blow-off air system, similar to those used in the embodiments discussed previously, and shown in FIG. 15, may be used in conjunction with the present embodiment.

Figure 17A:
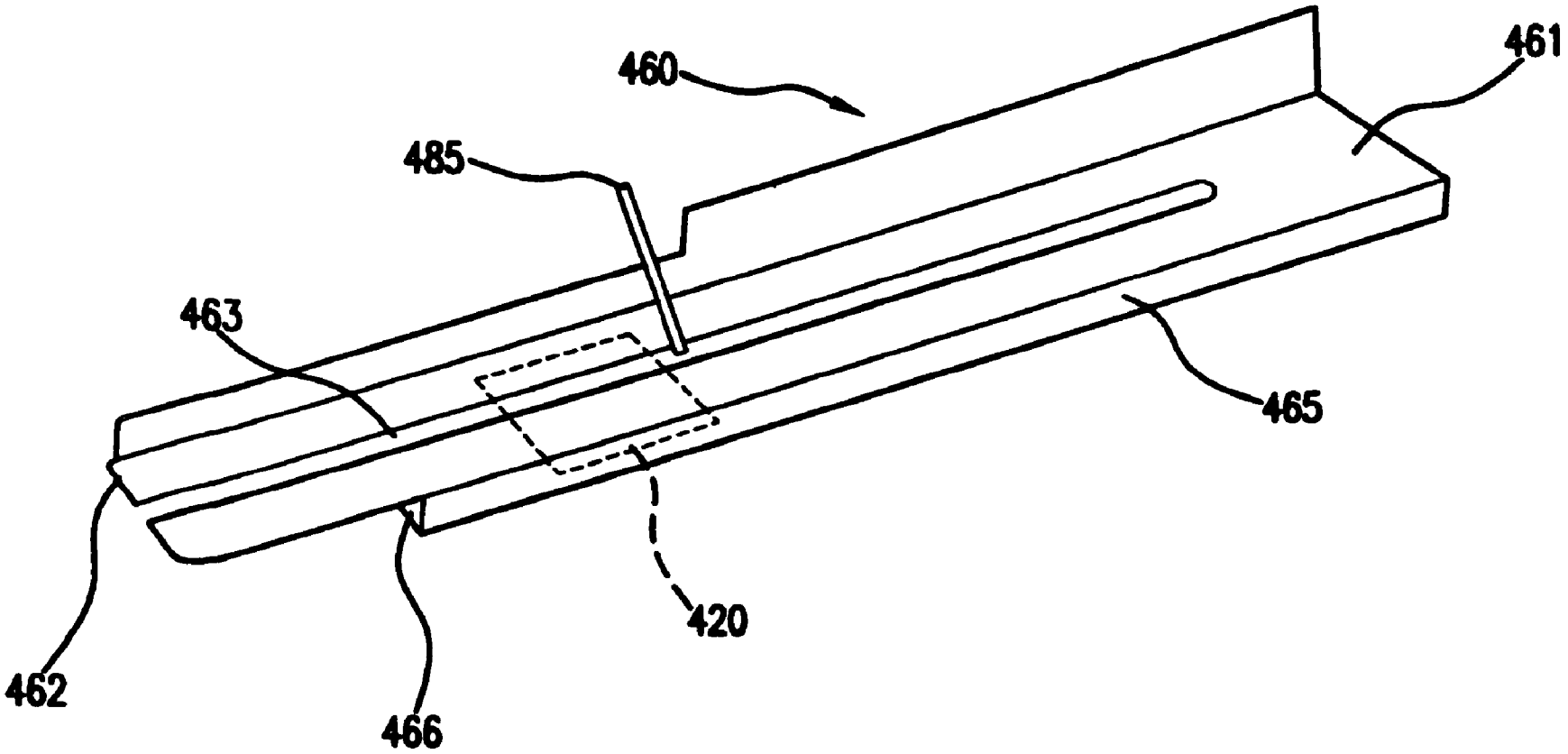
FIGS. 17A–C show the lower bread scoop of FIG. 16A, modified according to an alternative embodiment of the invention.
Figure 17B:
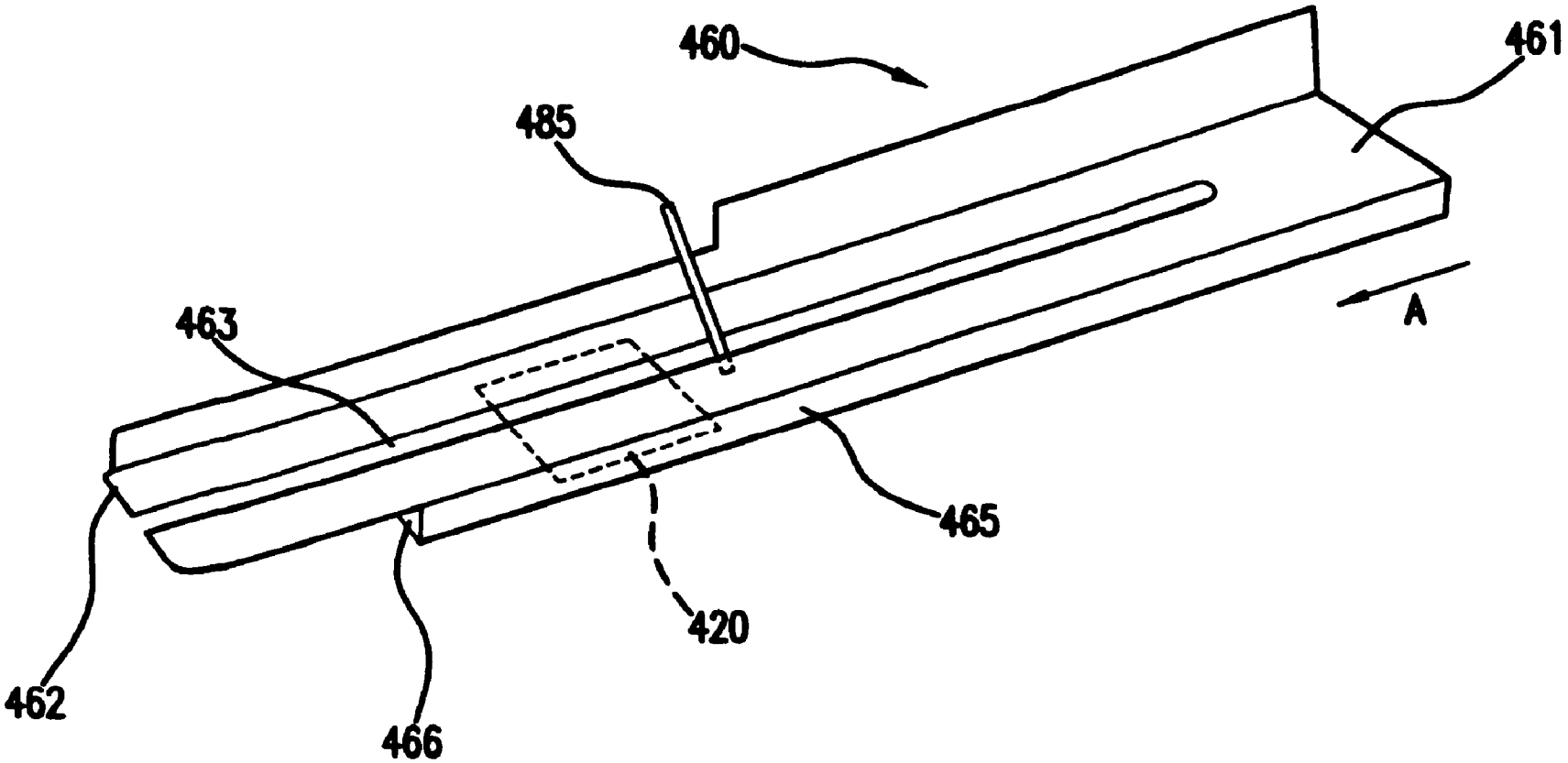
Figure 17C:
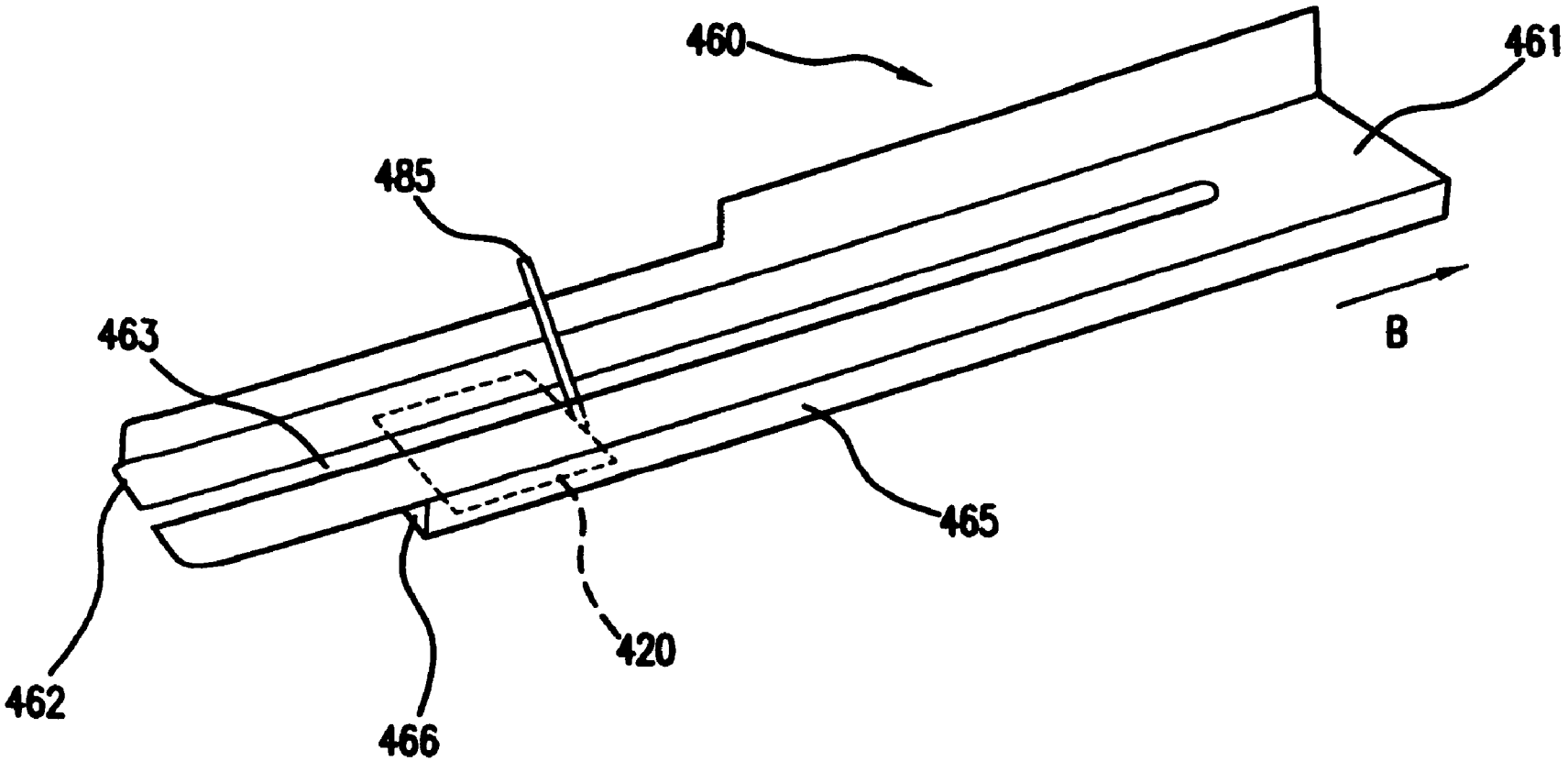

FIGS. 17A–17C show an alternative embodiment, in which the function of the plunger 468 is replaced with a slit and bar arrangement. More specifically, as shown in the figures, the horizontal surface 461 has a slit 463 that runs substantially through the longitudinal axis of the horizontal surface. It is noted that, in FIGS. 17A–17C, the slit 463 is shown for illustrative purposes to run only through a portion of the length of the horizontal surface 461. However, the actual length of the slit 463 vis-a-vis the horizontal surface 461 will be determined based on functional, operational, spatial, and other such considerations.

The scoop assembly is also equipped with a stop bar 485 which is positioned substantially perpendicularly with respect to the horizontal surface 461. The stop bar 485 may be coupled to an air cylinder, which lowers and raises the stop bar in a vertical direction. In addition, the stop bar 485 may operate independently, or, in a preferred embodiment, it may be coupled to the pushing assembly 64 (see, e.g., FIGS. 6–9).

In either case, the stop bar 485 is equipped with a pressure sensing device which allows operation of the stop bar depending on whether or not a packet 420 is in contact with the stop bar. In this way, the stop bar also helps ensure continued and uninterrupted operation of the system. That is, the pressure sensing device may be calibrated for a threshold pressure such that, when an envelope which is stuck in the lower compartment comes into contact with the stop bar so as to create a pressure that is greater than the threshold pressure, the stop bar automatically moves up, so that it does not impede the continued operation of the bagger.

FIG. 17A shows the lower scoop 460 in a retracted position. In this position, the stop bar 485 is raised out of the slit 463, so that a packet 420 may be placed in the lower compartment 465 as discussed previously. Once the lower compartment has been loaded, the lower scoop 460 begins to move forward, in the direction of Arrow A (as shown in FIG. 17B). At this time, the stop bar 485 is lowered. In a preferred embodiment, the lower compartment 465 has a groove (not shown) that runs substantially through the longitudinal axis of the lower compartment 465. Thus, when the stop bar 485 is lowered, its bottom end enters the groove of the lower compartment, such that the bottom end of the stop bar is positioned vertically lower than the surface of the lower compartment, where the packet 420 to be inserted is resting. In this way, the possibility that the packet 420 will be caught between the bottom end of the stop bar and the surface of the lower compartment is substantially eliminated. In addition, since the scoop is moving in the direction of Arrow A, the packet 420 will slide in the opposite direction, thus bringing an edge of the packet 420 into contact with the stop bar 485.

Once the scoop has been fully extended and a bread product loaded (as has been discussed previously), the scoop and lower compartment begin to retract. Thus, with reference to FIG. 17C, the lower scoop 460 and the lower compartment 465 now move in the direction of Arrow B. As this movement is initiated, the stop bar 485 remains stationary. Since the stop bar 485 is in contact with the packet 420, continued movement of the lower compartment in the direction of Arrow B will cause the packet 420 to move towards the distal end 466 of the lower compartment 465. Thus, just as the pushing assembly 64 pushes the bread loaf off the lower scoop 461 while the latter is retracting, the stop bar 485 pushes the packet 420 off the lower compartment 465 as the latter is retracting, which allows the loaf to end up on top of the packet. As before, while the scoop assembly retracts, it also pulls the wrapper over the loaf and packet.

Figure 17D:
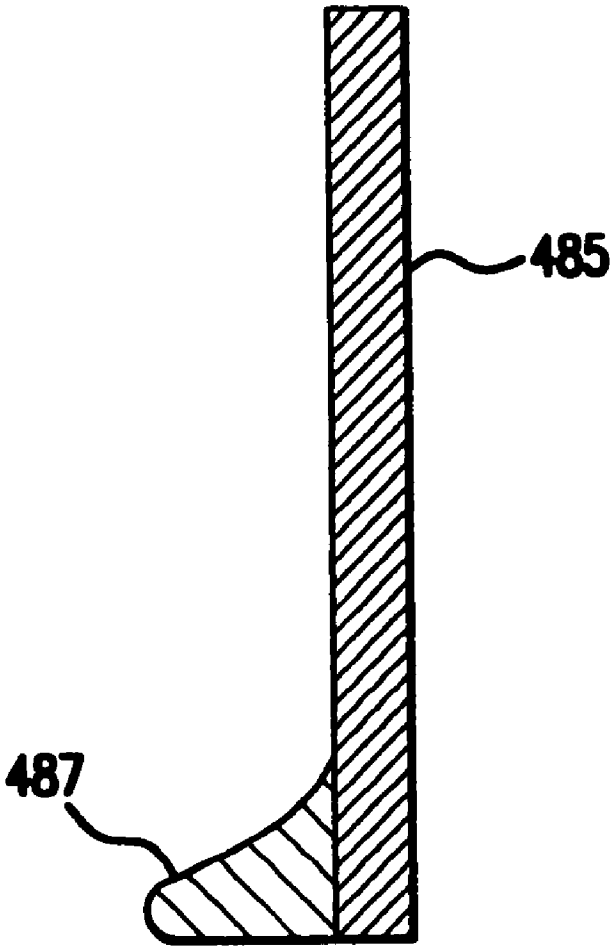
FIG. 17D shows an alternative embodiment of the stop bar of FIGS. 17A–C.

It is noted that, in an embodiment of the invention, multiple stop bars may be used. Thus, for example, in an embodiment where two stop bars are used, each stop bar moves up and down through a corresponding slit in the lower scoop, and into a corresponding groove in the lower compartment. Moreover, each of the stop bars may be equipped with its own pressure sensing device. In this arrangement, the stop bars move in synchronicity with each other such that, when one of the stop bars moves up or down, so does the other. In addition, the two or more stop bars may operate as a single structure. Thus, for example, in the embodiment just described, the two stop bars may be connected to each other by a horizontal member so as to result in a single structure having the shape of an inverted U. FIG. 17D shows an alternative embodiment in which the stop bar 485 has a wedge, or flange, 487. In operation, when the packet exits the lower compartment as was described with reference to FIGS. 17A–C, the trailing edge of the packet may lie close enough to one end of the bread such that, once the packet and bread have been bagged, the corners of the trailing edge of the packet may poke holes into the bag. To address this potential problem, the wedge 487 helps ensure that the packet is pushed an extra distance away from the distal end 466 of the lower compartment and, thus, away from the end of the bread product. It is noted that the same effect may be achieved by replacing the wedge with a ball-shaped structure at the bottom end of the stop bar 485, or by including a flange to create a L-shaped, I-shaped, or similar member. Alternatively, an air cylinder may be used to push the stop bar 485 forward (i.e., towards the bagger) once the scoop and the lower compartment have been retracted. This would push the packet further forward and away from the end of the loaf.

The embodiments of the invention described herein may also include an ejection mechanism whose operation is synchronized with the operation of the packet delivery system and the automated product packager. Referring to FIGS. 16 and 17, for example, it is possible that, from time to time, a packet will be misfed into the lower compartment or, even if correctly fed, the packet may crumple and become stuck in the lower compartment. Such an occurrence would, of course, disrupt proper operation in accordance with the invention. As such, the system may include an ejection mechanism that utilizes air pressure, a mechanical device (e.g., a plunger), an electro-mechanical device, or other similar means to ensure that packets that have been misfed, are stuck, or otherwise obstruct the continuous operation of the system are removed.

Figure 18:
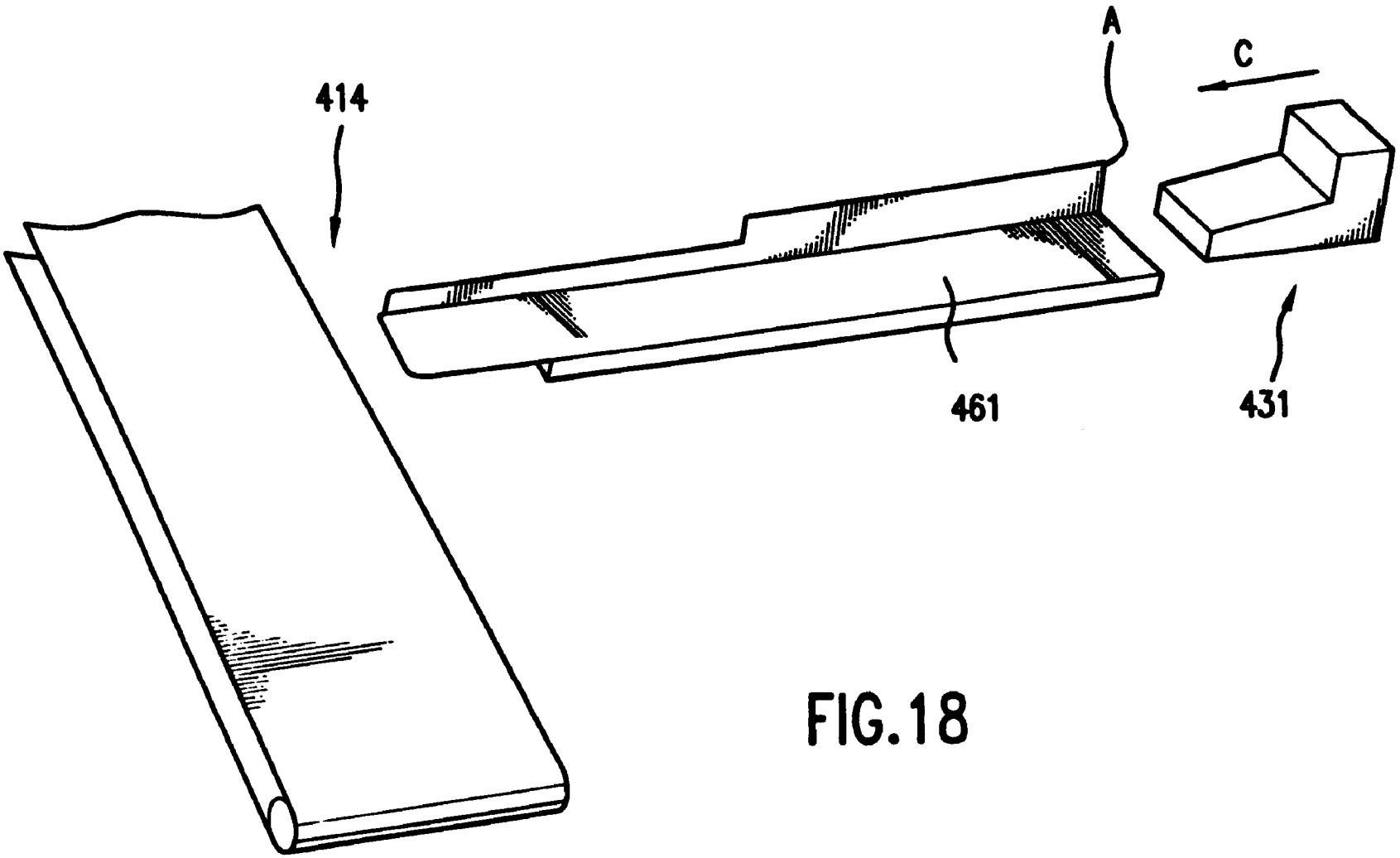
FIG. 18 is a schematic view of an alternative embodiment of the invention.
Figure 19A:
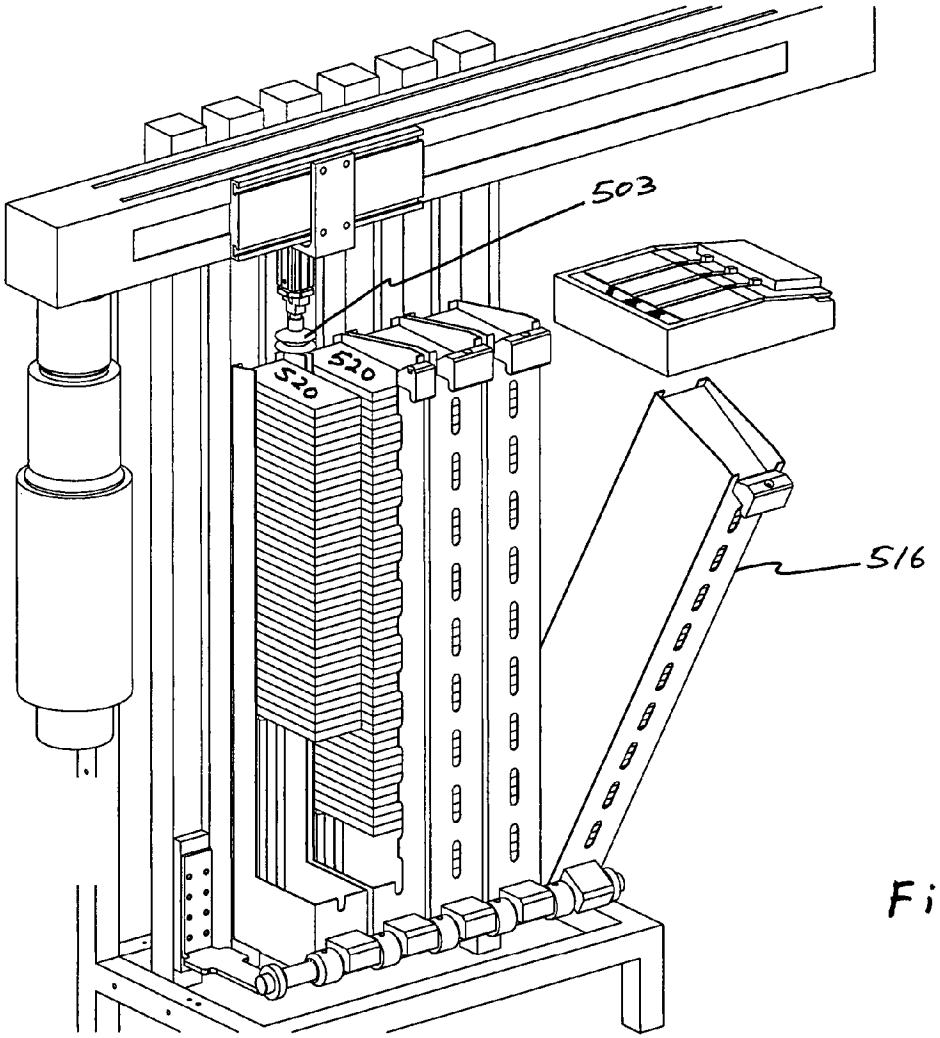
FIGS. 19A–K show an alternative arrangement of the magazines according to an embodiment of the invention.
Figure 19B:
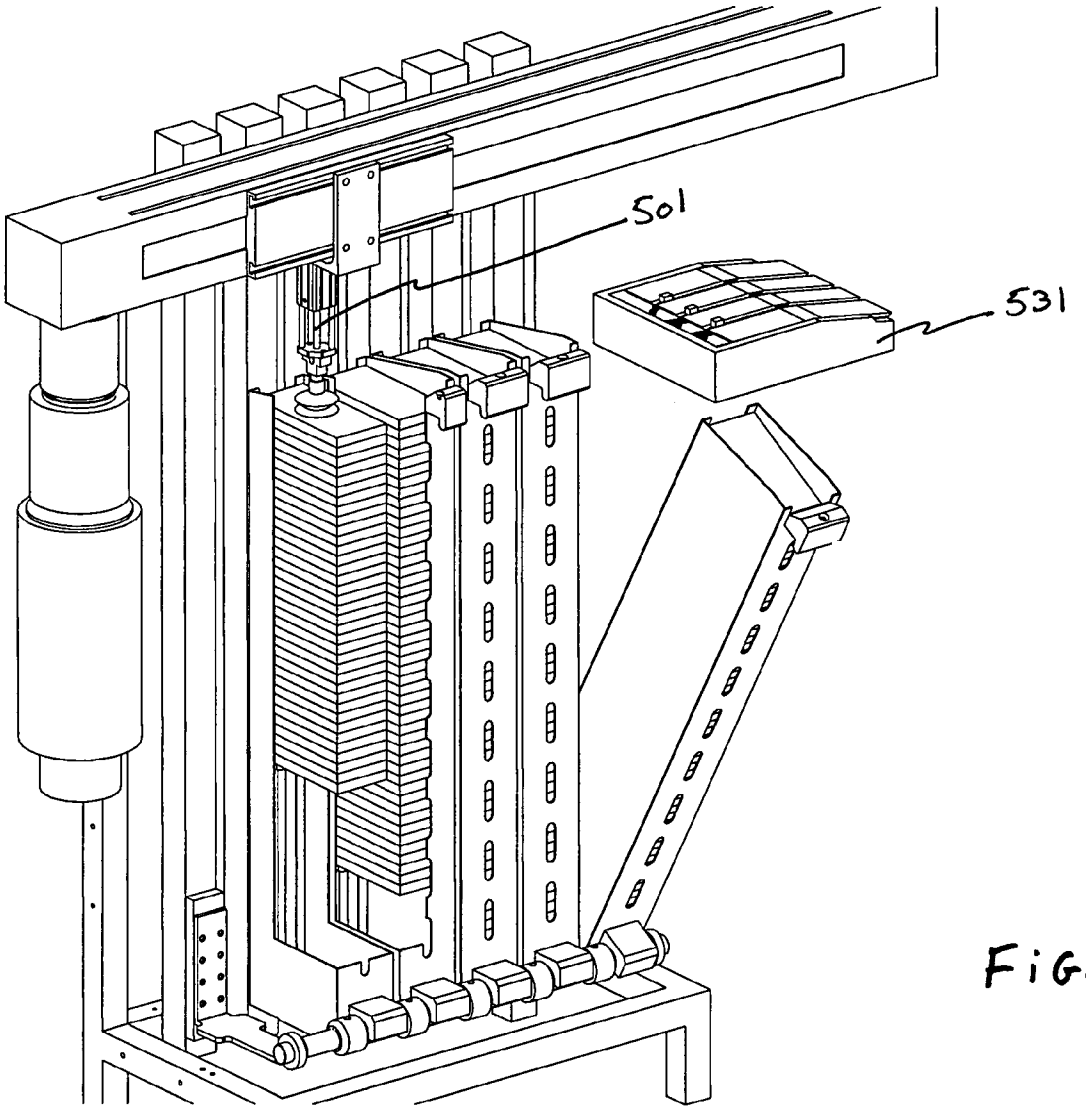
Figure 19C:
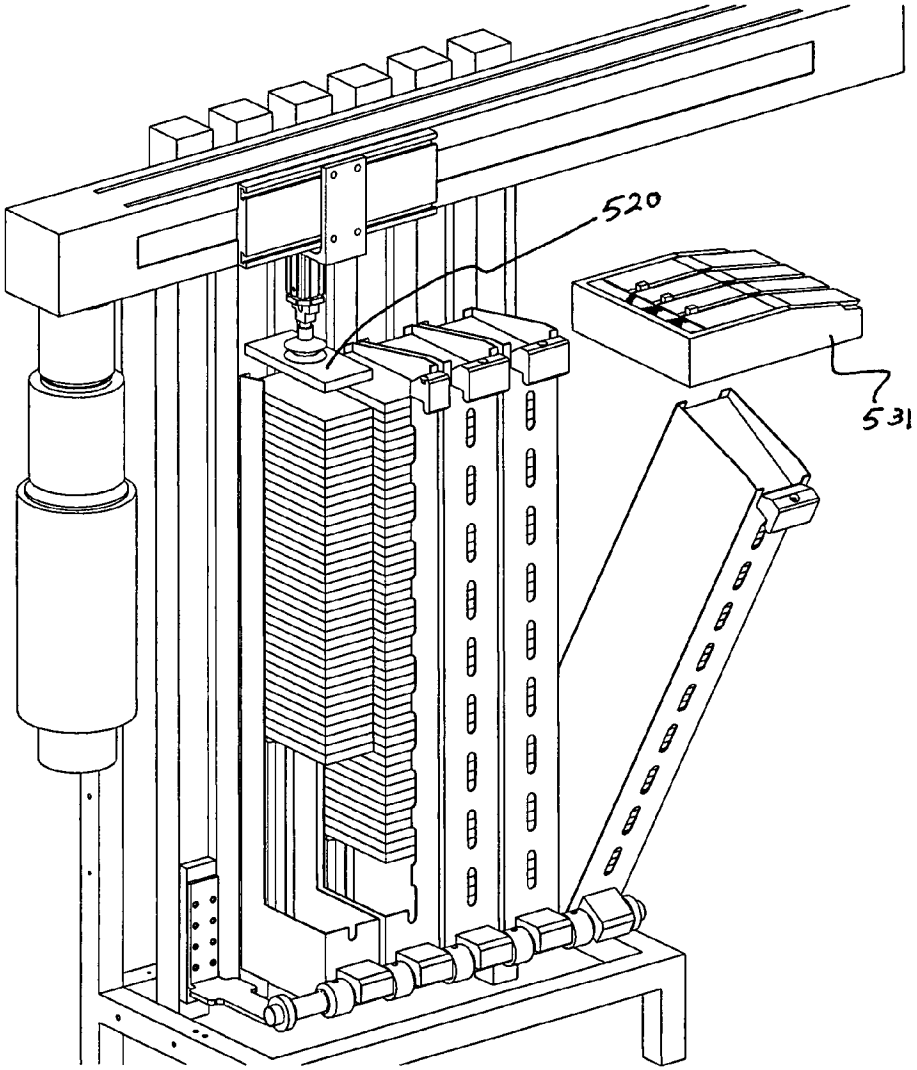
Figure 19D:
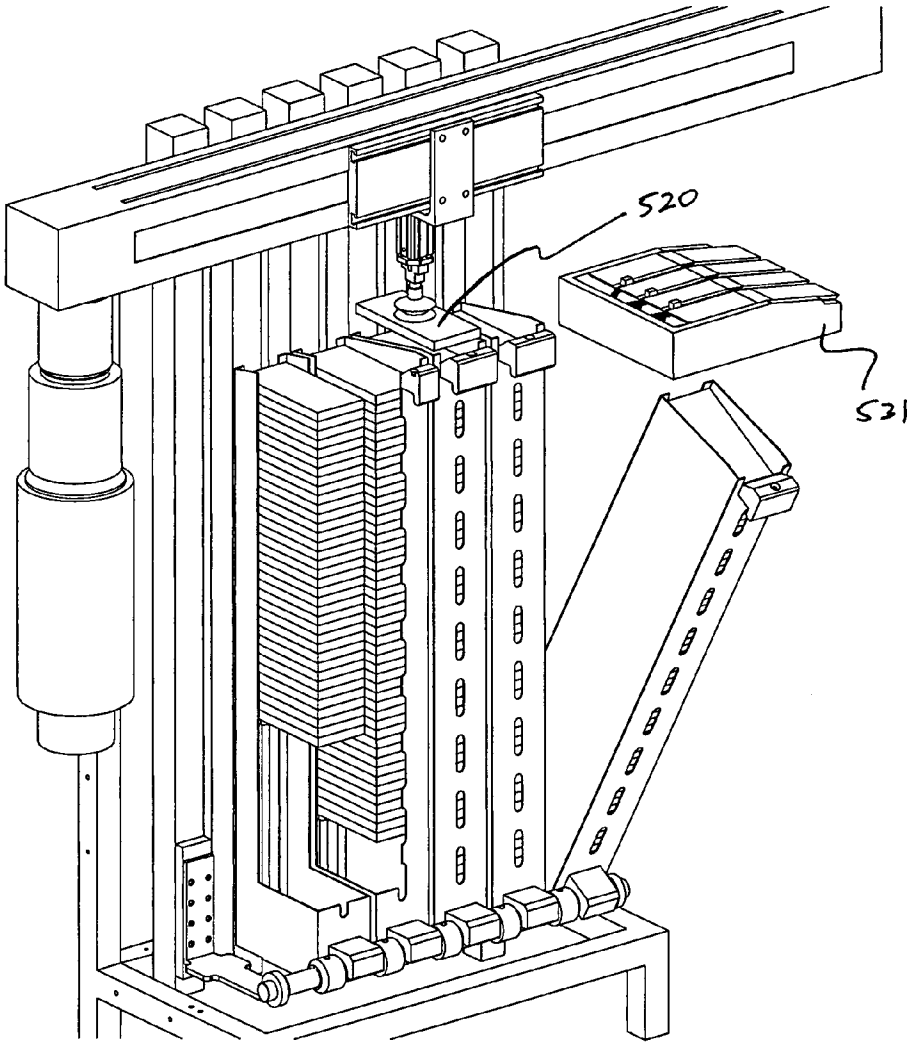
Figure 19E:
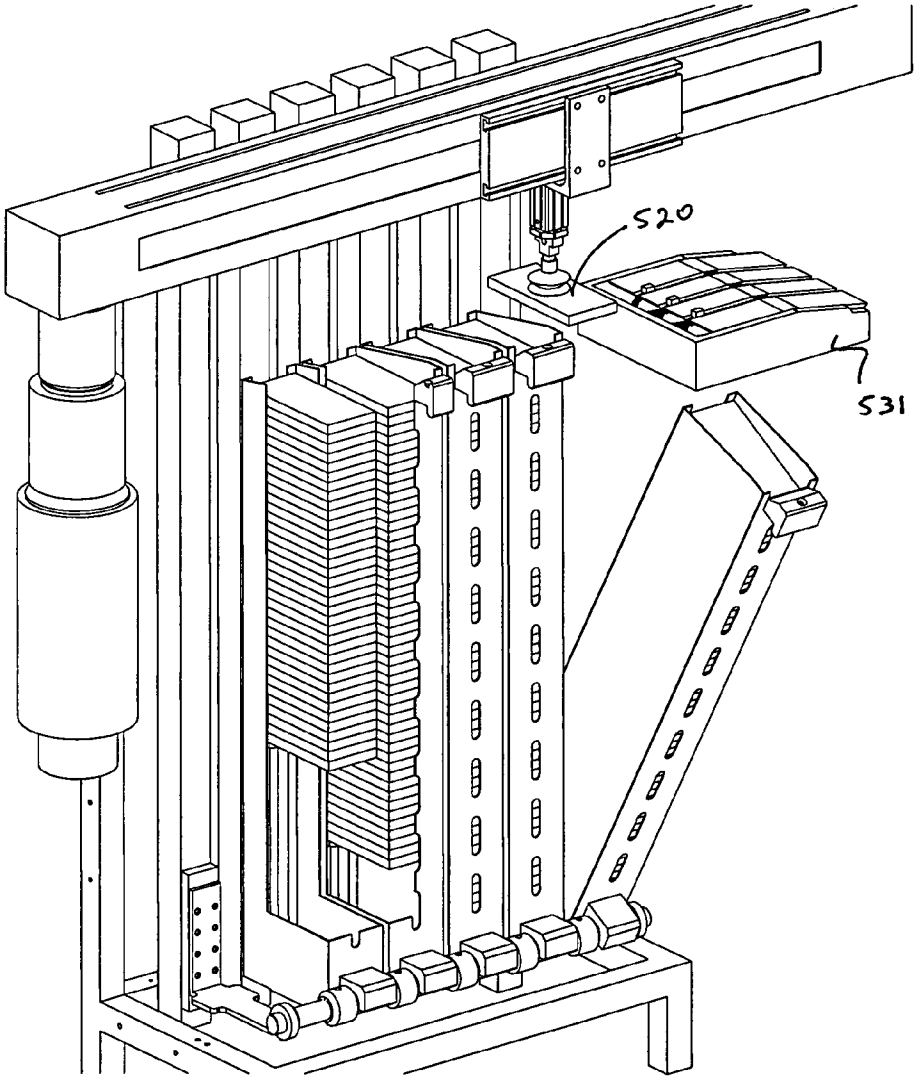
Figure 19F:
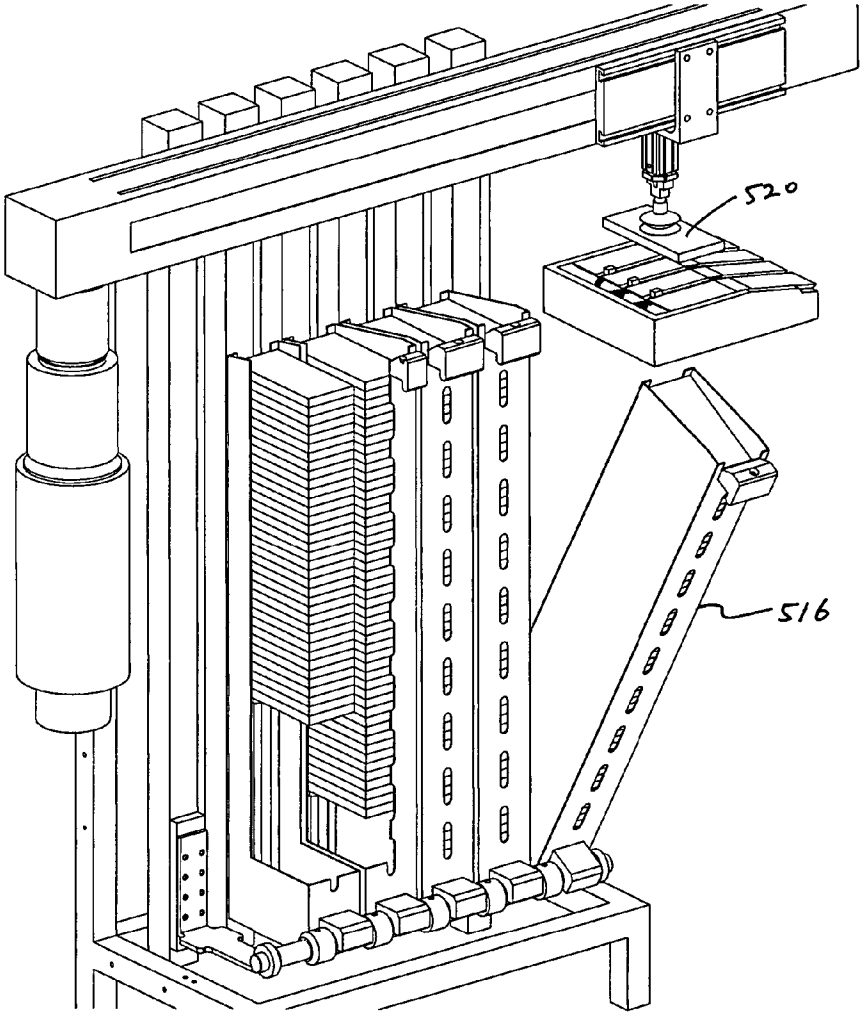
Figure 19G:
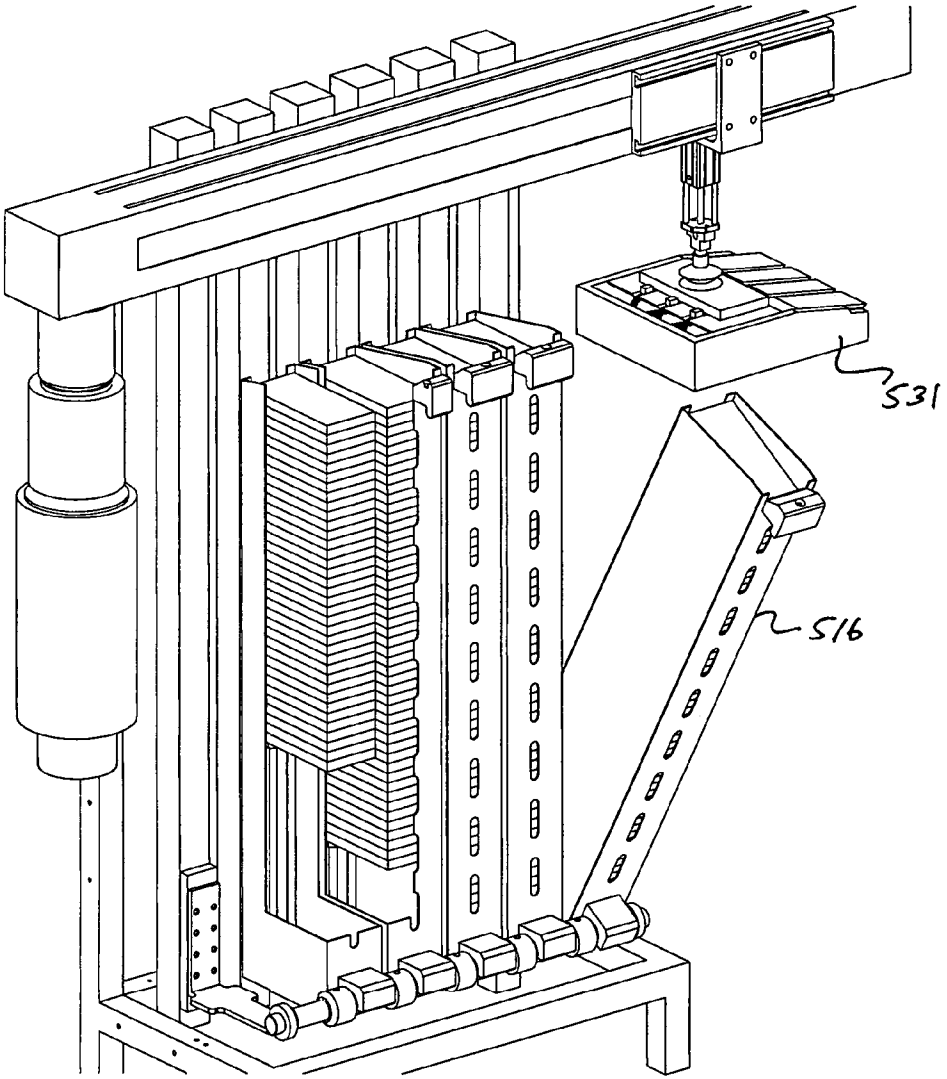
Figure 19H:
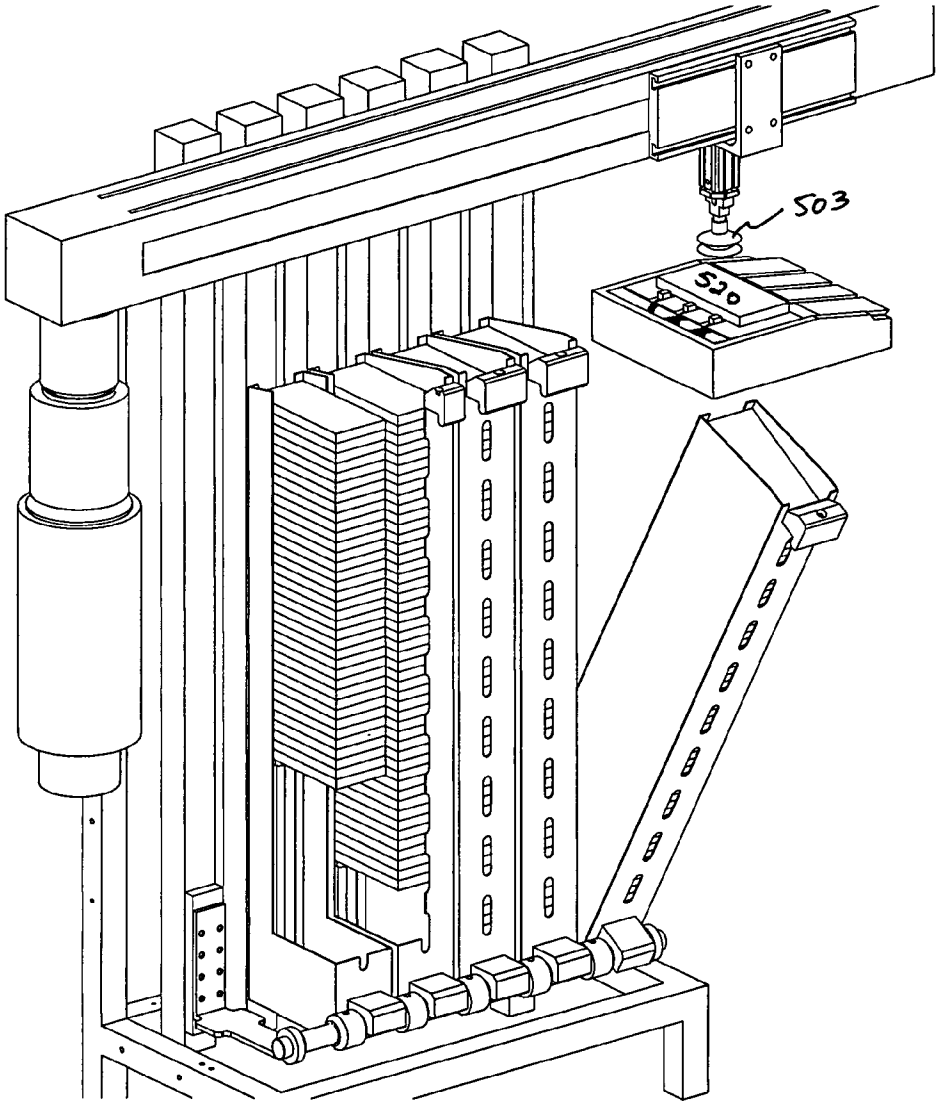
Figure 19I:
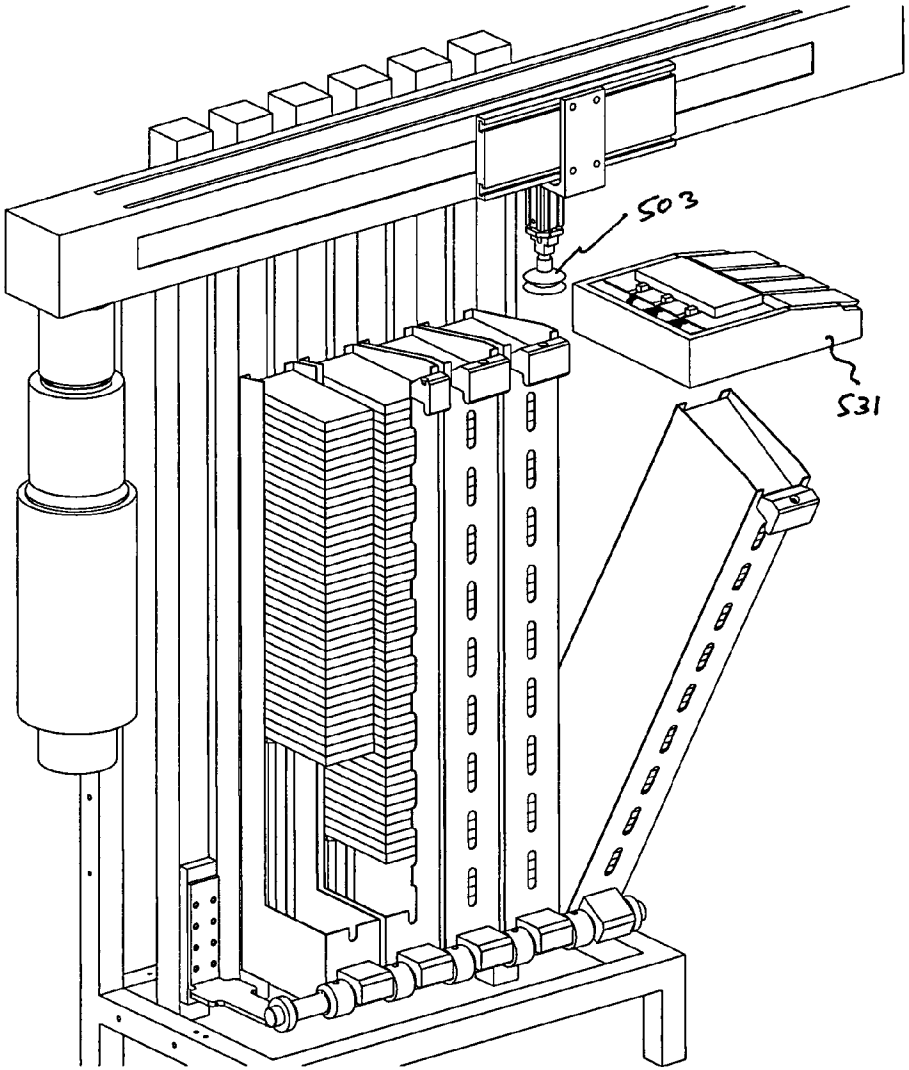
Figure 19J:
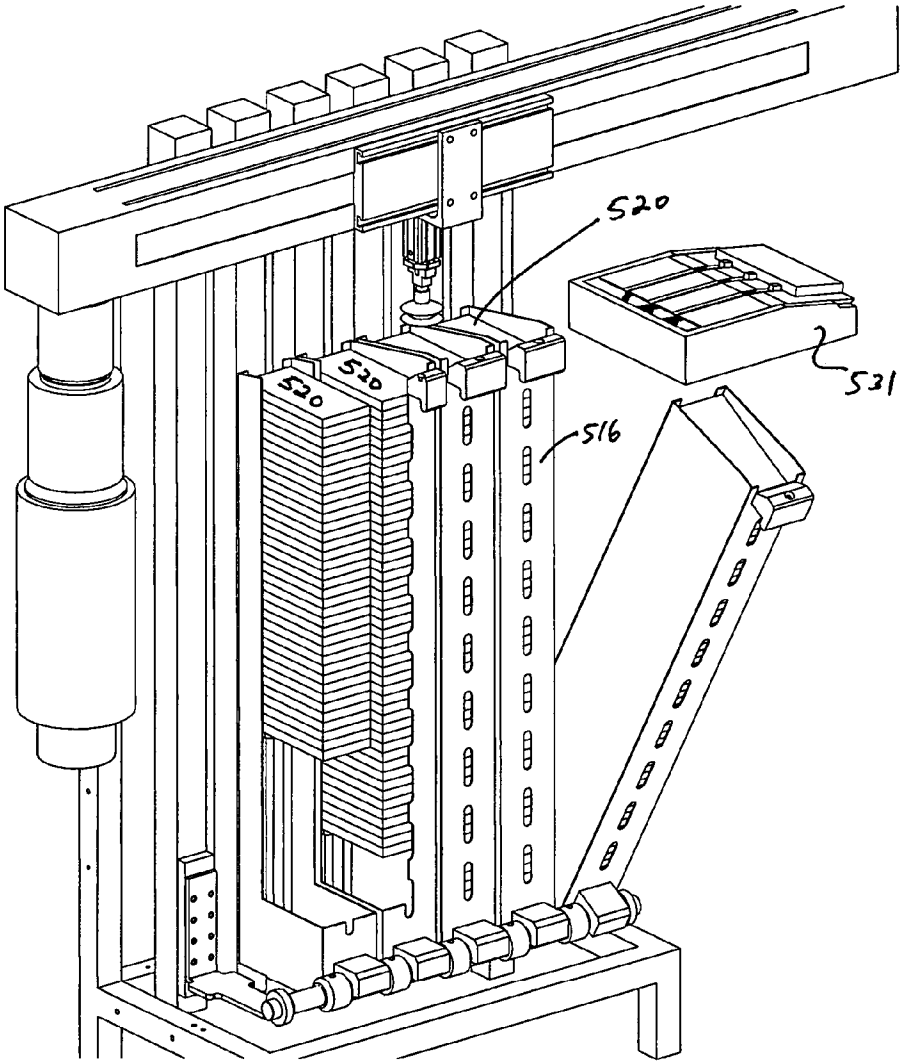
Figure 19K:
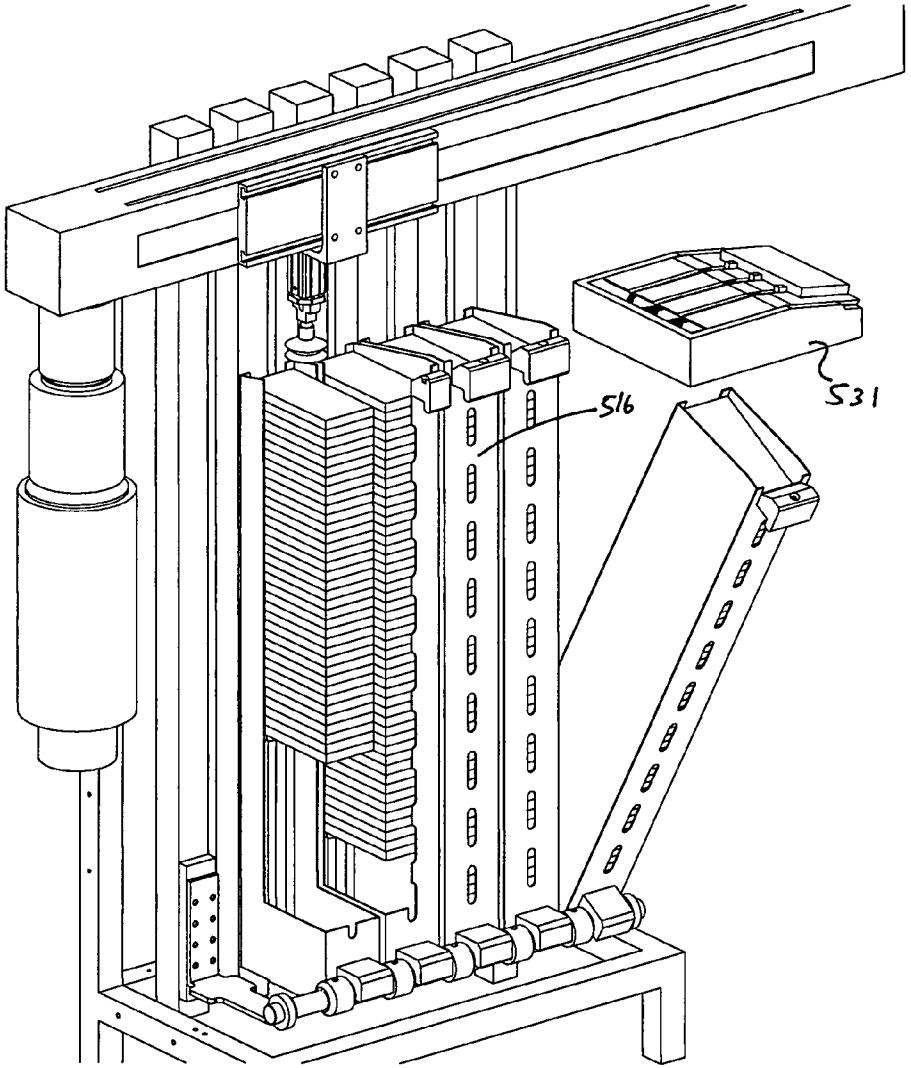

FIG. 18 is an illustrative schematic of an alternative arrangement of an embodiment of the invention. As before, the lower scoop 460 and the product conveyor 414 are situated substantially perpendicularly to each other. However, the feeder mechanism 431 (more generally referred to as a packet deposition mechanism) is no longer situated perpendicularly with respect to the scoop. Rather, it is positioned adjacent the scoop such that its longitudinal axis is parallel to that of the scoop.

Such an arrangement allows for several advantages. First, the packet to be inserted is delivered in the direction of movement of the scoop assembly (Arrow C in FIG. 18). This provides for simplified synchronization of the operation of the packet delivery system and the automated product packager.

Second, a plurality of packets, as opposed to a single packet, can be delivered to the scoop assembly. Thus, for example, two separate packet deposition mechanisms can be placed adjacent the scoop (e.g., the position shown for packet deposition mechanism 431 in FIG. 18) in such a way as to allow one mechanism to deliver a packet through side A of the scoop, and the other to deliver a packet through the horizontal surface 461 of the scoop. The two packet deposition mechanisms would then operate substantially simultaneously in order for the packets to be delivered substantially simultaneously which, in turn, would allow both packets to be deposited in the same bag, one on each side of the loaf of bread.

Alternatively, a single, modified, packet deposition mechanism may be used to deliver more than one packet to the scoop at a time. Moreover, depending on whether one or a plurality of packet deposition mechanisms are used, the system can be configured to operate in conjunction with one or more carousels, each having one or more magazines. Thus, in the illustrative example above, where two packets are included in each bag, each packet can be taken from a different magazine on the same carousel, or from magazines on separate carousels, thus increasing the variety of packets that can be used and decreasing the time required to include more than one packet in each bag.

With reference to FIG. 18, in an alternative embodiment, the scoop assembly may be equipped with one or more rollers, each of which rotates in the direction of movement of the lower scoop. In an illustrative example, a roller may be placed adjacent side A, and a second one adjacent the horizontal surface 461. In operation, the packet deposition mechanism presents a packet to each one of said rollers, each of which, in turn, draws its respective packet in a direction towards the distal end of the scoop, thus depositing the packet on the appropriate side of the scoop. At this point, a stop bar of the kind discussed previously moves down and urges the packet forward as the scoop extends forward.

As mentioned previously in connection with various embodiments of the invention, the packet delivery trays or conveyors may be constituted by or one or more carousel and magazine assemblies, or one or more side-by-side or stacked magazines. When the latter is used, as shown in FIGS. 19A–19K, the packet placer device comprises suction cups of the kind discussed above, except that, in this embodiment, the cups do not cycle by rotating between a pick-up and a drop-off position. Rather, the suction cup assembly, e.g., the holder, having an arm 501 and one or more suction cups 503 of the placer device moves in two linear directions. Thus, as a packet 520 is presented atop the stack of packets in a magazine 516, one or more suction cups move vertically downwards in a direction that is perpendicular to the plane of the packet 520, and secure the packet from above (see FIGS. 19A–19B). With the packet 520 secured, the suction cup(s) then move vertically back up (as in FIG. 19C), and then in a direction that is parallel to the plane of the packet (i.e., usually horizontally), until it reaches a "drop-off" position (see FIGS. 19D–19G).

Once in the "drop-off" position, the suction cup assembly either releases the packet 520 in the drop-off position, or moves vertically down before releasing the packet. Thus, with reference to embodiments in which a feeder mechanism is employed, FIGS. 19H–19K illustrate a configuration in which the arm 501 moves downward and releases the packet 520 onto the feeder mechanism 531. The arm 501 (and thus the suction cup(s) 503) then move up, and back, i.e., away from the feeder mechanism 531, to pick up the next packet 520.

Figure 20:
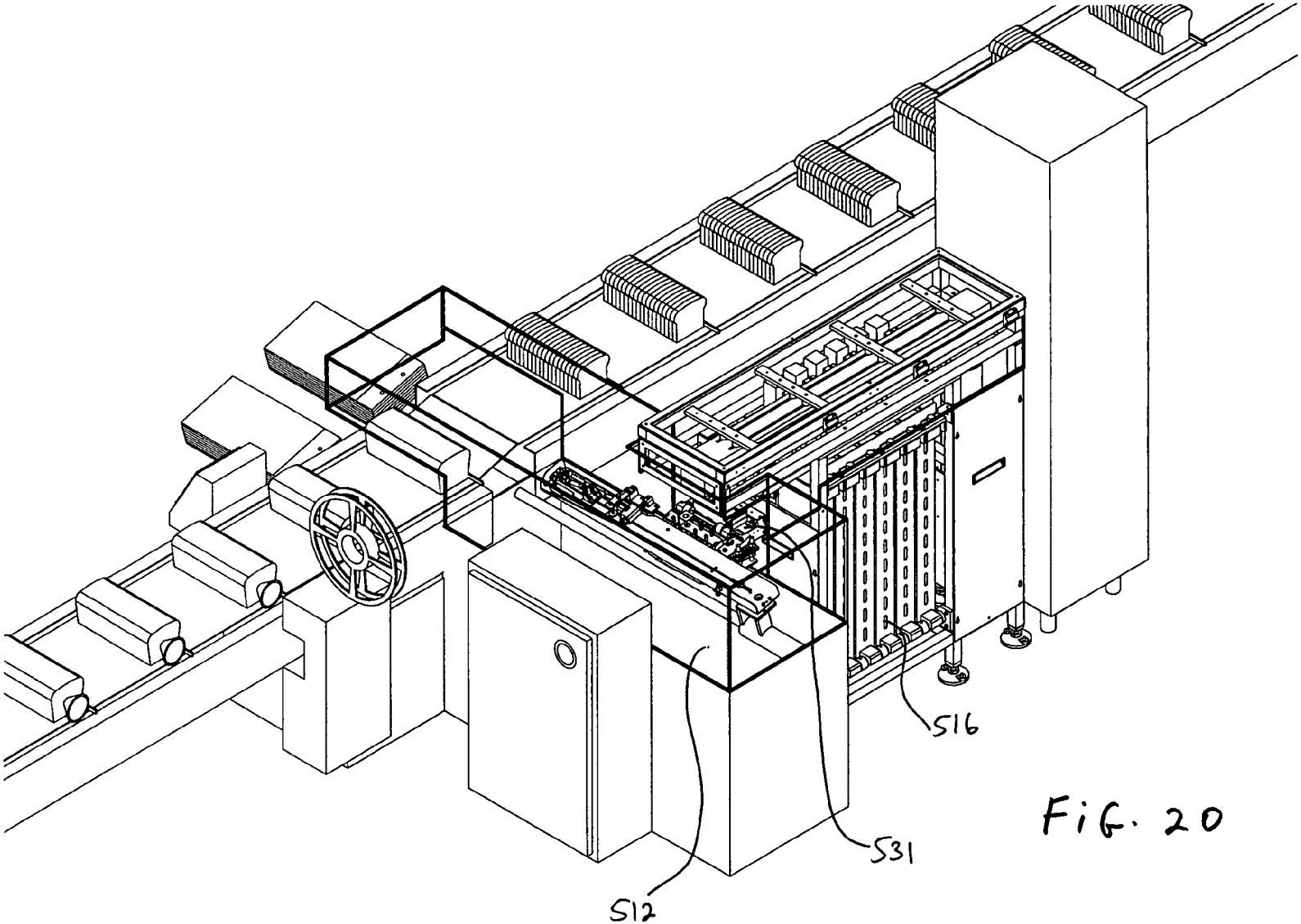
FIG. 20 shows a variation of the arrangement of FIGS. 19A–K in association with a bagging system.

The arrangement described immediately above may be employed in conjunction with either one, or a plurality of (vertical) packet conveyors or delivery trays, e.g., magazines. Thus, in an illustrative example, FIG. 20 shows a configuration in which six magazines 516 are arranged side-by-side, showing a back view of the packet placer device in relation to the feeder mechanism 531 and the packaging machine 512. In addition, as has been described previously, each magazine may also be equipped with sensors, so that, each time a packet is picked up by a packet placer device, a magazine packet advancement mechanism is activated to move the stack of packets up in the vertical direction (via, e.g., a lead-screw-and-knot assembly, or an air-cylinder-and-brake assembly), so as to present the next packet to the packet placer device. Moreover, as before, either the same, or additional sensors, such as bar code readers, e.g., may be used to gather information about each packet that is being picked up, about the quantity of packets remaining in one or more of the magazines, etc. This information may then be transmitted to a PLC to help synchronize the operation of the overall system.

FIGS. 21A–21L show an embodiment of the invention in which a packet placer is used in conjunction with an attachment or adhesion mechanism to place one or more packets on the outside of the wrapper of the product once the latter has been packaged by one or more of the means described hereinabove. The packet placer has a PLC or other controller device. The PLC or controller device may interact with an IT server, which receives information from various sensors, barcode readers, etc., as well as local and/or remote input from human operators, and provides information (e.g., wrapper-packet mapping information) to the controller in the packet placer. Based on this information, the controller, in turn, makes permissive decisions and issues control instructions to enable synchronized operation of the system.

Figure 21A:
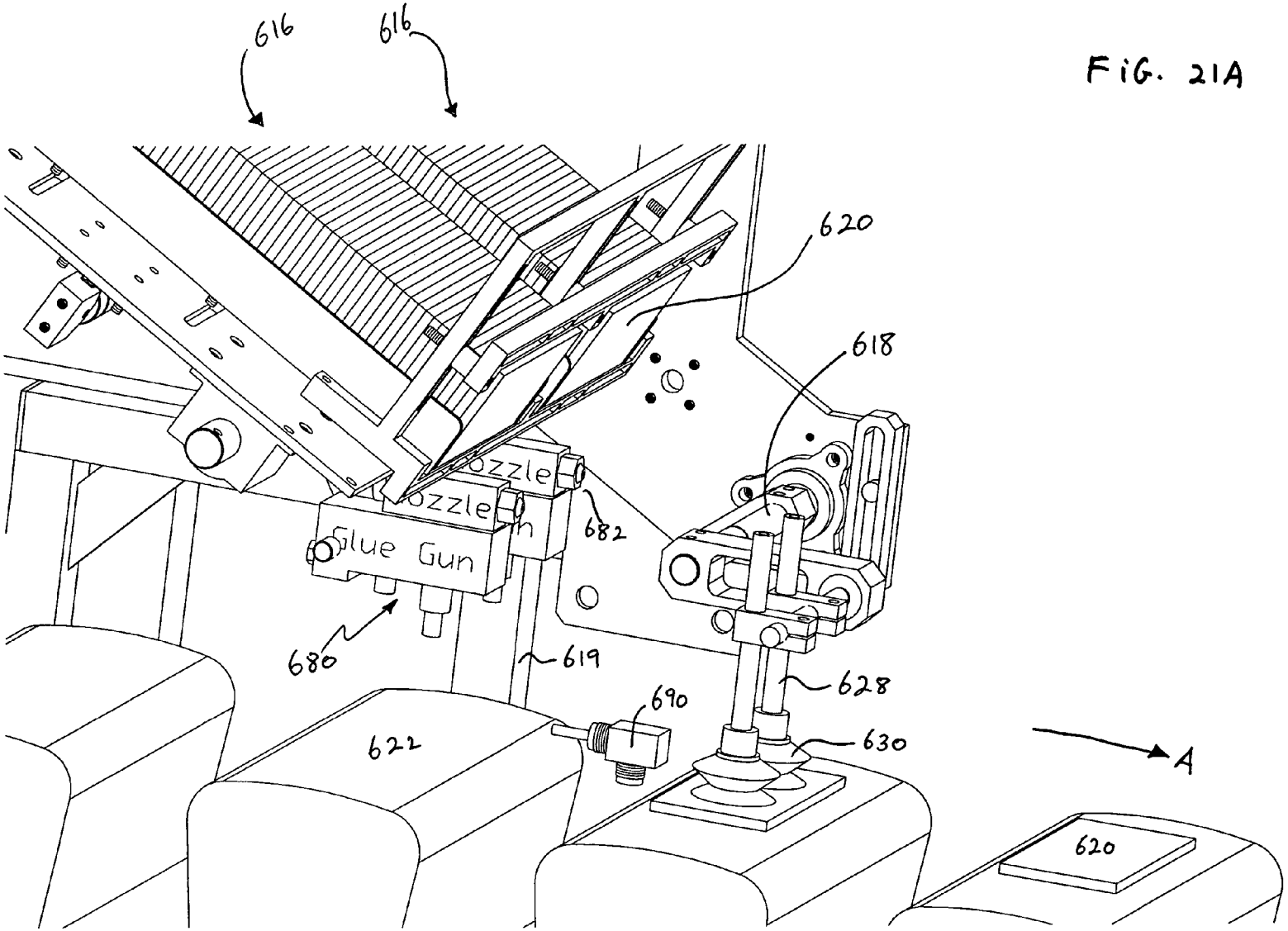
FIGS. 21A–L are schematic views of a packet placing system suitable for use with embodiments of the invention, showing a packet being placed upon a packaged bread product.
Figure 21B:
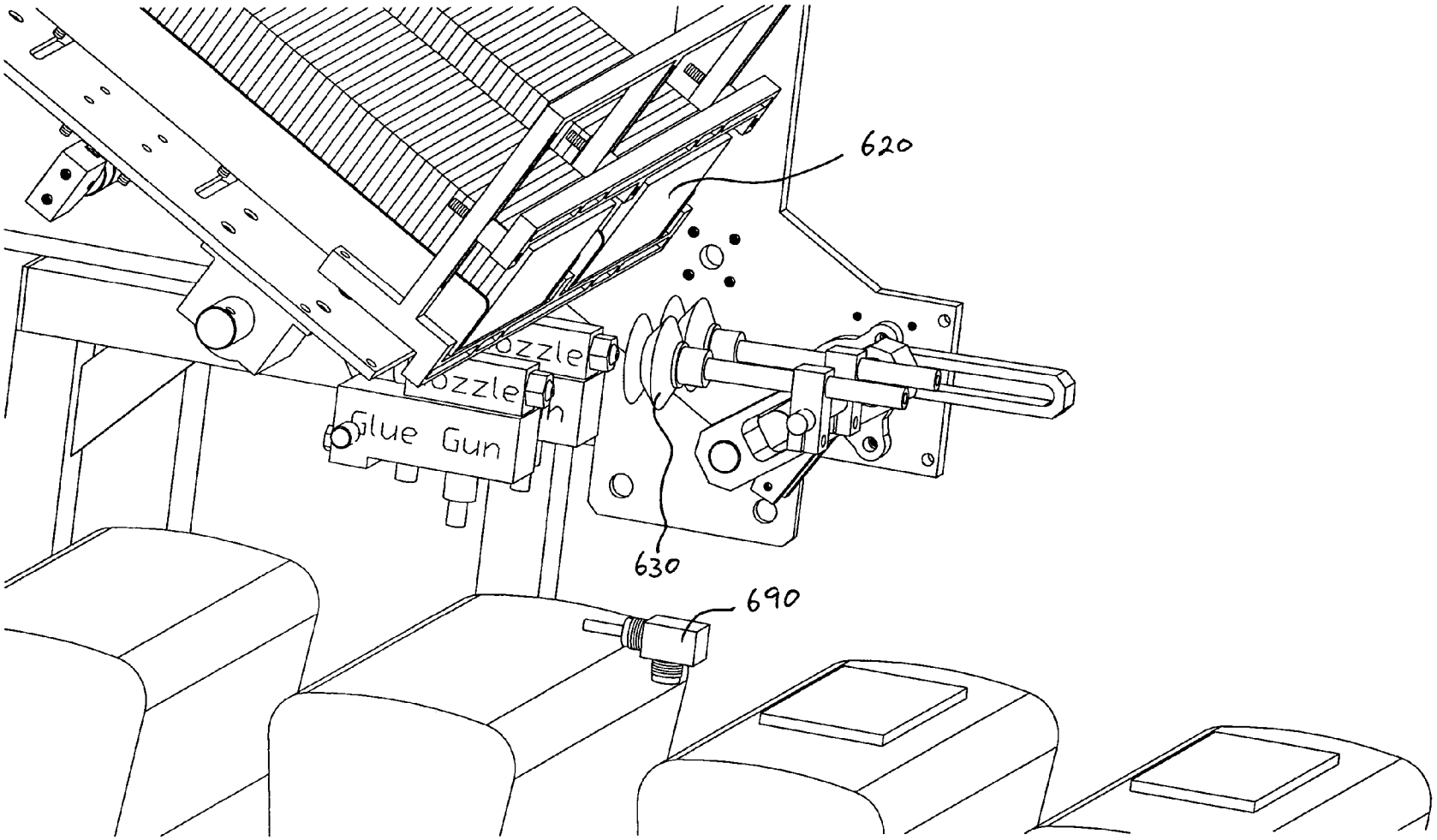
Figure 21C:
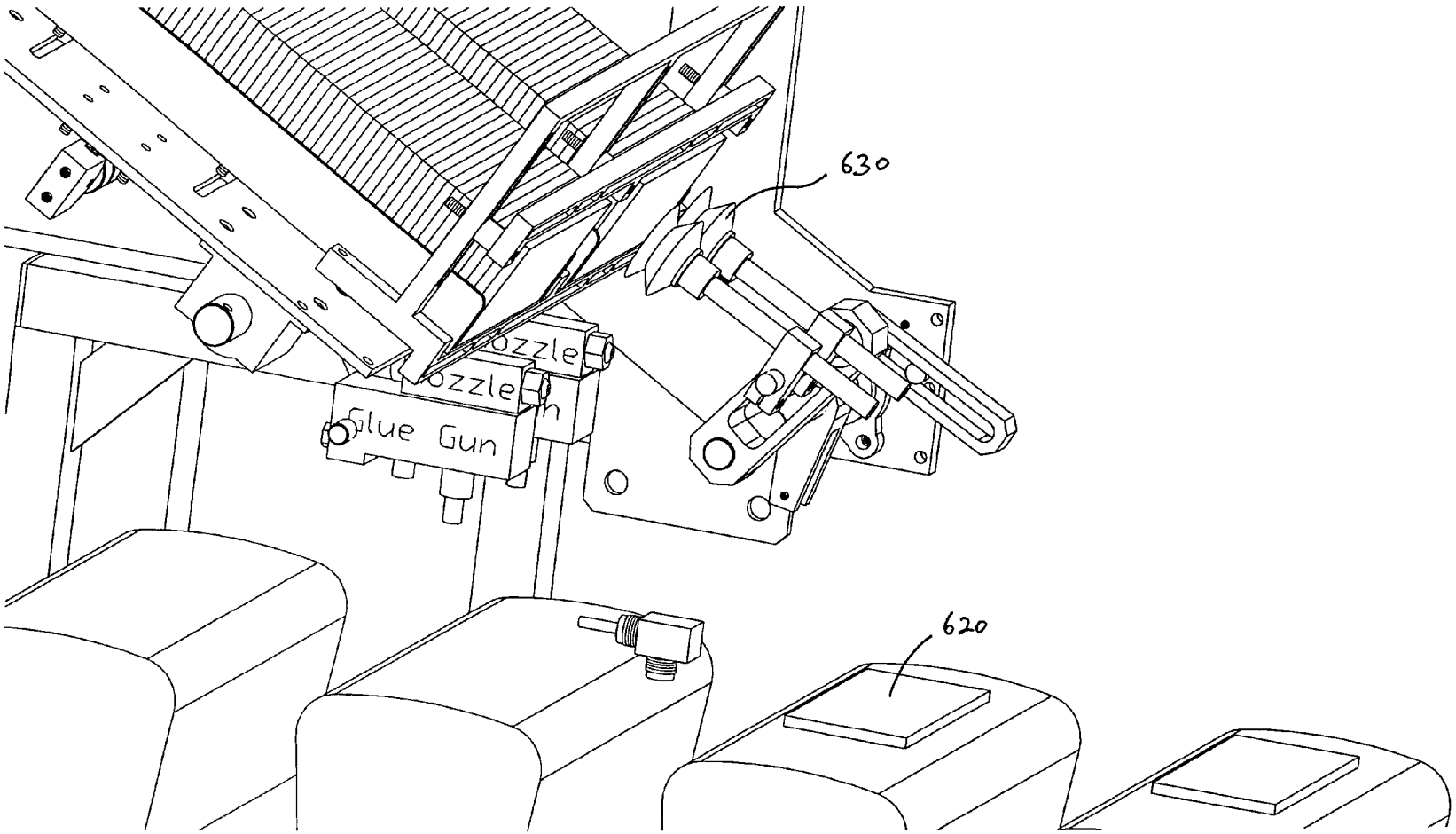
Figure 21D:
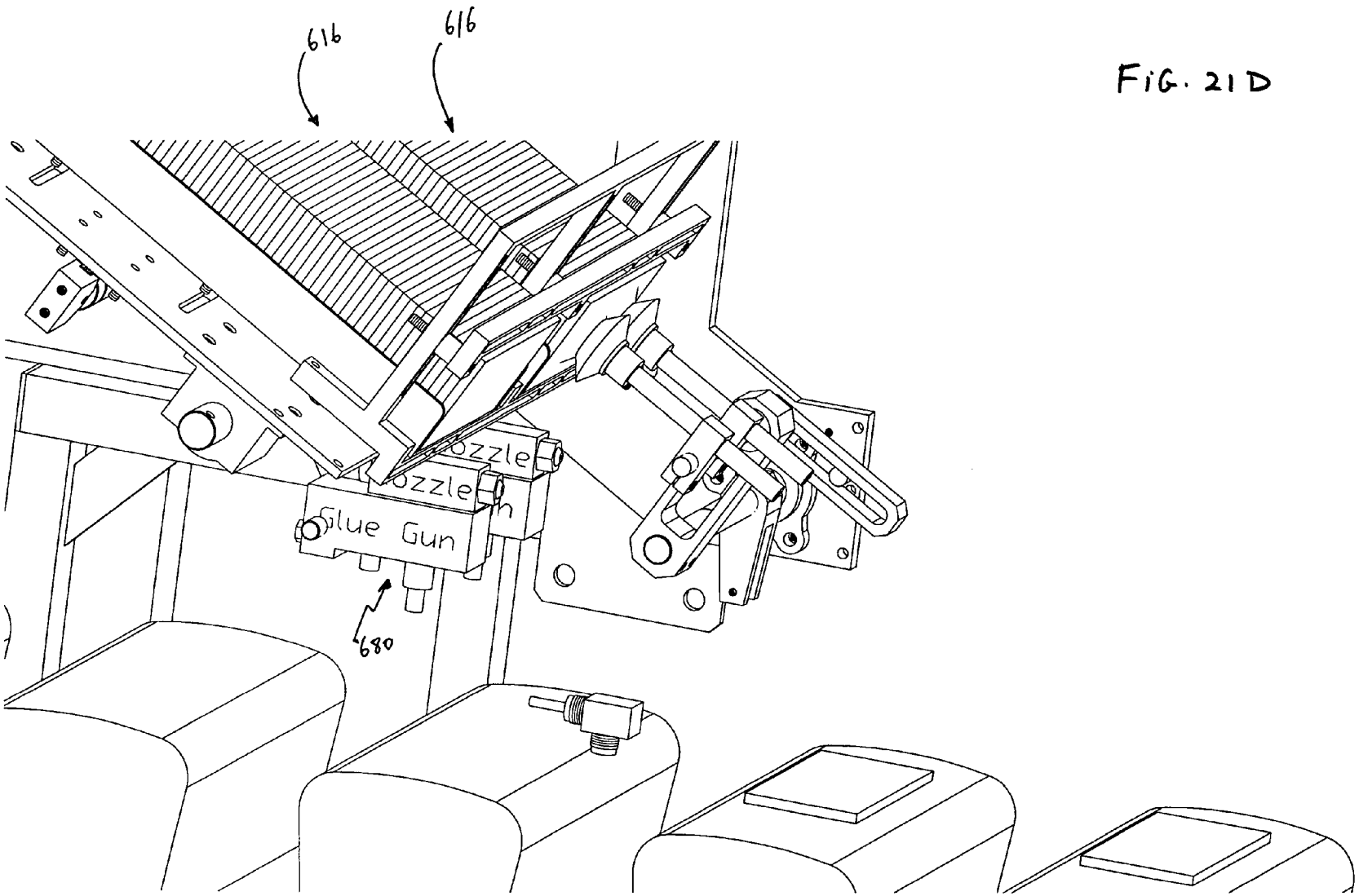
Figure 21E:
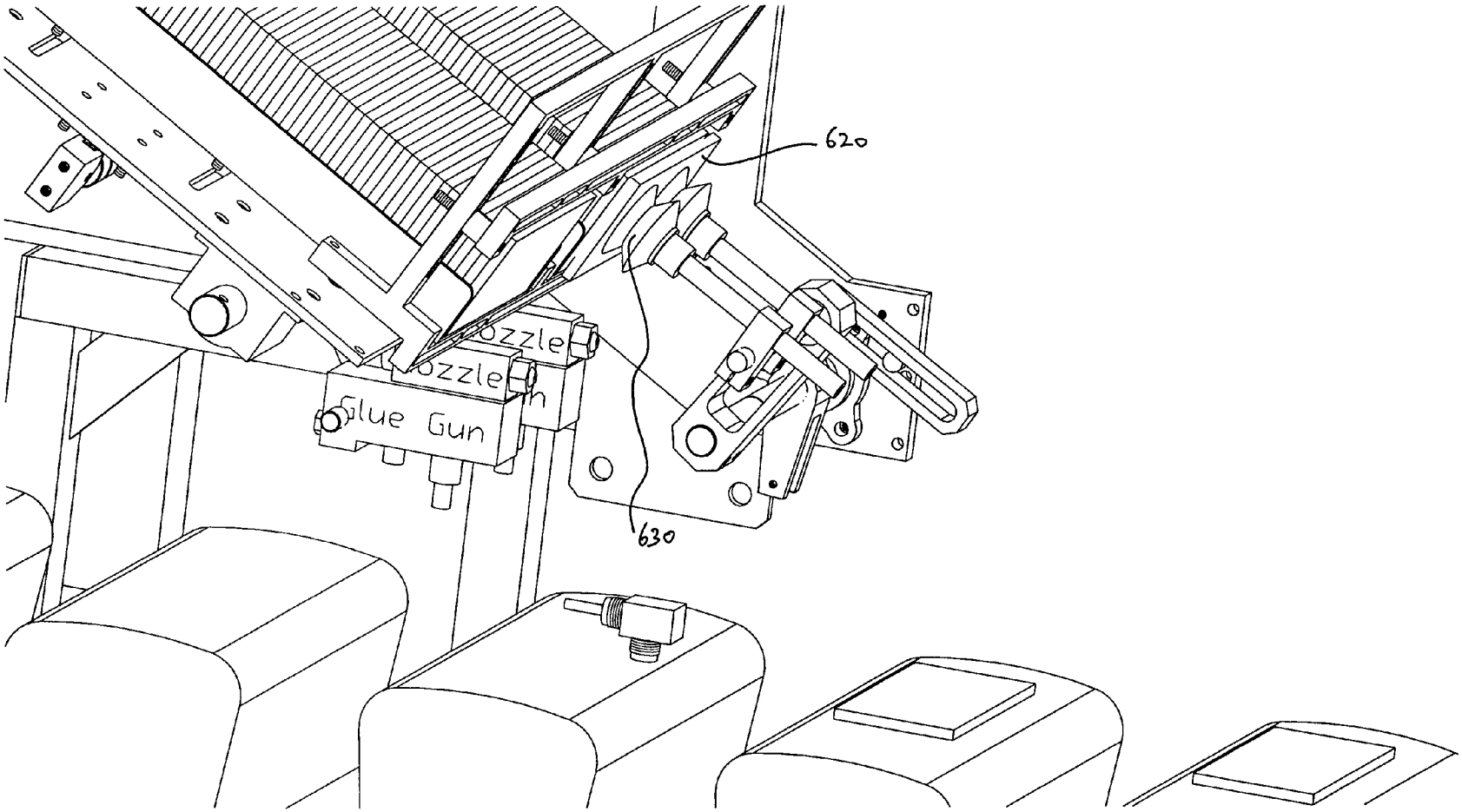
Figure 21F:
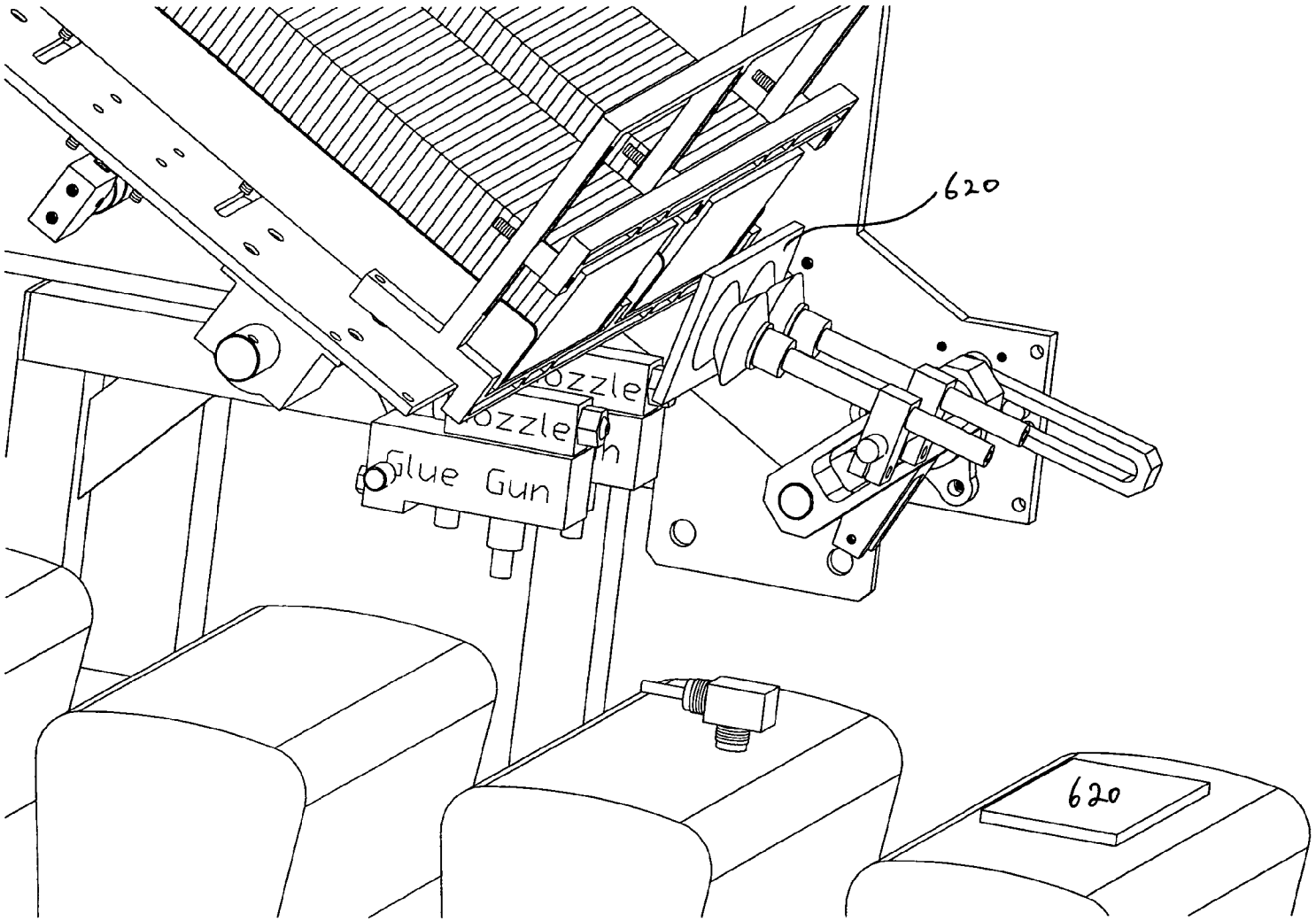
Figure 21G:
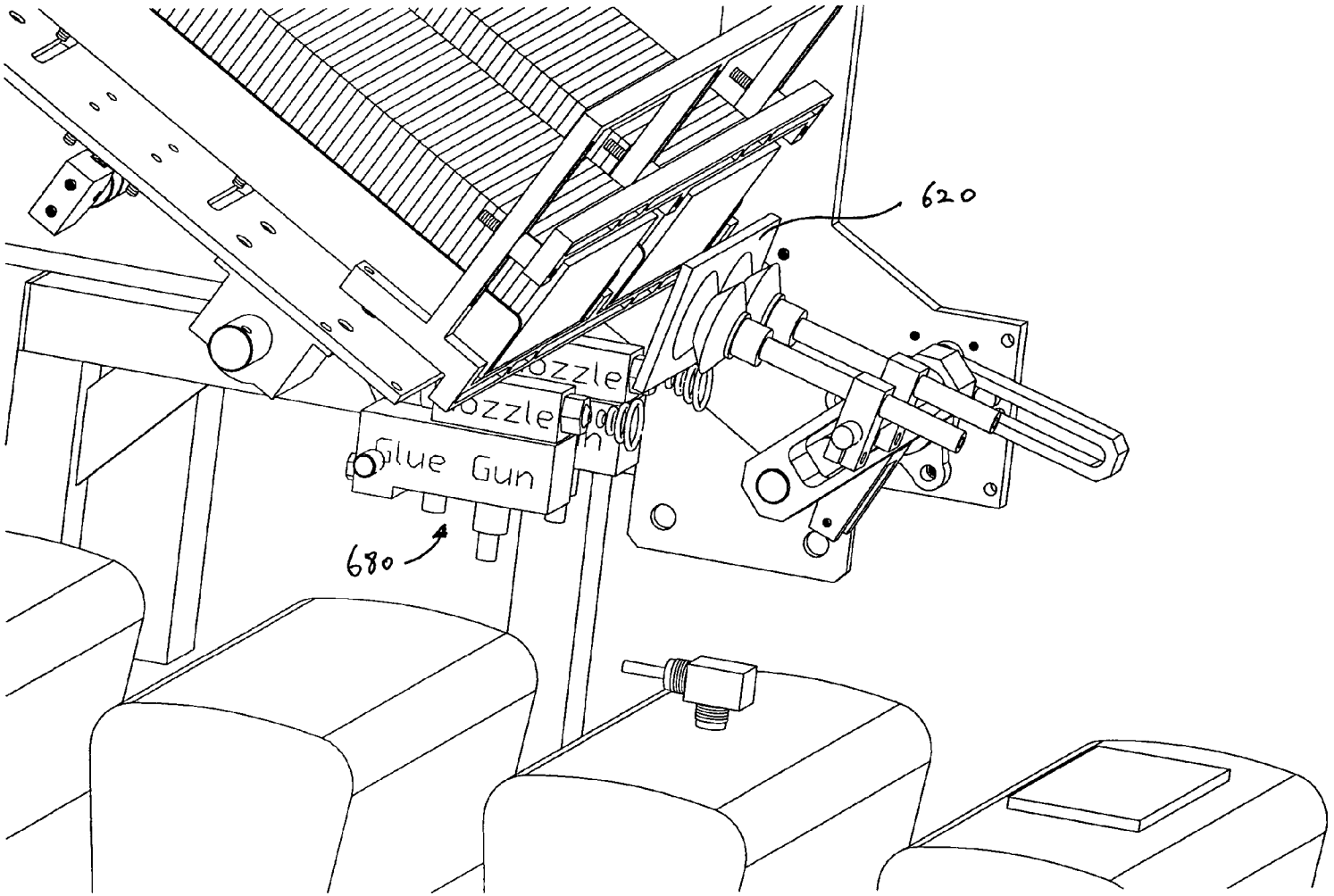
Figure 21H:
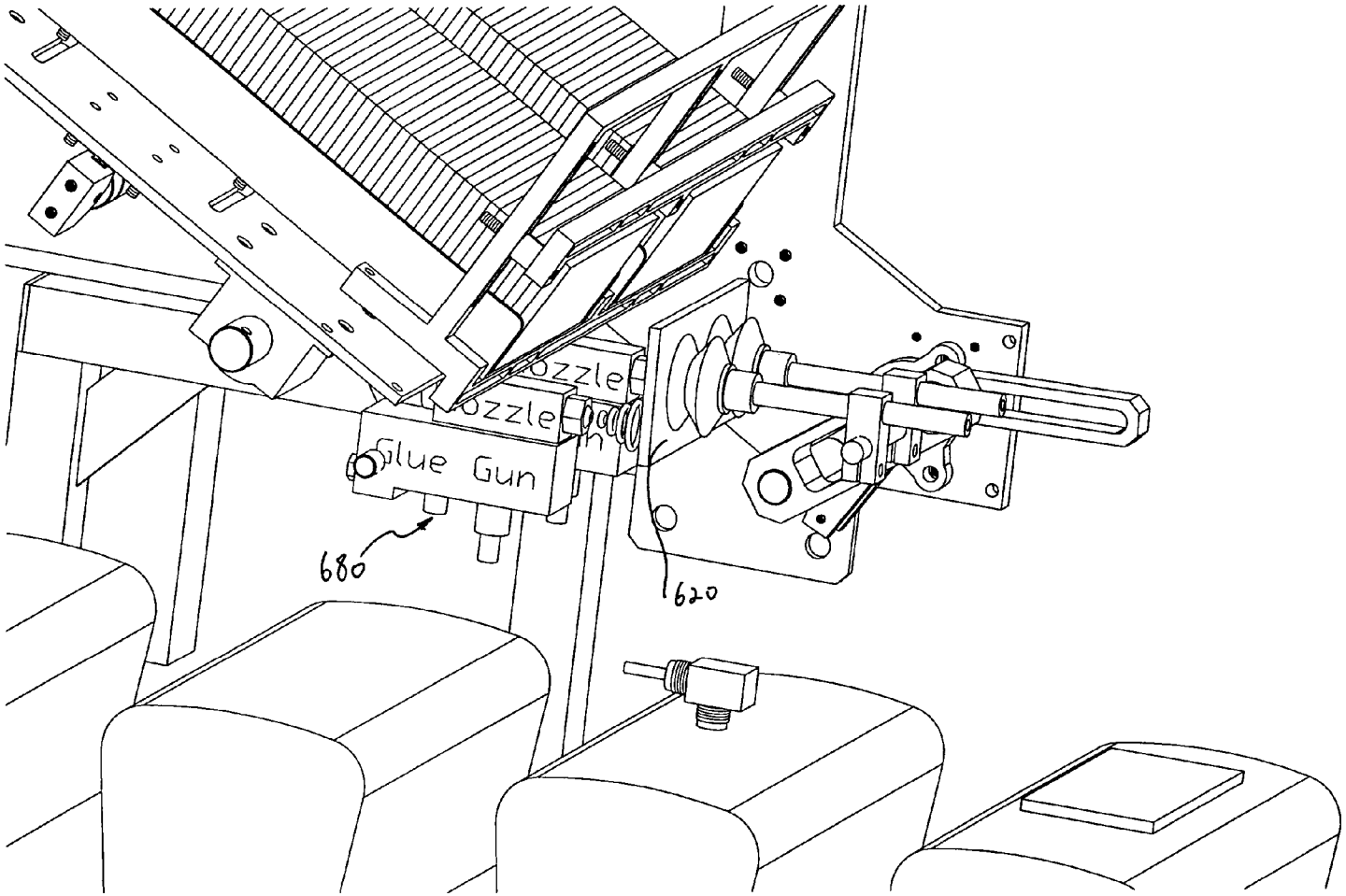
Figure 21:
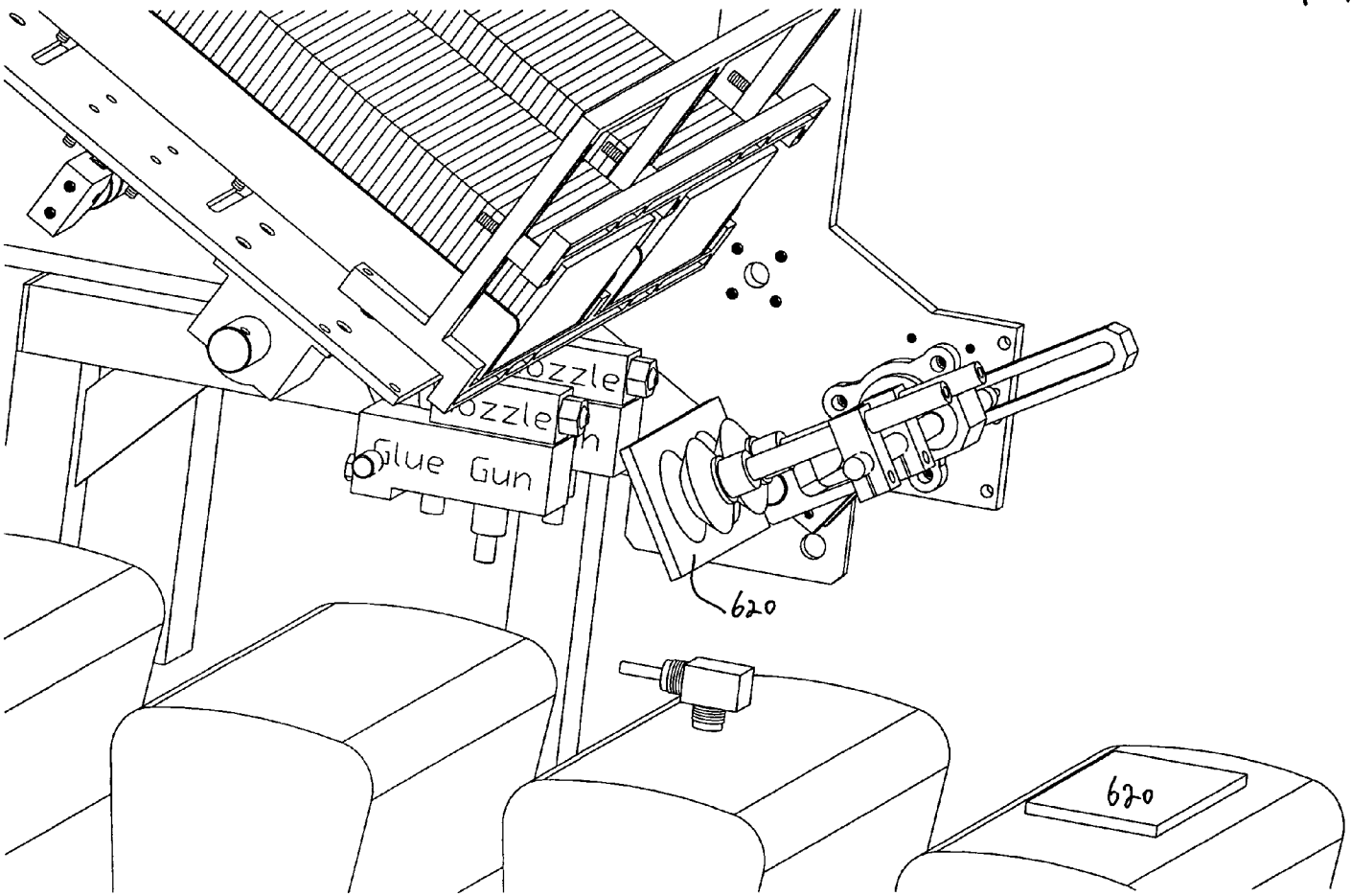
Figure 21J:
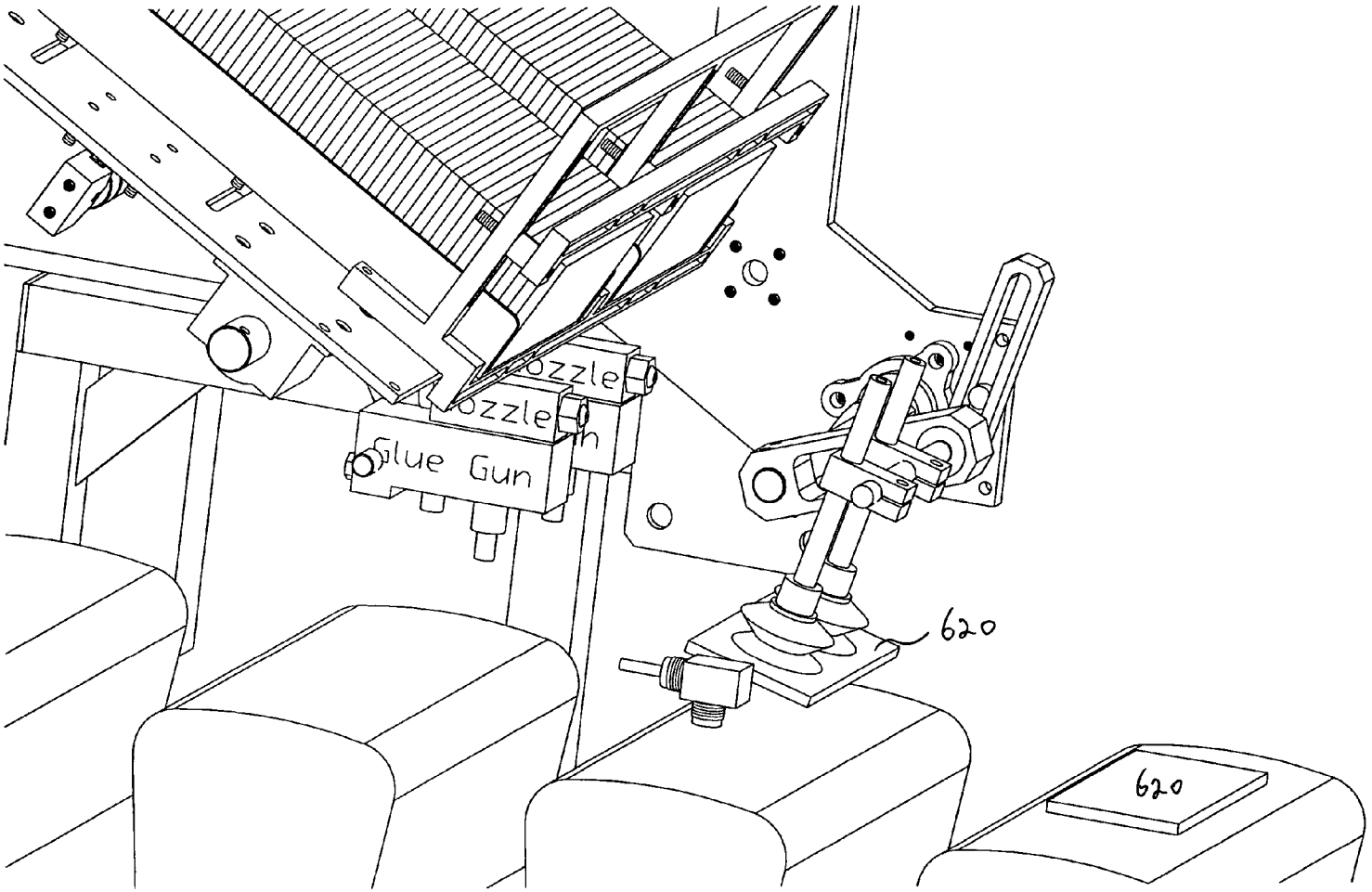
Figure 21K:
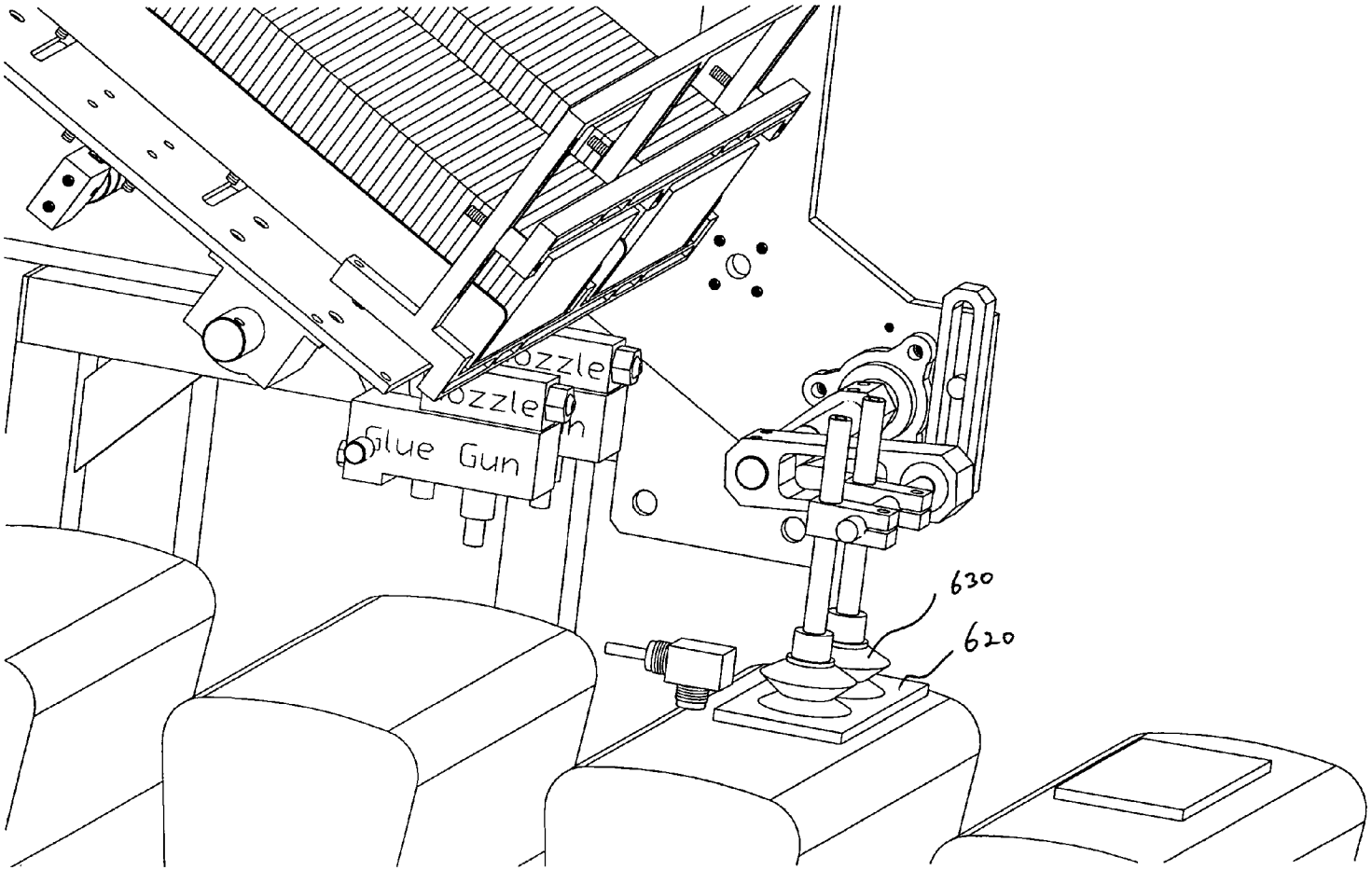
Figure 21L:
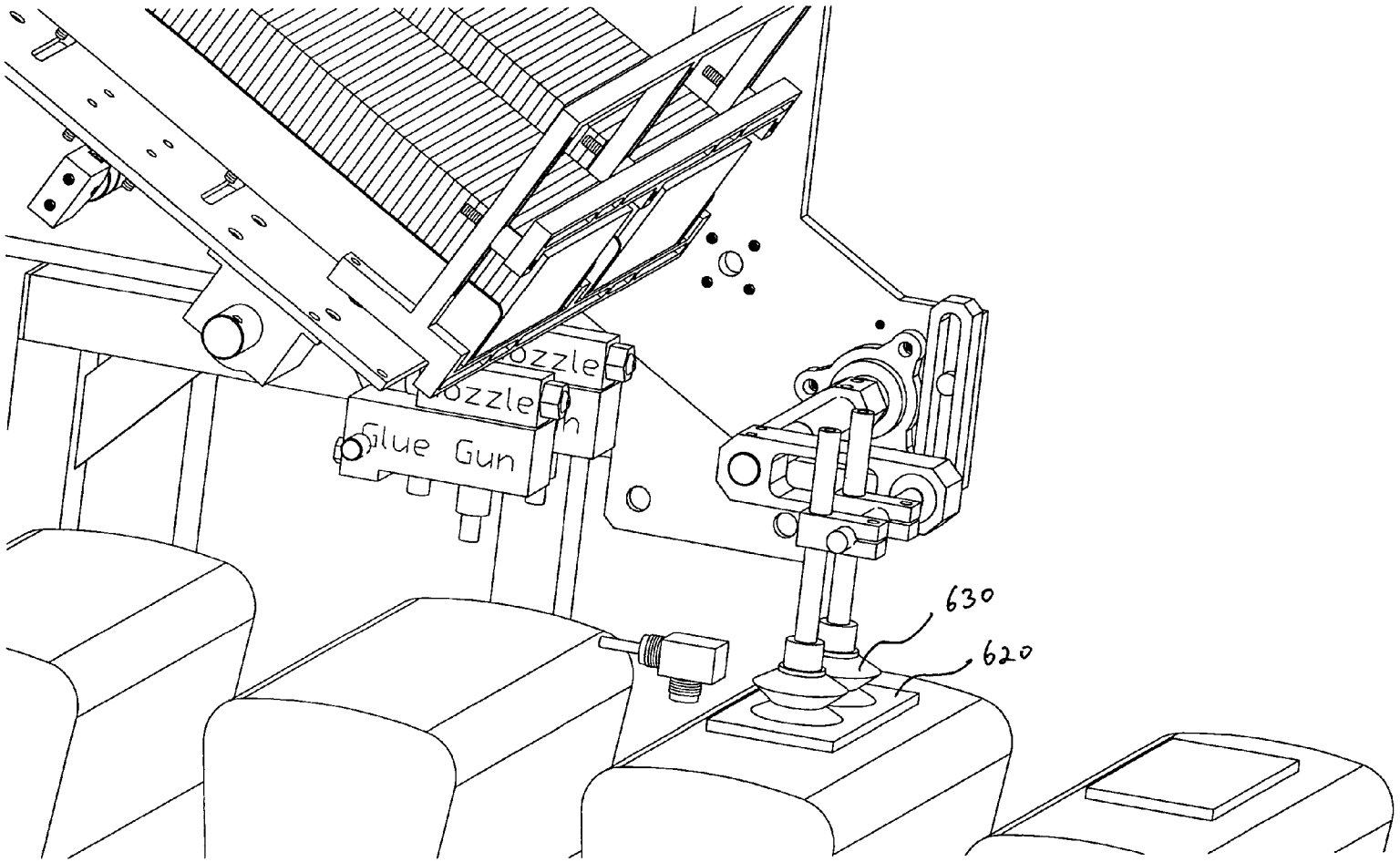
Figure 22:
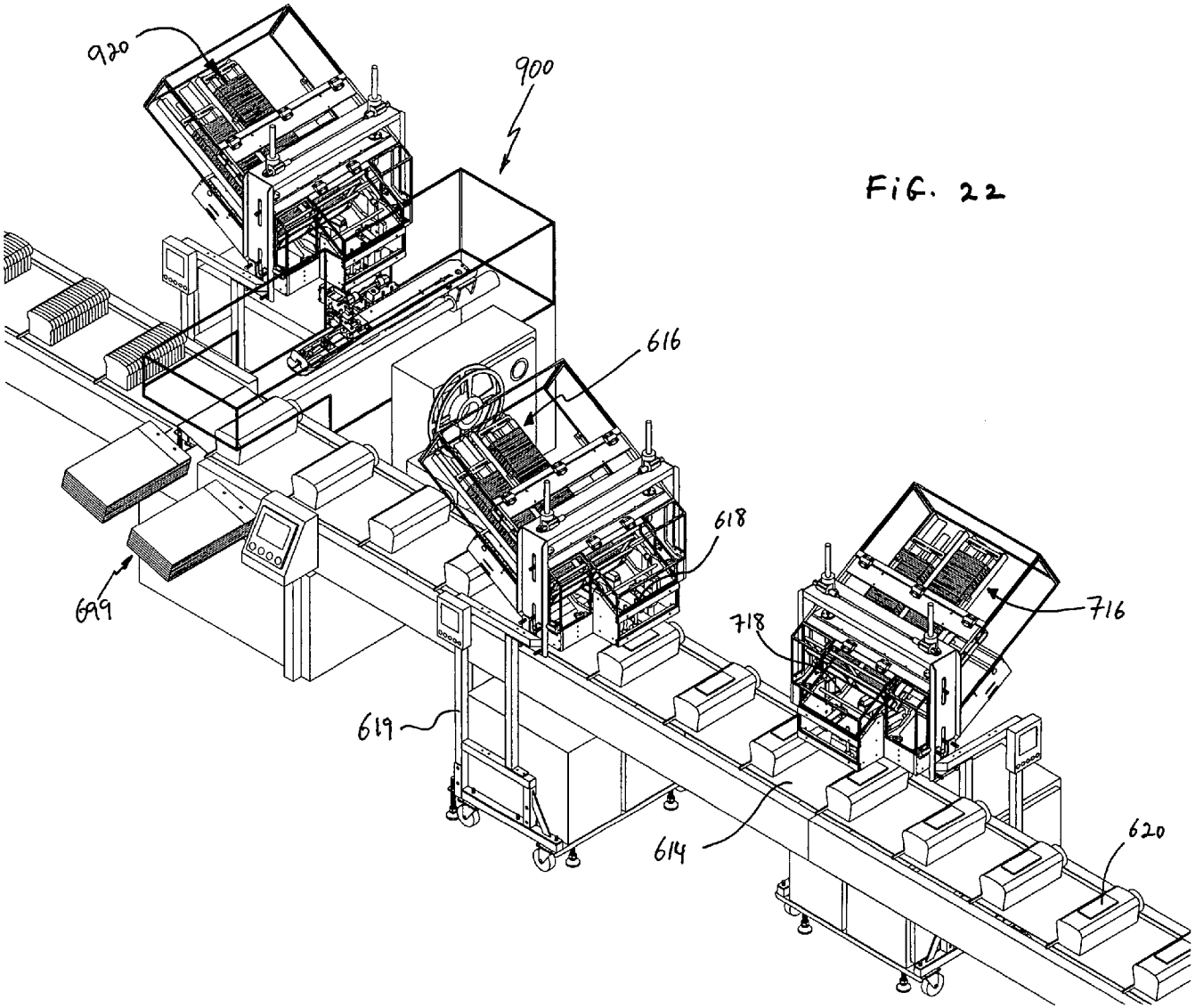
FIG. 22 shows various arrangements of a bagging system, a packet placing system, and a packet insertion system according to embodiments of the invention.

More specifically, in this embodiment, the packet delivery system comprises at least one magazine 616, and a recipe placer 618, which serve the same general functions, respectively, as the packet conveyor 316 and the packet placer 318, described previously. As shown in FIG. 21A, in one embodiment, the recipe placer frame 619 straddles a product conveyor 614 (see FIG. 22), and the product to be packaged, e.g., a loaf or other bread product 622, moves along the product conveyor 614 in the direction of Arrow A. Thus, the longitudinal axes of the magazine(s) 616, as well as the path of motion of the recipe placer 618, are parallel to the line of motion of the product conveyor 614. However, as shown in FIG. 22, the packet delivery system may be positioned perpendicularly with respect to the product conveyor 614, such that the longitudinal axes of the magazine(s) 716, as well as the path of motion of the recipe placer 718, are perpendicular to the line of motion of the product conveyor 614.

Returning to FIGS. 21A–21L, in a preferred embodiment, two or more magazines 616 are slanted downwards at an angle with respect to the product conveyor 614, such that the packets 620 have a natural tendency to slide in the direction of the bread product 622. In this embodiment, the two or more magazines 616 are placed slidably side-by-side in a row, such that, once the quantity of packets 620 of one of the magazines has been depleted, the magazine assembly can be shifted sideways, and the recipe placer 618 can continue to pick packets 620 from the second magazine without interruption. The shifting mechanism may function as described previously in connection with FIG. 5, or in a manner known in the art.

Similarly, depending on spatial limitations, the two (or more) magazines, while still slanted downwards towards the conveyor 614, may be arranged slidably in a vertical stack such that, once the quantity of packets 620 of one of the magazines has been depleted, the magazine assembly can be shifted up/down, and the recipe placer 618 can continue to pick packets 620 from the second magazine without interruption. In alternative embodiments, the row or stack of magazines may be stationary, and the recipe placer may be configured (e.g., by being capable of sliding horizontally or vertically, or by being angled) so as to pick packets from a second magazine once the quantity of packets in a first magazine has been depleted.

Recipe placer 618 cycles among three positions: (1) a "place" position, shown in FIGS. 21A and 21L, which defines the position in which a packet 620 is placed on a bread product 622; (2) a "pick" position, shown in FIG. 21D, which defines the position in which the recipe placer 618 picks a packet 620 from one of the magazines 616; and (3) a "home" or "wait" position, shown generally in FIG. 21B, in which the system may "wait" before moving up to pick another packet or moving down to place a packet that has already been picked.

The recipe placer 618 is an Original Equipment Manufacturer (OEM) reciprocating placing machine that is commercially available and functions generally in a manner similar to that described in connection with the packet placer 18 shown in FIGS. 1–4. Thus, the recipe placer 618 comprises stems 628, each of which carries a vacuum cup 630. The system is configured so that, in the position shown in FIG. 21D, the vacuum cups are brought into contact with packet 620, and a vacuum is applied to cups 630 in order to secure packet 620 to the cups 630. Stems 628 then rotate counterclockwise, as shown in FIGS. 21E–21L, to the "place" position, where the vacuum is released and the packet 620 is placed upon, or removably affixed to, the bread product 622. The stems 628 then rotate clockwise, passing through the "home" position and towards the "pick" position in order to pick another packet 620 (see FIGS. 21A–21D).

The packet delivery system is also equipped with a gluing unit 680. In the preferred embodiment, this is an OEM unit that is available, e.g., through Nordson Corporation, of Westlake, Ohio. The gluing unit 680 includes a pair of swirl nozzles 682 that are disposed underneath the magazines 616 (or 716 in FIG. 22). In addition, the gluing unit may comprise the following standard equipment: ProBlue 7/2 Hose/Gun (main unit, glue pot, heaters, controls); CF201T Spray Head (1/setup); 6-foot Supply Hose, heated (2/setup); Photoeye (1/setup); Solenoid (2/setup); and Solenoid Kits for mounting solenoids (2/setup).

As has been mentioned, in this embodiment, the packet 620 is removably affixed to the bag with which the bread product 622 is packaged. As will be described below, in a preferred embodiment, a special, helical gluing pattern is employed to removably affix the packet 620 to (e.g., the outer top of) the bread bag shortly after the bread has been loaded into the bag. Given the placement of the packet on the package of bread, in the instant embodiment, the size of the packet is configured such that, once affixed to the bread bag, it does not interfere with the overall production, delivery, and sales processes.

The dimensions of the packet 620, therefore, are configured in such a way as to ensure that the package of bread carrying the packet will still fit into trays and/or carts that are normally used in the production and delivery processes. In addition, the dimensions of the packets are determined such that, once the packages of bread are delivered to a retail store, e.g., the bread bags will fit properly and without interference on the trays that are commonly used to transfer the bags from a delivery/storage area to a retail/sales area in the store. Similarly, the dimensions of the packets are configured so as to allow side-by-side and/or stack placement of the bread bags on retail shelves at the store.

Moreover, quite separate from the gluing pattern (e.g., helical), the type of glue that is used will depend on the type of product that is being packaged. More specifically, the type of glue that is used will depend, at least in part, on the dimensions of the bread product that is being packaged, as well as the type and thickness of wrapper (i.e., bag, or package) material that is being used to bag the product. In addition, the specific type of glue, including temperature, duration, and distance of application, are chosen in such a way as to ensure that, on the one hand, the packet is sufficiently securely affixed to the bread bag so as not to become detached from the bag during the distribution process, and yet, on the other hand, the packet is not so strongly attached to the bag such that removal of the packet will tear the bag.

More specifically, it has been found that with most glues that may be available for the current application, the glue is either too hot, so that it melts the (bread) bag when the packet is placed on the bag, or the temperature is too low, such that the packet would not stick to the bag well enough and, as a result, would come off too easily and/or prematurely. In addition, it has been found that placing a glue "strip", or several glue "dots", on the packet also result in melting of the bag during application and/or tearing of the bag during removal of the packet from the bag.

Nevertheless, it has been found that several glues, e.g., 3M's Gummy Glue, National Starch's glue No. 342601, Bostik's glue No. H2916H (preferable), and HB Fuller's removable glue, when used in conjunction with the previously-mentioned gluing unit, with the latter being positioned and used in a gluing process as described below, provides favorable results.

The gluing unit 680, and, more specifically, the nozzles 682, are designed to produce a glue stream in a swirl, or circular/helix pattern that, once on the packet, has the appearance of a spider web. This pattern is produced by the following sequential steps: (1) shooting a stream of air through the nozzles 682 prior to the glue being shot (i.e., "pre-air"); (2) initiating shooting of the glue through the nozzles and ensuring that the air stream stays on during this glue-shooting period; (3) ceasing the glue stream; and (4) ceasing the air stream a short period after the glue has ceased to be shot (i.e., "post-air"). The sequence of the above steps is important because the pre-air and the air stream during shooting of the glue impose the helical pattern on the glue stream, while the post-air ensures that none of the glue lodges into the air nozzles (and thus prevents clogging of the nozzles).

However, with respect to the instant invention, an additional advantage has been found in that the air stream that causes the swirling action also cools the glue so that it does not melt the bag. In addition, the temperature of the glue can be raised to a point where it will flow in the gluing unit. Therefore, when compared to other glue-gluing unit combinations that provide glue "dots" or similar glue patterns with a relatively small surface area, the combination employed in the instant invention allows for a swirling pattern that spreads a small stream of the glue over a larger surface area, thus providing better, and more efficient, adhesion between the packet and the bag.

Thus, adjustment of the temperature of the glue, as well as the duration of application of pre-air, glue, and post-air comprise some of the factors that provide the advantages offered by the instant invention. In this regard, it has been found that the following specifications produce optimum results:

| | | |
|---|---|---|
| 1. | Glue Pot Temperature: | 350° F. (+/− tolerance of machine) |
| 2. | Glue Hose Temperature: | 375° F. (+/− tolerance of machine) |
| 3. | Glue Nozzle Temperature: | 375° F. (+/− tolerance of machine) |
| 4. | Nozzle Sizes: | 0.018 in. diameter (for heavier bags) |
| | | 0.012 in. diameter (for lighter bags) |
| 5. | Pre-Air-Timer: | 0.002 seconds (+0.004/−0.000) |
| 6. | Glue Blow Time: | 0.018 seconds (+/−0.005) |
| 7. | Post-Air-Timer: | 0.002 seconds (+0.004/−0.000) |
| 8. | Air Pressure Swirling Air: | 40 PSI (+/−5 PSI) |
| 9. | Glue Pressure: | 32 PSI (+8/−2 PSI) |
| 10. | Air System Pressure: | 80 PSI (+20/−5 PSI) |

As is explained in further detail below, another important factor is realizing the advantages of the instant invention is to ensure that the distance between the nozzles 682 and the packet 620 during application of the glue to the packet is between 1.5 and 2.5 inches, and preferably 2 inches.

In operation, a "cage" area is set up, at the bakery where the invention is to be used, for storing boxes containing the packets 620. Each box may contain one or more rows of packets, and has a barcode which is scanned when the box is placed into the cage, thus allowing the IT server to add (the contents of) the box to inventory. At the same time, the scanning of the barcode on the box of packets allows for identification and removal of expired and/or incorrect boxes from the cage, such that the contents of such boxes can be physically destroyed (or sent back) and electronically removed from the inventory that is maintained by the server. Then, in order to use the packets on packaged products, one or more boxes are "checked out" of the cage by scanning. Thus, the packets in the checked-out boxes are still "in inventory" until actually affixed to the product.

Once at the conveyor 614, and with the recipe placer 618 running, the barcode on the checked-out box is scanned once (e.g., by a hand-held scanner in communication with the IT server) for each row of packets 620 that is to be placed into each magazine 616. By the same token, each of the magazines 616 also carries a barcode which is now also scanned in a similar fashion. This allows the server, or controller, to associate a specific magazine with one or more rows of the packets that have already been scanned for placing into that specific magazine. The row(s) of packets 620 are then loaded into the magazine 616.

As shown in FIG. 22, the bagging system that is used to wrap the (bread) product 622 includes a plurality of wickets 699 for holding the wrappers prior to packing the bread. Thus, at this point, the bar code on one of the wrappers is scanned. Because the barcode on the wrapper identifies the type and/or retail destination of the bread that will be packaged with that particular group of wrappers, scanning of the bar code on the first wrapper (for each run) provides the IT server with information as to which bread product will be traveling downstream along the conveyor 614.

Then, with the recipe placer 618 in the "home" position, the (empty) vacuum cup(s) 630 rotate clockwise towards the "pick" position. As the cups rotate towards the "pick" position, a vacuum-start-delay-timer is started such that, when it times out, the vacuum comes on so as to be prepared for picking and securing a packet.

Next, at the "pick" position, a pick-delay-timer is initiated (the delay is required for an efficient pick). When the pick-delay-timer times out, the cups pick up a packet 620 from the magazine 616 and begin to rotate back towards the "home" position, where barcode data on the packet is read by a sensor or barcode reader (not shown). The vacuum cups 630 are equipped with one or more sensors, e.g., photoeyes, or vacuum sensors that monitor the vacuum within the cups, that detect the existence of a packet in the magazine. Therefore, if there is no packet, i.e., if no packet is sensed by the vacuum cup sensor or photoeye, then the cups return to the "pick" position and the process is repeated until there is a packet (that is ready to be picked and placed) that is sensed on the vacuum cups. In addition, the cycle will stop after three consecutive failures to read a packet barcode.

Once a packet has been picked and its barcode information read, a sensor (such as, e.g., photoeye 690) is used to detect the leading edge of the bread 622 that is traveling downstream on the conveyor 614. At this point, a bread-delay-timer is started such that, when this timer times out, the packet 620, being held by the cups 630, starts moving towards the "place" position. Here, the leading edge of the packet is detected (e.g., by a photoeye, not shown), and a packet-edge-timer is started such that, when it times out, pattern air (i.e., the pre-air) comes on and is shot through the nozzles.

At this point, a pre-air timer is started. When the pre-air timer times out, a glue-timer starts and glue is shot at the packet. Similarly, when the glue-timer times out, glue stops being shot at the packet, and a post-air-timer starts. Finally, when the post-air-timer times out, pattern air stops blowing. Thus, the packet is sprayed with glue as it rotates through the home position.

Once the packet has been sprayed with the glue, the counterclockwise motion of the cups continues towards the "place" position (see FIGS. 21I–21L). Once at the "place" position, the vacuum turns off, and air blows out from the vacuum cups for a predetermined amount of time to help release the packet from the cups, and the process is repeated in order to pick up and place the next packet 620.

In the above sequence, the duration of the glue timer, the distance between the nozzles and the packet during spraying of the packet with the glue, etc. are controlled by the controller within the packet placer. The controller ensures synchronization of the various components of the invention using information received from the various sensors, as well as information transmitted to and from the IT server, to control the various timers and the recipe placer 618. Thus, for example, using the photoeye 690, the rotation of the cups from the pick/home position towards the "place" position is timed such that the packet arrives at the "place" position just when the bread 622 is ready to receive the packet. Similarly, the gluing period is initiated such that the time between the cessation of the glue timer and the application of the packet to the bread bag is long enough to allow the glue to cool sufficiently (and thus not melt the bag), but short enough to prevent the glue from hardening before the packet is affixed to the bag.

In addition, the. IT server regularly tracks the following data with time/date: the number of bread products that pass through the bagger; the number of packets placed onto bread products (by barcodes); inventory of boxes of packets in trailer delivering the boxes to the bakery; inventory of the boxes in the cage; and inventory of the boxes during operation (i.e., work in progress).

In addition to some of the safeguards that have been described previously, the instant invention provides for additional safeguards for ensuring that the correct packet is being affixed to the correct bag of bread. Thus, for example, one of the pieces of data that is entered into the IT server in the cage area includes, for each packet barcode, a list of bread-bag barcodes that may properly receive this specific packet. In this regard, as mentioned previously, the bread-bag barcode is read at the beginning of each run of new bags. This is generally manually performed by an operator.

The changing of the wicket of bags is detected by a sensor, whereupon the operator is prompted to either approve, or decline, continued operation of the system. Therefore, if the operator does not approve, e.g., by pressing the "Next-Wicket-OK" button before the wicket changes, the cycle will stop and the operator will have to scan a bag from the new wicket. However, if the operator sees that the next wicket of bags is the same as the previous, he can press the "Next-Wicket-OK" button and the cycle will not be interrupted when the wicket changes to a new set of bags.

In addition, if the IT system determines that a given bread bag is not approved for a given packet, the cycle stops. Alternatively, if the bread bag is approved for packets in a different magazine, the magazines shift, such that packets will be picked from the approved magazine.

It will be understood that a mechanism is needed to prevent the packets from falling out of the front end of the magazine (i.e., the end closest to the conveyor 614) when no picking is being done. In addition, it must be ensured that, during the picking operation, only one packet is pulled from the magazine during each cycle. In this regard, various "hold-back" mechanisms may be used in conjunction with the magazine system of the instant invention. These may include, for example: (1) hold-back fingers, which are disposed near the four corners of the packet, and are employed in "standard" machines as known in the art; (2) a spring-loaded finger that is added in the middle, at the top, to keep the second packet from coming out; (3) air cylinders to clamp the packets (except the one that is to be picked) to keep them from sliding out the end during the pick operation; and (4) adjustable "finger(s)", wherein the spacing between consecutive packets is determined by the thickness of the packets (e.g., wider for product samples, such as a chocolate bar, and narrower for single coupons or a multiplicity of coupons, whether placed in an actual "packet" or envelope or not) and may be adjusted accordingly.

It will also be understood that the instant invention is not limited to the illustrative examples used herein. Thus, for example, in detecting the position of the bread as it travels downstream, an average of the leading and trailing edges may be used to estimate the width of the bread product.

Alternatively, graphics, color, and/or other identifying marks or indicia of the bread bag may be used for detection purposes.

Similarly, the glue pattern, application method, air content, etc. may be varied for different types of bread bags so as to be compatible with the thickness and surface adhesion properties of the bag, wherein, e.g., some require more glue, more air pressure, etc. In addition, a barcode reader may be positioned so as to enable reading of the UPC of every bread bag that goes through the bread bagger line. In this way, every bread product can be verified before a packet is affixed to it. Moreover, this system would allow for the collection of fairly accurate information about the production of the plant. Finally, the packet placer of the instant invention may by placed at the distribution line, as opposed to the bagger line (as described and shown in the above examples).

Figure 23:
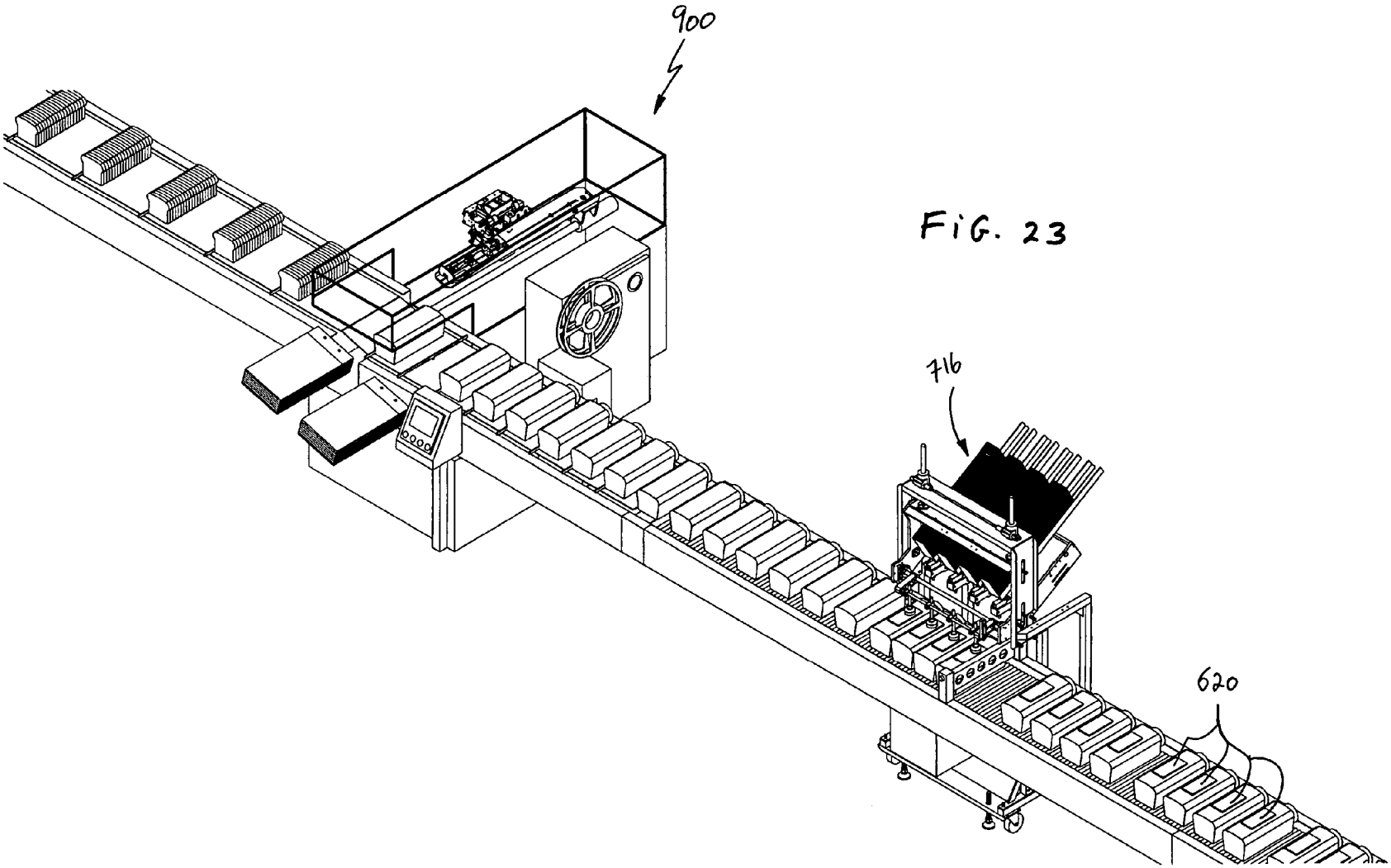
FIG. 23 shows a multiple-head reciprocating placer in conjunction with a bagging and insertion system according to an embodiment of the invention.
Figure 24:
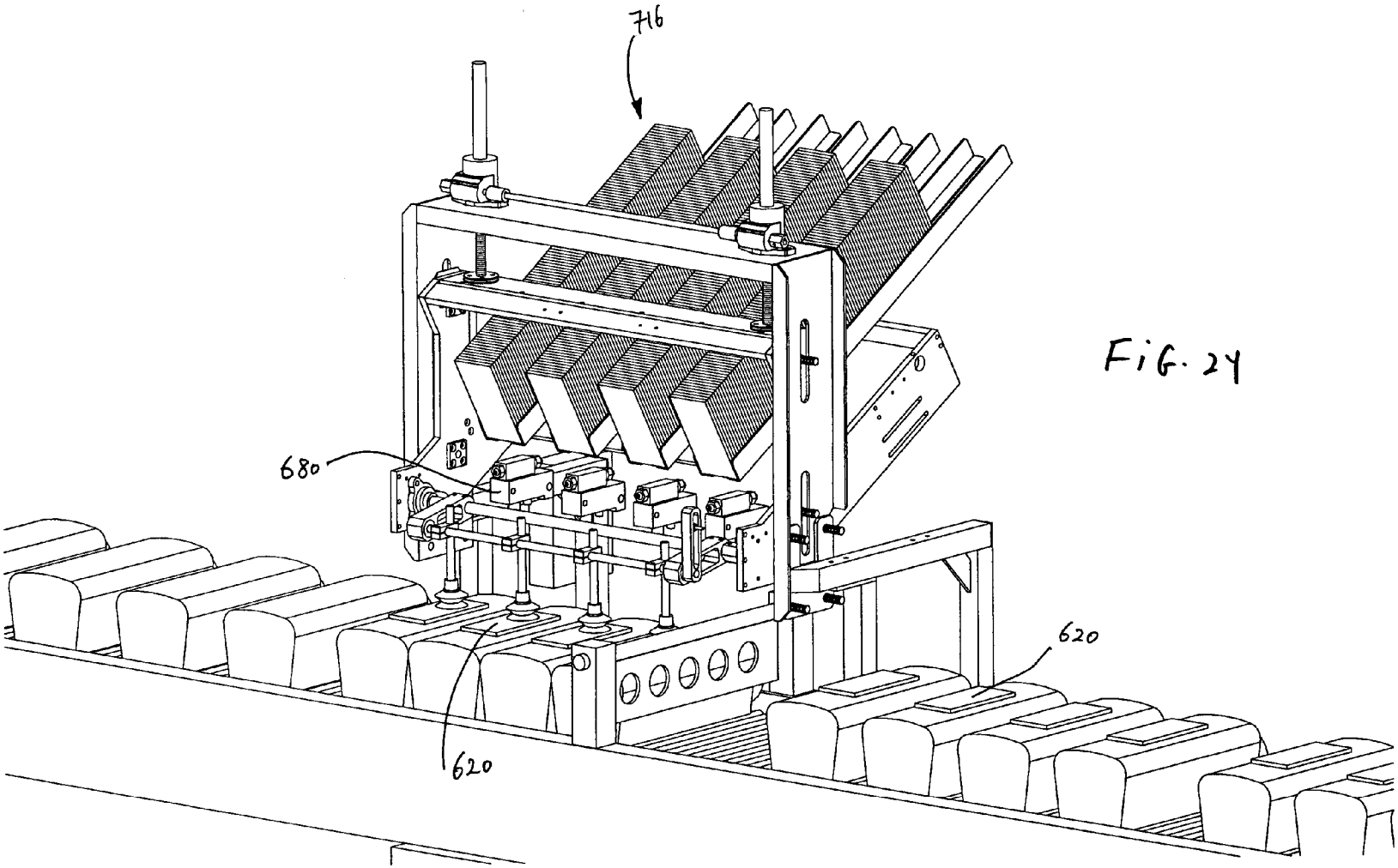
FIG. 24 shows an enlarged view of the multiple-head reciprocating placer of FIG. 23.

It is also noted that multiple-head placers may be used which can pick and place a larger quantity of packets per unit of time. Thus, a multiple head rotary placer may be used wherein the heads do not have to go from the "place" position back to the "pick" position because the heads rotate in a circular pattern, with one head following another. Therefore, while one head is placing, another is picking. In addition, a multiple head recipe placer can use the recipe action to place multiple packets onto multiple pieces of products, all at one time (see, e.g., FIGS. 23 and 24).

It is also noted that, in an alternative embodiment, a plurality of the systems and devices described above may be used in combination to provide at least one packet inside, and affix at least one packet outside, the packaged product. Thus, with reference to FIG. 22, the bagging and insertion system 900 may be used in conjunction with either the recipe placer 618 (and associated magazines, etc.) or the recipe placer 718 (and associated magazines, etc.) to place at least one packet 920 inside, and to affix at least one packet 620 on the outside, of each package.

The packets for use with the invention can be, or may comprise (i.e., within an actual envelope or "packet" ) a wide variety of items and are not limited to thin, planar objects. Typically, the "packets" are, or comprise, printed material such as coupons, product information sheets, promotional material and the like. However, the packet may also be, or comprise, game pieces for contests, sweepstake materials, trading cards, or prizes. The packet may also comprise an envelope having one or more enclosures of the type listed above, or, such enclosures may be bound together without placing in an envelope. Also, the packets can be, or may comprise, product samples such as tea bags, coffee, and dried soup powders contained in suitable pouches.

In the embodiments of the invention utilizing two- and three-fold inserts, the insert may comprise a perforated or otherwise prefolded card, or may comprise an envelope having a corresponding number of pockets. Oftentimes, the size of a packet that is to be used as an insert can be dictated by the Uniform Coupon Council. Currently, the preferred sizes range from a minimum of approximately 1.5"+1.5" to a maximum of approximately 5"+8.5". In addition, thicknesses range from approximately $^{3}/_{1000}$ inch to approximately 1.5 inches.

Although several embodiments have been described herein, one skilled in the art that pertains to the present invention will understand that there are equivalent alternative embodiments. In particular, the embodiments have been described with reference to the delivery of one or more packets to be automatically packaged with a bread product. However, the invention may also be used with any other similarly-packaged product.

What is claimed is:

1. A method of removably affixing a packet onto the wrapper of a packaged product, comprising:

(a) providing a packet placement system comprising:

a first packet placer configured to sequentially travel through a pick-up position, a home position, and a drop-off position;

a first magazine configured to present a first packet to the first packet placer; and a gluing mechanism disposed adjacent said magazine;

(b) activating said packet placer to pick up said first packet from the magazine in the pick-up position;

(c) as the packet travels from the pick-up position towards the drop-off position, activating the gluing mechanism to blow a helical stream of glue onto said packet; and (d) removably affixing the packet to the outer surface of said wrapper.

2. The method of claim 1, wherein the gluing mechanism includes a plurality of nozzles and each nozzle produces a helical stream of glue, and wherein step (c) is performed by:

(i) shooting a stream of air through each said nozzle;

(ii) blowing glue through each said nozzle while continuing to shoot said stream of air;

(iii) terminating the blowing of the glue; and (iv) terminating the shooting of the air stream after blowing of the glue has been terminated.

3. The method of claim 2, further including detecting a leading edge of the packet prior to performing step (i).

4. The method of claim 2, wherein, in step (i), air is shot for a period of time that lasts between about 0.002 and 0.006 seconds.

5. The method of claim 2, wherein the stream of glue is blown for a period of time that lasts between about 0.013 and about 0.023 seconds.

6. The method of claim 2, wherein, after termination of the blowing of the glue stream, the shooting of the air through said nozzles is continued for a period of time that lasts between about 0.002 and 0.006 seconds.

7. The method of claim 2, wherein the air pressure is between about 75 and about 100 pounds per square inch.

8. The method of claim 2, wherein, during application of the glue to the packet, the distance between each of said nozzles and the packet is between about 1.5 and 2.5 inches.

9. The method of claim 8, wherein said distance is about 2.0 inches.

10. The method of claim 1, wherein said product is a bread product.

11. The method of claim 10, wherein said bread product is selected from the group consisting of a sliced loaf of bread, unsliced loaf of bread, hamburger bun, hot dog bun, tortilla, bagel, roll, and a plurality thereof.

12. The method of claim 1, wherein said product is a rice cake, a pop-corn cake, or a plurality thereof.

13. The method of claim 1, wherein the packet is affixed to the top surface of the product's wrapper.

14. The method of claim 1, wherein the packet placer is a reciprocating placer configured to sequentially cycle back and forth among said pick-up, home, and drop-off positions.

15. The method of claim 1, wherein the packet placer is a multiple-head rotary placer.

16. The method of claim 1, wherein said packet placer is a multiple-head reciprocating placer.

17. The method of claim 1, further including providing a controller to synchronize operation of said packet placer, magazine, and gluing mechanism.

18. The method of claim 17, wherein said controller is a programmable logic controller (PLC) or a digital computer.

19. The method of claim 17, wherein the packet placement system comprises at least a second magazine, and the method further includes picking packets from said at least second magazine when the packets in the first magazine have been depleted or upon transmission of a command from the controller to switch magazines.

20. The method of claim 19, wherein at least one of said magazines is slidable with respect to the first packet placer.

21. The method of claim 19, wherein said first and at least second magazines are arranged side-by-side in a row.

22. The method of claim 19, wherein said first and at least second magazines are arranged in a vertical stack.

23. The method of claim 1, wherein said magazine is angled downwards with respect to the horizontal.

24. The method of claim 1, wherein the magazine includes a horizontal section and a downward-slanting section, said downward-slanting section being adjacent said packet placer.

25. The method of claim 1, wherein the packaged product moves past the packet placer on a conveyor, and a plane of the packet placer's path of motion is parallel to the conveyor's line of motion.

26. The method of claim 1, wherein the packaged product moves past the packet placer on a product conveyor, and a plane of the packet placer's path of motion is perpendicular to the conveyor's line of motion.

27. The method of claim 1, further comprising providing a packaging machine for packaging said product with said wrapper prior to placement of said first packet on the wrapper, the packaging machine comprising:

a scoop assembly for additionally placing a second packet inside the wrapper prior to packaging said product; and a conveyor to convey the product past the scoop assembly and the first packet placer.

28. The method of claim 27, wherein the scoop assembly comprises:

a scoop having a horizontal surface for receiving said product prior to being packaged; and a lower compartment disposed underneath said horizontal surface and adapted to receive said second packet to be inserted into said wrapper.

29. The method of claim 28, wherein the packet placement system further includes a second packet placer, a second magazine configured to present said second packet to said second packet placer, and a feeder mechanism disposed adjacent said second magazine and second packet placer and configured to receive said second packet from the second packet placer, the scoop assembly being configured to reciprocate between a retracted position and a forward position, and the method further comprising:

activating said second packet placer to pick up said second packet from said second magazine;

delivering the second packet onto the feeder mechanism; and delivering the second packet, by the feeder mechanism, into the lower compartment of the scoop assembly when the scoop assembly is in the retracted position.

30. The method of claim 29, wherein the scoop assembly is disposed upstream of said first packet placer, and the method further comprises, prior to placement of said first packet on the wrapper of the packaged product, delivering the second packet and the product to be packaged into said wrapper as the scoop assembly moves toward said forward position, thereby providing a first packet on the wrapper and a second packet inside the wrapper.

31. The method of claim 1, wherein the packaged product moves past the packet placer on a conveyor, the method further including detecting the position of the moving product.

32. The method of claim 1, further including verifying, prior to step (c), that a packet is available in the magazine for pick up.

33. The method of claim 32, further including de-activating the packet placer after a predetermined number of consecutive indications that no packet is available for pickup.

34. The method of claim 1, further including reading barcode information on the packet.

35. The method of claim 34, said packet barcode being read after the packet has been picked up.

36. The method of claim 1, wherein said packet placement system is provided at a distribution line.

37. The method of claim 1, further including reading barcode information on said wrapper.

38. The method of claim 37, wherein said barcode is read after the product has been packaged with said wrapper.

39. The method of claim 38, wherein said barcode is read prior to step (d).

40. The method of claim 38, further including using said barcode information to determine a total number of said packaged products that are produced during a pre-determined period of time.

41. A packet placing system for use with an automated packaging machine, comprising:

(a) a first packet placer configured to sequentially travel through a pick-up position, a home position, and a drop-off position;

(b) a first magazine configured to present a first packet to the packet placer; and (c) a gluing mechanism disposed adjacent said magazine, wherein the packaging machine comprises a conveyor to convey a product and a bagging mechanism for packaging said product in a wrapper, the packet placer picking up said first packet from said first magazine in the pick-up position, the gluing mechanism spraying said first packet with a helical glue pattern as the packet travels from the home position to the drop-off position, and, in the drop-off position, the packet being removably affixed to an outside surface of said wrapper containing the product.

42. The packet placing system of claim 41, wherein the packet placer is a reciprocating placer configured to sequentially cycle back and forth among said pick-up, home, and drop-off positions.

43. The packet placing system of claim 41, wherein the magazine is angled downwards with respect to the horizontal.

44. The packet placing system of claim 41, wherein the magazine includes a horizontal section and a downward-slanting section, said downward-slanting section being adjacent said packet placer.

45. The packet placing system of claim 41, wherein a plane of the packet placer's path of motion is parallel to the conveyor's line of motion.

46. The packet placing system of claim 41, wherein a plane of the packet placer's path of motion is perpendicular to the conveyor's line of motion.

47. The packet placing system of claim 41, further comprising a plurality of magazines arranged side-by-side in a row.

48. The packet placing system of claim 41, further comprising a plurality of magazines arranged in a vertical stack.

49. The packet placing system of claim 41, wherein said product is a bread product.

50. The packet placing system of claim 49, wherein said bread product is selected from the group consisting of a sliced loaf of bread, unsliced loaf of bread, hamburger bun, hot dog bun, tortilla, bagel, roll, and a plurality thereof.

51. The packet placing system of claim 41, wherein said product is a rice cake, a pop-corn cake, or a plurality thereof.

52. The packet placing system of claim 41, further including a controller to synchronize operation of said packet placing system and packaging machine.

53. The packet placing system of claim 52, wherein said controller is a programmable logic controller (PLC) or a digital computer.

54. The packet placing system of claim 41, wherein said packet placer is a multiple-head rotary placer.

55. The packet placing system of claim 41, wherein said packet placer is a multiple-head reciprocating placer.

56. The packet placing system of claim 41, wherein the packaging machine further includes a scoop assembly, the scoop assembly comprising:

a scoop having a horizontal surface for receiving said product to be packaged; and a lower compartment disposed underneath said horizontal surface and adapted to receive a second packet to be inserted into said wrapper.

57. The packet placing system of claim 56, further including:

a second packet placer;

a second magazine configured to present said second packet to said second packet placer; and a feeder mechanism disposed adjacent said second magazine and second packet placer and configured to receive said second packet from the second packet placer, wherein the scoop assembly is configured to reciprocate between a retracted position and a forward position, said feeder mechanism delivering the second packet into the lower compartment of the scoop assembly when the scoop assembly is in the retracted position.

58. The packet placing system of claim 57, wherein the scoop assembly is disposed upstream of said first packet placer such that, prior to placement of said first packet on the wrapper of the packaged product, the second packet and the product to be packaged are delivered into said wrapper as the scoop assembly moves toward said forward position.

59. A packet placement system for placing a packet onto the wrapper of a packaged product, the system comprising:

(a) a first packet placer configured to sequentially travel through a pick-up position, a home position, and a drop-off position;

(b) a first magazine configured to present a first packet to the packet placer, the packet placer being configured to pick up said first packet from said first magazine in the pick-up position; and (c) a gluing mechanism disposed adjacent said magazine to blow glue to said first packet with a helical glue pattern as the packet travels from the home position to the drop-off position, wherein, in the drop-off position, the packet placer is configured to removably affix the packet to an outside surface of the product's wrapper.

60. The packet placement system of claim 59, wherein said product is a bread product.

61. The packet placement system of claim 60, wherein said bread product is selected from the group consisting of a sliced loaf of bread, unsliced loaf of bread, hamburger bun, hot dog bun, tortilla, bagel, roll, and a plurality thereof.

62. The packet placement system of claim 59, wherein said product is a rice cake, a pop-corn cake, or a plurality thereof.

63. The packet placement system of claim 59, wherein the gluing mechanism includes a plurality of nozzles, each of the nozzles being configured to blow a helical stream of glue onto said packet.

64. The packet placement system of claim 63, wherein the glue nozzle temperature is about 375° F.

65. The packet placement system of claim 63, wherein each of the nozzles is selected from the group consisting of a 0.012-inch-diameter nozzle size, a 0.018-inch-diameter nozzle size, and nozzle sizes therebetween.

66. The packet placement system of claim 63, wherein, during application of the glue to the packet, the distance between each of said nozzles and the packet is between about 1.5 and 2.5 inches.

67. The packet placement system of claim 66, wherein said distance is about 2.0 inches.

68. The packet placement system of claim 59, wherein the gluing mechanism is configured to apply said glue to said packet for a time period that lasts between about 0.013 and about 0.023 seconds.

69. The packet placement system of claim 59, wherein said magazine includes a hold-back mechanism.

70. The packet placement system of claim 69, wherein said hold-back mechanism is a member selected from the group consisting of corner hold-back fingers, a spring-loaded finger, adjustable hold-back fingers, and combinations thereof.

71. The packet placement system of claim 59, wherein the magazine is angled downwards with respect to the horizontal.

72. The packet placement system of claim 59, wherein, in the drop-off position, the packet is disposed directly above said packaged product.

73. The packet placement system of claim 59, wherein the magazine includes a horizontal section and a downward-slanting section, said downward-slanting section being adjacent said packet placer.

74. The packet placement system of claim 59, wherein the packaged product moves past the packet placer on a conveyor, and a plane of the packet placer's path of motion is parallel to the conveyor's line of motion.

75. The packet placement system of claim 59, wherein the packaged product moves past the packet placer on a product conveyor, and a plane of the packet placer's path of motion is perpendicular to the conveyor's line of motion.

76. The packet placement system of claim 59, further comprising a plurality of magazines arranged side-by-side in a row.

77. The packet placement system of claim 76, wherein at least one of said magazines is slidable.

78. The packet placement system of claim 59, further comprising a plurality of magazines arranged in a vertical stack.

79. The packet placement system of claim 78, wherein at least one of said magazines is slidable.

80. The packet placement system of claim 59, wherein the packet is removably affixed to the top surface of the product's wrapper.

81. The packet placement system of claim 59, wherein the packet placer is a reciprocating placer configured to sequentially cycle back and forth among said pick-up, home, and drop-off positions.

82. The packet placement system of claim 59, wherein the packet placer is a multiple-head rotary placer.

83. The packet placement system of claim 59, wherein said packet placer is a multiple-head reciprocating placer.

84. The packet placement system of claim 59, further including a controller to synchronize operation of said packet placer, magazine, and gluing mechanism.

85. The packet placement system of claim 84, wherein said controller is a programmable logic controller (PLC) or a digital computer.

86. The packet placement system of claim 59, in combination with a packaging machine for packaging said product with said wrapper prior to placement of said first packet on the wrapper.

87. The packet placement system of claim 86, wherein the packaging machine includes a scoop assembly for additionally placing a second packet inside the wrapper prior to packaging said product and a conveyor to convey the product past the scoop assembly and the first packet placer.

88. The packet placement system of claim 87, wherein the scoop assembly comprises:

a scoop having a horizontal surface for receiving said product prior to being packaged; and a lower compartment disposed underneath said horizontal surface and adapted to receive said second packet to be inserted into said wrapper.

89. The packet placement system of claim 88, further including:

a second packet placer;

a second magazine configured to present said second packet to said second packet placer; and a feeder mechanism disposed adjacent said second magazine and second packet placer and configured to receive said second packet from the second packet placer, wherein the scoop assembly is configured to reciprocate between a retracted position and a forward position, said feeder mechanism delivering the second packet into the lower compartment of the scoop assembly when the scoop assembly is in the refracted position.

90. The packet placement system of claim 89, wherein the scoop assembly is disposed upstream of said first packet placer such that, prior to placement of said first packet on the wrapper of the packaged product, the second packet and the product to be packaged are delivered into said wrapper as the scoop assembly moves toward said forward position.

91. The packet placement system of 86, wherein said wrapper has a barcode and said packaging machine further includes means for reading said barcode.

92. The packet placement system of 91, wherein said means for reading is disposed so as to read the barcode after packaging of said product with said wrapper and prior to placement of said first packet on the packaged product.

93. The packet placement system of claim 59, wherein the packaged product moves past the packet placer on a conveyor, the system further including means for detecting the position of the moving product.

94. The packet placement system of claim 59, further including means in the packet placer for detecting whether a packet is available in the magazine for pickup.

95. The packet placement system of claim 59, wherein said packet placer is located at a distribution line.

* * * * *